US006567641B1

(12) United States Patent
Aslam et al.

(10) Patent No.: US 6,567,641 B1
(45) Date of Patent: May 20, 2003

(54) SLEEVED ROLLERS FOR USE IN A FUSING STATION EMPLOYING AN EXTERNALLY HEATED FUSER ROLLER

(75) Inventors: Muhammed Aslam, Rochester, NY (US); Jiann-Hsing Chen, Fairport, NY (US); Arun Chowdry, Rochester, NY (US); John W. May, Rochester, NY (US); Borden H. Mills, Rochester, NY (US); Alan R. Priebe, Rochester, NY (US); Kenneth D. Stack, Rochester, NY (US); Biao Tan, Rochester, NY (US); Joseph A. Pavlisko, Pittsford, NY (US)

(73) Assignee: NexPress Solutions LLC, Rochester, NY (US)

( * ) Notice: Subject to any disclaimer, the term of this patent is extended or adjusted under 35 U.S.C. 154(b) by 175 days.

(21) Appl. No.: 09/680,134

(22) Filed: Oct. 4, 2000

(51) Int. Cl.[7] ..... G03G 15/20

(52) U.S. Cl. ..... 399/330; 219/216; 399/328; 399/331; 399/333

(58) Field of Search ..... 219/216; 399/12, 399/328, 330, 331, 333; 430/98, 99

(56) References Cited

U.S. PATENT DOCUMENTS

| | | | | |
|---|---|---|---|---|
| 1,322,843 | A | 11/1919 | Townsend | |
| 1,457,781 | A | 6/1923 | Loughead | |
| 2,721,601 | A | 10/1955 | Spencer | |
| 2,782,459 | A | 2/1957 | Moncrieff | |
| 2,980,474 | A | 4/1961 | Gargan | |
| 2,988,387 | A | 6/1961 | Eschmann et al. | |
| 3,647,589 | A | 3/1972 | Felden | 156/165 |
| 3,846,901 | A | 11/1974 | Lovett | 29/450 |
| 4,119,032 | A | 10/1978 | Hollis | 101/216 |
| 4,344,700 | A | 8/1982 | Kasama et al. | |
| 4,381,709 | A | 5/1983 | Katz | 101/375 |
| 4,503,769 | A | 3/1985 | Andersen | 101/153 |
| 4,599,783 | A | 7/1986 | Ceccacci | 29/450 |
| 4,823,160 | A | 4/1989 | Ikuta et al. | |
| 4,903,597 | A | 2/1990 | Hoage et al. | 101/401.1 |
| 4,913,048 | A | 4/1990 | Tittgemeyer | 101/141 |
| 5,101,726 | A | 4/1992 | Lubke et al. | 101/216 |
| 5,241,905 | A | 9/1993 | Guaraldi et al. | 101/216 |
| 5,298,956 | A | 3/1994 | Mammino et al. | |
| 5,415,961 | A | 5/1995 | Yu et al. | 430/58 |
| 5,518,854 | A | 5/1996 | Yu et al. | 430/133 |
| 5,600,423 | A | 2/1997 | Miyashiro et al. | 399/313 |
| 5,890,395 | A | 4/1999 | Kawata et al. | 74/431 |
| 5,895,529 | A | 4/1999 | Foley et al. | 118/423 |
| 5,937,244 | A | 8/1999 | Yoda et al. | 399/159 |
| 5,960,236 | A | 9/1999 | Zaman et al. | 399/91 |
| 6,016,409 | A | 1/2000 | Beard et al. | 399/33 |

FOREIGN PATENT DOCUMENTS

| | | | | |
|---|---|---|---|---|
| EP | 0 246 627 | | 11/1987 | G03G/15/00 |
| EP | 0 590 924 | A1 | 4/1994 | G03G/15/00 |
| JP | 61-004089 | * | 1/1986 | |

* cited by examiner

*Primary Examiner*—Hoang Ngo
(74) *Attorney, Agent, or Firm*—James D. Leimbach

(57) ABSTRACT

A conformable roller for use in a fusing station of an electrostatographic machine, the fusing station being provided with a pressure roller and a fuser roller for fusing a toner image on a receiver, the fuser roller made from a plurality of layers surrounding an axis of rotation, the conformable roller comprising a rigid cylindrically symmetric core member; a flexible replaceable removable compliant sleeve member in the form of a tubular belt surrounding and nonadhesively intimately contacting the core member; and the fusing station including an external heat source for the fuser roller, at least one of the plurality of layers being thermally resistive.

29 Claims, 15 Drawing Sheets

SLEEVED ROLLERS FOR USE IN A FUSING STATION EMPLOYING AN EXTERNALLY HEATED FUSER ROLLER

CROSS REFERENCE TO RELATED APPLICATIONS

Reference is made to the commonly assigned U.S. Patent Applications, the disclosures of which are incorporated herein by reference.

U.S. patent application Ser. No. 09/679,113, filed Oct. 4, 2000, in the names of Robert Charlebois et al, entitled INTERMEDIATE TRANSFER MEMBER HAVING A STIFFENING LAYER AND METHOD OF USING.

U.S. patent application Ser. No. 09/679,177, filed Oct. 4, 2000, in the names of Muhammed Aslam et al, entitled SLEEVED ROLLERS FOR USE IN A FUSING STATION EMPLOYING AN INTERNALLY HEATED FUSER ROLLER.

U.S. patent application Ser. No. 09/679,345, filed Oct. 4, 2000, in the names of Jiann-Hsing Chen et al, entitled EXTERNALLY HEATED DEFORMABLE FUSER ROLLER.

U.S. patent application Ser. No. 09/680,133, filed Oct. 4, 2000, in the names of Arun Chowdry et al, entitled SLEEVED PHOTOCONDUCTIVE MEMBER AND METHOD OF MAKING. U.S. patent application Ser. No. 09/680,135, filed Oct. 4, 2000, in the names of Jiann-Hsing Chen et al, entitled TONER FUSING STATION HAVING AN INTERNALLY HEATED FUSER ROLLER.

U.S. patent application Ser. No. 09/680,139, filed Oct. 4, 2000, in the names of Robert Charlebois et al, entitled INTERMEDIATE TRANSFER MEMBER WITH A REPLACEABLE SLEEVE AND METHOD OF USING SAME.

U.S. patent application Ser. No. 09/680,136, filed Oct. 4, 2000, in the names of Akin Chowdry et al, entitled IMPROVED INTERMEDIATE TRANSFER MEMBER.

U.S. patent application Ser. No. 09/680,138, filed Oct. 4, 2000, in the names of Jiann-Hsing Chen et al, entitled TONER FUSING STATION HAVING AN EXTERNALLY HEATED FUSER ROLLER.

U.S. patent application Ser. No. 09/679,016, filed Oct. 4, 2000, in the names of Arun Chowdry et al, entitled DOUBLE-SLEEVED ELECTROSTATOGRAPHIC ROLLER AND METHOD OF USING.

FIELD OF THE INVENTION

This invention relates in general to fusing stations used in electrostatographic imaging, and in particular, to fusing stations, which include sleeved rollers. More particularly, the invention relates to externally-heated fuser rollers, useful for color imaging, including removable replaceable sleeve members.

BACKGROUND OF THE INVENTION

In electrostatographic imaging and recording processes such as electrostatographic reproduction, an electrostatic latent image is formed on a primary image-forming member such as a photoconductive surface and is developed with a thermoplastic toner powder to form a toner image. The toner image is thereafter transferred to a receiver, e.g., a sheet of paper or plastic, and the toner image is subsequently fused to the receiver in a fusing station using heat or pressure, or both heat and pressure. The fuser member can be a roller, belt, or any surface having a suitable shape for fixing thermoplastic toner powder to the receiver. The fusing step in a roller fuser commonly consists of passing the toned receiver between a pair of engaged rollers that produce an area of pressure contact known as a fusing nip. In order to form said nip, at least one of the rollers typically has a compliant or conformable layer on its surface. Heat is transferred from at least one of the rollers to the toner in the fusing nip, causing the toner to partially melt and attach to the receiver. In the case where the fuser member is a heated roller, a resilient compliant layer having a smooth surface is typically used which is bonded either directly or indirectly to the core of the roller. Where the fuser member is in the form of a belt, e.g., a flexible endless belt that passes around the heated roller, it typically has a smooth, hardened outer surface.

Most roller fusers, known as simplex fusers, attach toner to only one side of the receiver at a time. In this type of fuser, the roller that contacts the unfused toner is commonly known as the fuser roller and is usually the heated roller. The roller that contacts the other side of the receiver is known as the pressure roller and is usually unheated. Either or both rollers can have a compliant layer on or near the surface. In most fusing stations comprising a fuser roller and an engaged pressure roller, it is common for only one of the two rollers to be driven rotatably by an external source. The other roller is then driven rotatably by frictional contact.

In a duplex fusing station, which is less common, two toner images are simultaneously attached, one to each side of a receiver passing through a fusing nip. In such a duplex fusing station there is no real distinction between fuser roller and pressure roller, both rollers performing similar functions, i.e., providing heat and pressure.

Two basic types of simplex heated roller fusers have evolved. One uses a conformable or compliant pressure roller to form the fusing nip against a hard fuser roller, such as in a Docutech 135 machine made by the Xerox Corporation. The other uses a compliant fuser roller to form the nip against a hard or relatively non-conformable pressure roller, such as in a Digimaster 9110 machine made by Heidelberg Digital LLC. A fuser roller designated herein as compliant typically comprises a conformable layer having a thickness greater than about 2 mm and in some cases exceeding 25 mm. A fuser roller designated herein as hard comprises a rigid cylinder, which may have a relatively thin polymeric or conformable elastomeric coating, typically less than about 1.25 mm thick. A fuser roller used in conjunction with a hard pressure roller tends to provide easier release of a receiver from the heated fuser roller, because the distorted shape of the compliant surface in the nip tends to bend the receiver towards the relatively non-conformable pressure roller and away from the much more conformable fuser roller.

A conventional toner fuser roller includes a cylindrical core member, often metallic such as aluminum, coated with one or more synthetic layers which typically comprise polymeric materials made from elastomers.

The most common type of fuser roller is internally heated, i.e., a source of heat is provided within the roller for fusing. Such a fuser roller normally has a hollow core, inside of which is located a heating source, usually a lamp. Surrounding the core is an elastomeric layer through which heat is conducted from the core to the surface, and the elastomeric layer typically contains fillers for enhanced thermal conductivity. A different kind of fuser roller which is internally heated near its surface is disclosed by Lee et al. in U.S. Pat. No. 4,791,275, which describes a fuser roller comprising two polyimide Kapton® sheets (sold by DuPont and Nemours) having a flexible ohmic heating element disposed between the sheets, the polyimide sheets surrounding a conformable polyimide foam layer attached to a core member. According to J. H. DuBois and F. W. John, Eds., in Plastics, 5th Edition, Van Nostrand and Rheinhold, 1974, polyimide at room temperature is fairly stiff with a Young's modulus of about 3.5 GPa–5.5 GPa (1 GPa=1 GigaPascal= $10^9$ Newton/$m^2$), but the Young's modulus of the polyimide sheets can be expected to be considerably lower at the stated high operational fusing temperature of the roller of at least 450° F.

An externally heated fuser roller is used, for example, in an Image Source 120 copier, marketed by Eastman Kodak Company, and is heated by surface contact between the fuser roller and one or more heating rollers. Externally heated fuser rollers are also disclosed by O'Leary, U.S. Pat. No. 5,450,183, and by Derimiggio et al., U.S. Pat. No. 4,984,027.

A compliant fuser roller may comprise a conformable layer of any useful material, such as for example a substantially incompressible elastomer, i.e., having a Poisson's ratio approaching 0.5. A substantially incompressible conformable layer comprising a poly(dimethyl siloxane) elastomer has been disclosed by Chen et al., in the commonly assigned U.S. patent application Ser. No. 08/879,896, which is hereby incorporated by reference. Alternatively, the conformable layer may comprise a relatively compressible foam having a value of Poisson's ratio much lower than 0.5. A conformable polyimide foam layer is disclosed by Lee in U.S. Pat. No. 4,791,275, and a lithographic printing blanket is disclosed by Goosen et al. in U.S. Pat. No. 3,983,287, comprising a conformable layer containing a vast number of frangible rigid-walled tiny bubbles which are mechanically ruptured to produce a closed cell foam having a smooth surface.

Receivers remove the majority of heat during fusing. Since receivers may have a narrower length measured parallel to the fuser roller axis than the fuser roller length, heat may be removed differentially, causing areas of higher temperature or lower temperature along the fuser roller surface parallel to the roller axis. Higher or lower temperatures can cause excessive toner offset in roller fusers. However, if differential heat can be transferred axially along the fuser roller by layers within the fuser roller having high thermal conductivity, the effect of differential heating can be reduced.

Improved heat transfer from the core to the surface of an internally heated roller fuser will reduce the temperature of the core as well as that of mounting hardware and bearings that are attached to the core. Similarly, improved heat transfer to the surface of an externally heated fuser roller from external heating rollers will reduce the temperature of the external heating rollers as well as the mounting hardware and bearings attached to the external heating rollers.

When the fuser and pressure rollers of a simplex fusing station are pressed against each other, and the conformable layer is deflected to form the fusing nip, the thickness of the conformable layer is reduced inside the nip. When the conformable layer is substantially incompressible, the average speed of the conformable layer through the fusing nip must be greater than that of other parts of the conformable layer that are well away from the nip, because the volume flow rate of the elastomer is constant around the roller. This results in a surface speed of the conformable roller inside the nip, which is faster than far away from the nip. When, for example, the conformable roller is a driving roller frictionally rotating a relatively non-conformable pressure roller, the pressure roller will rotate faster than if the fuser roller had been non-compliant, a phenomenon known as "overdrive". Overdrive may be expressed quantitatively as a peripheral speed ratio, measured as the ratio of the peripheral surface speeds far away from the nip.

A substantially incompressible elastomer that is displaced in the fusing nip results in an extra thickness of the conformable layer adjacent to either side of the fusing nip, i.e., pre-nip and post-nip bulges. Again, since the elastomer is substantially incompressible, the average speed of the conformable layer in these bulges is less than that of the other parts of the conformable layer that are well away from the nip. The highest pressure in the nip will be obtained at the center of the nip (at the intersection of the joined surfaces and an imaginary line between the centers of the two rollers). Since one roller drives the other, the surface velocities of the rollers should be close to equal at the point of maximum pressure, at the center of the nip. In view of these facts, it may be understood that in general there will be locations in the contact zone of the nip where the surface velocities of the two rollers differ, i.e., there will be slippage. This slippage, which may be substantial just after entry and just before exit of the nip, is a cause of wear which shortens roller life.

A potentially serious problem for fusing arising from the presence of overdrive is "differential overdrive", associated for example with tolerance errors in mounting the rollers forming the fusing nip, or with roller runout. Runout can have many causes, e.g., fluctuations in layer thicknesses along the length of a roller, variations in the dimensions of a core member, an acentric roller axis, and so forth. It will be evident that differential overdrive can result in localized differential slippages along the length of a fusing nip, inasmuch as the local effective speed ratio would otherwise tend to fluctuate or change with time along the length of the nip, causing some portions of the driven roller to try to lag and other portions to try to move faster than the average driven speed. Differential overdrive can have serious consequences for fusing, including the formation of large-scale image defects and wrinkling of a receiver.

All rollers suffer from surface wear, especially where the edges of receivers contact the rollers. Since relative motion due to slippage between rollers increases wear, the changes in velocity of the surface of a conformable roller, as it travels into, through, and out of a fusing nip formed with a relatively non-conformable roller, should increase the wear rate of the conformable roller, especially if the conformable roller is the heated fusing member, bearing in mind that a fuser roller typically faces a relatively rough and abrasive paper surface in the nip. Moreover, since the material on the conformable roller is stretched and relaxed each time it passes through the fusing nip, this flexure can result in fatigue aging and wear, including failure of the roller due to splitting or cracking of the compliant material, or even delamination.

To obtain high-quality electrophotographic copier/printer image quality, image defects must be reduced. One type of defect is produced by smearing of image dots or other small-scale image features in the fusing nip. Relative motions associated with overdrive and resulting in localized slippage between rollers in a fusing nip can cause softened toner particles to smear parallel to the direction of motion, resulting for example in elongated dots.

Some roller fusers rely on film splitting of low viscosity oil to enable release of the toner and (hence) receiver from the fuser roller. Relative motion in the fusing nip can disadvantageously disrupt the oil film.

A toner fuser roller commonly includes a hollow cylindrical core, often metallic. A resilient base cushion layer, which may contain filler particles to improve mechanical strength and/or thermal conductivity, is formed on the surface of the core, which may advantageously be coated with a primer to improve adhesion of the resilient layer. Roller cushion layers are commonly made of silicone rubbers or silicone polymers such as, for example, poly (dimethylsiloxane) (PDMS) polymers of low surface energy, which minimize adherence of toner to the roller.

Frequently, release oils composed of, for example, poly (dimethylsiloxanes) are also applied to the fuser roller surface to prevent the toner from adhering to the roller. Such release oils (commonly referred to as fuser oils) may interact with the PDMS in the resilient layer upon repeated use, which in time causes swelling, softening, and degradation of the roller. To prevent these deleterious effects caused by release oil, a thin barrier layer of, for example, a cured polyfluorocarbon, is formed on the cushion layer.

Electrophotography can be used to create high quality multicolor toner images when the toner particles are small, that is, diameters less than about 10 micrometers, and the receivers, typically papers, are smooth. A typical method of making a multicolor toner image involves trichromatic color synthesis by subtractive color formation. In such synthesis, successive imagewise electrostatic images, each representing a different color, are formed on a photoconductive element, and each image is developed with a toner of a different color. Typically, the colors correspond to each of the three subtractive primary colors (cyan, magenta and yellow) and, optionally, black. The imagewise electrostatic images for each of the colors can be made successively on the photoconductive element by using filters to produce color separations corresponding to the colors in the image. Following development of the color separations, each developed separation image can be transferred from the photoconductive element successively in registration with the other color toner images to an intermediate transfer member. All the color toner images can then be transferred in one step from the intermediate transfer member to a receiver, where they are fixed or fused to produce a multicolor permanent image. Alternatively, an electrophotographic apparatus comprising a series of tandem modules may be employed, such as disclosed by Herrick et al. in U.S. Pat. No. 6,016,415, wherein color separation images are formed in each of four color modules and transferred in register to a receiver member as the receiver member is moved through the apparatus while supported on a transport web.

To rival the photographic quality produced using silver halide technology, it is desirable that these multicolor toner images have high gloss. To this end, it is desirable to provide a very smooth fusing member contacting the toner particles in the fusing station.

In the fusing of the toner image to the receiver, the area of contact of a conformable fuser roller with the toner-bearing surface of a receiver sheet as it passes through the fusing nip is determined by the amount pressure exerted by the pressure roller and by the characteristics of the resilient cushion layer. The extent of the contact area helps establish the length of time that any given portion of the toner image will be in contact with and heated by the fuser roller.

A fuser module is disclosed by M. E. Beard et al., in U.S. Pat. No. 6,016,409, which includes an electronically-readable memory permanently associated with the module, whereby the control system of the printing apparatus reads out codes from the electronically readable memory at install to obtain parameters for operating the module, such as maximum web use, voltage and temperature requirements, and thermistor calibration parameters.

As previously mentioned, PDMS cushion layers may include fillers comprising inorganic particulate materials, for example, metals, metal oxides, metal hydroxides, metal salts, and mixtures thereof. For example, U.S. Pat. No. 5,292,606, the disclosure of which is incorporated herein by reference, describes fuser roller base cushion layers that contain fillers comprising particulate zinc oxide and zinc oxide-aluminum oxide mixtures. Similarly, U.S. Pat. No. 5,336,539, the disclosure of which is incorporated herein by reference, describes a fuser roller cushion layer containing dispersed nickel oxide particles. Also, the fuser roller described in U.S. Pat. No. 5,480,724, the disclosure of which is incorporated herein by reference, includes a base cushion layer containing 20 to 40 volume percent of dispersed tin oxide particles.

Filler particles may also be included in a barrier layer. For example, in Chen et al., U.S. Pat. No. 5,464,698, the disclosure of which is incorporated herein by reference, is described a toner fuser member having a silicone rubber cushion layer and an overlying layer of a cured fluorocarbon polymer in which is dispersed a filler comprising a particulate mixture that includes tin oxide.

Chen et al., in commonly assigned U.S. patent application Ser. No. 08/879,896, disclose an improved fuser roller including three concentric layers each comprising a particulate filler, i.e., a base cushion layer comprising a condensation-cured PDMS, a barrier layer covering the base cushion and comprised of a cured fluorocarbon polymer, and an outer surface layer comprising an addition-cured PDMS, the particulate fillers in each layer including one or more of aluminum oxide, iron oxide, calcium oxide, magnesium oxide, tin oxide, and zinc oxide. The barrier layer, which may comprise a Viton™ elastomer (sold by DuPont) or a Fluorel™ elastomer (sold by Minnesota Mining and Manufacturing), is a relatively low modulus material typically having a Young's modulus less than about 10 MPa, and it therefore has a negligible effect upon the mechanical characteristics of the roller, including overdrive.

Vrotacoe et al., in U.S. Pat. No. 5,553,541, disclose a printing blanket, for use in an offset printing press, which includes a seamless tubular elastic layer comprising compressible microspheres, surrounded by a seamless tubular layer made of a circumferentially inextensible material, and a seamless tubular printing layer over the inextensible layer. It is disclosed that provision of the inextensible layer reduces or eliminates pre-nip and post-nip bulging of the roller when printing an ink image on a receiver sheet, thereby improving image quality by reducing or eliminating ink smearing caused by slippage associated with the formation of bulges in the prior art.

Fusing stations can include flexible, high-modulus stiffening layers with internally-heated and externally-heated compliant toner fuser rollers, as well as in compliant pressure rollers. Excessive fuser roller wear and toner image dot smearing are commonly caused by overdrive in the fusing nip, as typically found in prior art rollers. The stiffening layer reduces wear and improves image quality by greatly reducing overdrive, or making it negligible.

The use of a removable endless belt or tubular type of blanket on an intermediate roller has long been practiced in the offset lithographic printing industry, as recently disclosed by Gelinas in U.S. Pat. No. 5,894,796 wherein the tubular blanket may be made of materials including rubbers and plastics and may be reinforced by an inner layer of aluminum or other metal. As disclosed earlier, for example, by Julian in U.S. Pat. No. 4,144,812, an intermediate lithographic roller comprises a portion having a slightly smaller diameter than the main body of the roller, such that a blanket member may be slid along this narrower portion until it reaches a location where a set of holes located in the roller allow a fluid under pressure, e.g., compressed air, to pass through the holes, thereby stretching the blanket member and allowing the entire blanket member to be slid onto the main body of the roller. After the blanket is located in a suitable position, the source of compressed air or fluid under pressure is turned off, thereby allowing the blanket member to relax to a condition of smaller strain, such strain being sufficient to cause the blanket member to snugly embrace the roller.

An intermediate transfer roller consisting of a rigid core and a removable, replaceable intermediate transfer blanket has been disclosed by Landa et al., in U.S. Pat. No. 5,335,054, and by Gazit et al., in U.S. Pat. No. 5,745,829, whereby the intermediate transfer blanket is fixedly and replaceably secured and attached to the core. The intermediate transfer blanket, disclosed for use in conjunction with a liquid developer for toning a primary image, consists of a substantially rectangular sheet mechanically held to the core by grippers. The core (or drum) has recesses where the grippers are located. It will be evident from U.S. Patent Nos. 5,335,054 and 5,745,829 that, owing to the presence of the recesses, the entire surface of the intermediate transfer drum cannot be utilized for transfer, which is a disadvantage requiring costly means to maintain a proper orientation of the useful part of the drum when transferring a toner image from a primary imaging member to the intermediate transfer roller, or, when transferring a toner image from the intermediate transfer roller to a receiver. Moreover, the fact that the blanket does not form a continuous covering of the entire core surface, owing to the fact that two of its edges are held by grippers, is similarly a disadvantage. Another disadvantage arises because there is inevitably a gap between these edges, so that contamination can become deposited there which may lead to transfer artifacts.

Commonly assigned copending U.S. patent application Ser. No. 09/457,455, by T. N. Tombs et al., hereby incorporated by reference, discloses a single-sleeved intermediate transfer roller and method of using in an electrostatographic color reproduction machine. The intermediate transfer roller comprises a central member plus a replaceable removable sleeve member. This improves over U.S. Pat. Nos. 5,335,054 and 5,745,829 in that the sleeve member is in the form of an endless belt. The central member remains attached to a frame portion of the machine when the sleeve member is removed and replaced. A sleeve member comprises one or more compliant layers and may also include a stiffening layer. In some embodiments a central member may comprise a core member and a thick compliant layer coated on the core member.

An electrostatographic imaging member in the form of a removable replaceable endless imaging belt on a rigid roller is disclosed by Yu et al., in U.S. Pat. No. 5,415,961. The electrostatographic imaging member is placed on the rigid roller and removed from the rigid roller by means involving stretching the endless imaging belt with a pressurized fluid.

Mammino et al., in U.S. Pat. Nos. 5,298,956 and 5,409,557, disclose a reinforced seamless intermediate transfer member that may be in the shape of a belt, sleeve, tube or roll and comprising a reinforcing member in an endless configuration having filler material and electrical property regulating material on, around or embedded in the reinforcing member. The reinforcing member may be made of metal, synthetic material or fibrous material, and has a tensile modulus ranging from about 400,000 to more than 1,000,000 psi (2.8 to more than 6.9 GPa). The intermediate transfer member has a thickness between 2 mils and about 7 mils.

May and Tombs in U.S. Pat. Nos. 5,715,505 and 5,828,931 disclose a primary image forming member roller comprising a thick compliant blanket layer coated on a core member, the thick compliant blanket surrounded by a relatively thin concentric layer of a photoconductive material. The compliant primary imaging roller provides improved electrostatic transfer of a toner image directly to a receiver member. It is disclosed that the compliant imaging roller can be used bifunctionally, i.e., it may serve also as an intermediate member for electrostatic transfer of a toner image to a receiver. U.S. Pat. No. 5,732,311 discloses a compliant electrographic primary imaging roller. Disclosures in U.S. Pat. Nos. 5,715,505, 5,828,931 and 5,732,311 are hereby incorporated by reference.

Commonly assigned copending U.S. patent application Ser. No. 09/680,133, by M. F. Molaire et al., discloses a single-sleeved compliant primary imaging roller and a method of making. The sleeve is a photoconductive member, the sleeve resting on a compliant layer formed on a core member. This improves over U.S. Pat. Nos. 5,715,505 and 5,828,931, in that the layers comprising the roller are made more reliably and more cheaply, and also that the photoconductive sleeve may be readily removed and replaced when at the end of its useful life, thereby lowering cost and reducing downtime. Commonly assigned copending U.S. patent application Ser. No. 09/680,133, by M. F. Molaire, et al., hereby incorporated by reference, also improves over U.S. Pat. No. 5,415,961 by providing a core member having a thick compliant layer over which the sleeve member is placeable and removable.

A sleeved intermediate transfer member having a central member comprising a thick compliant layer coated on a rigid core member, as disclosed in commonly assigned copending U.S. patent application Ser. No. 09/475,455 by T. N. Tombs, et al., is disadvantageously subject to damage of the compliant layer when removing or replacing a sleeve member. A compliant layer on a rigid core of a sleeved PIFM, as disclosed in commonly assigned copending U.S. Patent application Ser. No. 09/680,133 by M. F. Molaire, et al., may also be subject to damage when removing or replacing a photoconductive sleeve member.

Double-sleeved intermediate transfer rollers and primary image-forming rollers are disclosed in commonly assigned copending U.S. patent application Ser. No. 09/679,016 by J. W. May, et al., hereby incorporated by reference. An inner sleeve provides macro-compliance, i.e., the ability to conform to form a nip. An outer sleeve provides micro-compliance, which comes into play at, for example, the scale of individual toner particles, paper roughness, and edges of large toned solid areas. In commonly assigned copending U.S. patent application Ser. No. 09/679,016 by J. W. May, et al., a double-sleeved intermediate transfer or primary image-forming roller comprises a costly, highly toleranced, rigid, core member, and the ability to replace the sleeves preserves the core member for multiple reuses, thereby cutting overall costs. Moreover, it is disclosed that a stiffening layer can be included as an exterior outer surface of an inner sleeve or as an exterior inner surface of an outer sleeve. Additionally, either sleeve may be replaced without replacing the other, or else the inner and outer sleeves may be replaced with differing frequencies.

There remains a need to provide improved externally-heated fuser rollers and pressure rollers that lower overall costs when employed in a fusing station, while otherwise maintaining the advantages of fusing station rollers which include a stiffening layer. Typical fuser rollers and pressure rollers, which are subject to aging, damage, and wear, are bulky, heavy, and expensive to store and to ship. Sleeved rollers of the present invention have relatively lightweight, easily replaceable, surface layers, and therefore they satisfy the need to drive down overall operational costs by avoiding the necessity of manufacturing and shipping complete rollers when replacements in a fusing station are required.

SUMMARY OF THE INVENTION

The invention provides an improved fusing station of an electrostatographic machine. The fusing station includes a conformable or compliant multilayer roller, which has a rigid core member and a removable replaceable compliant sleeve member. The multilayer roller can be an externally heated fuser roller, or a pressure roller. The sleeve member of the multilayer roller is removable from the core member when the sleeve member needs replacing due to wear or damage, or when the sleeve member is at the end of a predetermined operational life. A new sleeve member may then be installed, e.g., on an expensive, finely toleranced core member, thereby providing a large cost saving by retaining the expensive core member for a long operational usage. Another advantage of the sleeve member of the inventive multilayer roller is being able to ship lighter and less bulky sleeve parts, as compared to shipping entire replacement rollers of prior art fusing stations. Moreover, the core member may preferably remain fixed to the electrostatographic apparatus in which it is mounted during removal or replacement of a sleeve member. The sleeve member includes one or more elastomeric layers and also preferably a flexible high-modulus stiffening layer. In different embodiments, a fusing station of the invention may include an externally heated sleeved compliant fuser roller and a sleeved compliant pressure roller, or it may include an externally heated sleeved compliant fuser roller and a hard pressure roller. In another embodiment, an externally heated hard fuser roller may be used with a sleeved compliant pressure roller. A multilayer sleeved inventive roller may be used in simplex and duplex fusing stations. In a duplex station, each of the rollers providing the fusing nip is provided with an external source of heat and preferably has a compliant sleeve.

In accordance with the invention, there is provided a conformable roller for use in a fusing station of an electrostatographic machine, the fusing station being provided with a pressure roller and a fuser roller for fusing a toner image on a receiver, the fuser roller made from a plurality of layers surrounding an axis of rotation, the conformable roller including: a rigid cylindrically symmetric core member; a flexible replaceable removable compliant sleeve member in the form of a tubular belt surrounding and nonadhesively intimately contacting the core member; and, the fusing station including an external heat source for the fuser roller, at least one of the plurality of layers being thermally resistive.

In accordance with another aspect of the invention there is provided a sleeve member, included in a conformable roller of a fusing station of an electrostatographic machine, the fusing station being provided with a pressure roller and a fuser roller for fusing a toner image on a receiver, the fuser roller being provided with an external heat source, the conformable roller including both a core member and a sleeve member, the sleeve member including: a tubular strengthening band; a compliant base cushion layer formed on the strengthening band; an optional barrier layer coated on the base cushion layer; an outer layer coated on the barrier layer; and, wherein the sleeve member has the form of a tubular belt surrounding and nonadhesively intimately contacting the core member.

In accordance with yet another aspect of the invention there is provided a sleeve member, included in a conformable roller of a fusing station of an electrostatographic machine, the fusing station being provided with a pressure roller and a fuser roller for fusing a toner image on a receiver, the fuser roller being provided with an external heat source, the conformable roller including both a core member and a sleeve member, the sleeve member including: a tubular strengthening band; a compliant base cushion layer formed on the strengthening band; a stiffening layer in intimate contact with and surrounding the base cushion layer; an outer layer on the stiffening layer; and, wherein the sleeve member has the form of a tubular belt surrounding and nonadhesively intimately contacting the core member.

In accordance with an additional aspect of the invention there is provided an inner sleeve member, included in a conformable roller of a fusing station of an electrostatographic machine, the fusing station being provided with a pressure roller and a fuser roller for fusing a toner image on a receiver, the fuser roller being provided with an external heat source, the conformable roller including both a core member and an inner sleeve member and an outer sleeve member, the inner sleeve member including: a tubular strengthening band; a compliant base cushion layer formed on the strengthening band; a protective layer on the base cushion layer; and, wherein the inner sleeve member has the form of a tubular belt surrounding and nonadhesively intimately contacting the core member.

In accordance with a further additional aspect of the invention there is provided an outer sleeve member, included in a conformable roller of a fusing station of an electrostatographic machine, the fusing station being provided with a pressure roller and a fuser roller for fusing a toner image on a receiver, the fuser roller being provided with an external heat source, the conformable roller including both a core member and an inner sleeve member and an outer sleeve member, the outer sleeve member including: a tubular stiffening layer; an outer layer on the stiffening layer; and, wherein the outer sleeve member has the form of a tubular belt surrounding and nonadhesively intimately contacting the inner sleeve member.

In accordance with a still yet another aspect of the invention, there is provided a fusing station of an electrostatographic machine which includes: a rotating externally heated compliant fuser roller and a counter-rotating hard pressure roller engaged to form a fusing nip with the compliant fuser roller, the compliant fuser roller including a flexible replaceable removable compliant sleeve member in the form of a tubular belt surrounding and nonadhesively intimately contacting a rigid cylindrical core member, the sleeve member including a tubular strengthening band, a base cushion layer formed on the strengthening band, a stiffening layer in intimate contact with the base cushion layer such that the stiffening layer has a Young's modulus in a range of approximately 0.1 GPa to 500 GPa and a thickness less than about 500 micrometers, and an outer layer on the stiffening layer.

In accordance with a further aspect of the invention, there is provided a fusing station of an electrostatographic machine which includes: a rotating externally heated compliant fuser roller including a flexible replaceable removable compliant sleeve member in the form of a tubular belt surrounding and nonadhesively intimately contacting a rigid cylindrical core member, the sleeve member including a tubular strengthening band, a base cushion layer formed on the strengthening band, a stiffening layer in intimate contact with the base cushion layer such that the stiffening layer has a Young's modulus in a range of approximately 0.1 GPa to 500 GPa and a thickness less than about 500 micrometers, and an outer layer on the stiffening layer; and, a counter-rotating compliant pressure roller engaged to form a fusing nip with the compliant fuser roller, the pressure roller including a flexible replaceable removable compliant sleeve member in the form of a tubular belt surrounding and nonadhesively intimately contacting a rigid cylindrical core member, the sleeve member including a tubular strengthening band, a base cushion layer formed on the strengthening band, a stiffening layer in intimate contact with the base cushion layer such that the stiffening layer has a Young's modulus in a range of approximately 0.1 GPa to 500 GPa and a thickness less than about 500 micrometers, and an optional outer layer on the stiffening layer.

In accordance with yet a further aspect of the invention, there is provided a fusing station of an electrostatographic machine which includes: a rotating compliant pressure roller and a counter-rotating externally heated hard fuser roller engaged to form a fusing nip with the compliant pressure roller, the compliant pressure roller including a flexible replaceable removable compliant sleeve member in the form of a tubular belt surrounding and nonadhesively intimately contacting a rigid cylindrical core member, the sleeve member including a tubular strengthening band, a base cushion layer formed on the strengthening band, a stiffening layer in intimate contact with the base cushion layer such that the stiffening layer has a Young's modulus in a range of approximately 0.1 GPa to 500 GPa and a thickness less than about 500 micrometers, and an outer layer on the stiffening layer.

In accordance with a still yet further aspect of the invention, there is provided a fusing station of an electrostatographic machine which includes: a rotating first heated fuser roller; a counter-rotating second heated fuser roller engaged to form a pressure fusing nip with the first fuser roller; wherein at least one of the first and second heated fuser rollers further includes a flexible replaceable removable compliant sleeve member in the form of a tubular belt surrounding and nonadhesively intimately contacting a rigid cylindrical core member, the sleeve member including a tubular strengthening band, a base cushion layer formed on the strengthening band, a stiffening layer in intimate contact with the base cushion layer such that the stiffening layer has a Young's modulus in a range of approximately 0.1 GPa to 500 GPa and a thickness less than about 500 micrometers, and an outer layer on the stiffening layer; and, wherein at least one of the first and second heated fuser rollers is heated by an external source of heat.

In accordance with an additional aspect of the invention, there is provided a toner fusing method, for use in an electrostatographic machine having a fusing station according to claim 14, the toner fusing method comprising the steps of: forming a fusing nip by engaging the rotating compliant fuser roller having an external source of heat and the counter-rotating hard pressure roller, one of the rollers being a driven roller and the other frictionally driven by pressure contact in the nip; forming an unfused toner image on a surface of a receiver sheet; feeding the leading edge of the receiver into the nip and allowing the unfused toner image on the receiver sheet to pass through the fusing nip with the unfused toner image facing the fuser roller; wherein the compliancy in combination with the stiffening layer included in the fuser roller provide a reduced wear rate of the fuser roller and an improved quality of a toner image fused by the fusing station.

In accordance with another additional aspect of the invention, there is provided a toner fusing method, for use in an electrostatographic machine having a fusing station according to claim 17, said toner fusing method comprising the steps of: forming a fusing nip by engaging the rotating compliant fuser roller having an external source of heat and the counter-rotating hard pressure roller, one of the rollers being a driven roller and the other frictionally driven by pressure contact in the nip; forming an unfused toner image on a surface of a receiver sheet; feeding the leading edge of the receiver into the nip and allowing the unfused toner image on the receiver sheet to pass through the fusing nip with the unfused toner image facing the fuser roller; and, wherein a low cost of ownership of the fusing station is provided by use of the replaceable removable sleeve member.

In accordance with yet another additional aspect of the invention, there is provided a method of making a sleeve member of claim 9 including the steps of: providing a cylindrical mandrill; mounting on the mandrill the strengthening band by sliding the strengthening band over the mandrel to a suitable position, the sliding being accomplished by making an inner diameter of the strengthening band temporarily larger during the sliding than an outer diameter of the mandrel; forming the base cushion layer on the strengthening band; uniformly coating the base cushion layer by the barrier layer; uniformly coating the barrier layer by the outer layer to form a completed sleeve member; and, sliding the completed sleeve member off the mandrill, the sliding being accomplished by making an inner diameter of the sleeve member temporarily larger during the sliding than an outer diameter of the mandrill.

In accordance with still another additional aspect of the invention, there is provided a method of making a sleeve member of claim 10 including the steps of: providing a cylindrical mandrill; mounting on the mandrill the strengthening band by sliding the strengthening band over the mandrel to a suitable position, the sliding being accomplished by making an inner diameter of the strengthening band temporarily larger during the sliding than an outer diameter of the mandrel; forming the base cushion layer on the strengthening band; providing the stiffening layer in the shape of a seamless metal tube; sliding the metal tube over an outer surface of the base cushion layer, the metal tube having, prior to the sliding of the metal tube, an inner diameter smaller than an outside diameter of the base cushion layer formed on the strengthening band, the sliding being accomplished by making the inner diameter of the metal tube temporarily larger during the sliding than the outside diameter of the base cushion layer; uniformly coating the metal tube by the outer layer to form a completed sleeve member; sliding the completed sleeve member off the mandrill, the sliding being accomplished by making an inner diameter of the sleeve member temporarily larger during the sliding than an outer diameter of the mandrill.

In accordance with still yet another additional aspect of the invention, there is provided a method of making an inner sleeve member of claim 11, including the steps of: providing a cylindrical mandrill; mounting on the mandrill a strengthening band by sliding the strengthening band over the mandrel to a suitable position, the sliding being accomplished by making an inner diameter of the strengthening band temporarily larger during the sliding than an outer diameter of the mandrel; forming a base cushion layer on the strengthening band; optionally coating the base cushion layer with a protective layer to form a completed inner sleeve member; and, sliding the completed inner sleeve member off the mandrill, the sliding being accomplished by making an inner diameter of the inner sleeve member temporarily larger during the sliding than an outer diameter of the mandrill.

In accordance with a still yet further additional aspect of the invention, there is provided a method of making an outer sleeve member of claim 12, including the steps of: providing a cylindrical mandrill; mounting on the mandrill a stiffening layer by sliding the stiffening layer over the mandrel to a suitable position, the sliding being accomplished by making an inner diameter of the stiffening layer temporarily larger during the sliding than an outer diameter of the mandrel; coating the stiffening layer by an outer layer to form a completed outer sleeve member; and, sliding the completed outer sleeve member off the mandrill, the sliding being accomplished by making an inner diameter of the outer sleeve member temporarily larger during the sliding than an outer diameter of the mandrill.

BRIEF DESCRIPTION OF THE DRAWINGS

In the detailed description of the preferred embodiments of the invention presented below, reference is made to the accompanying drawings, in some of which the relative relationships of the various components are illustrated, it being understood that orientation of the apparatus may be modified. For clarity of understanding of the drawings, some elements have been removed, and relative proportions depicted or indicated of the various elements of which disclosed members are composed may not be representative of the actual proportions, and some of the dimensions may be selectively exaggerated.

FIG. 8(*b*) depicts an end view of an inner sleeve member according to this invention which includes a tubular strengthening band, a base cushion layer formed on the strengthening band, and an optional protective layer coated on the base cushion layer.

FIG. 17(*b*) is a diagrammatic representation of a partly assembled double-sleeved roller including an inner and an outer sleeve member according to the invention, wherein the core member has marked on it a descriptive indicia, machine readable, located on an outer surface of the core member in a small area located close to an end of the core member, and each of the inner and outer sleeve members has marked on it a descriptive indicia, machine readable, located on the outer surface of the respective sleeve member in a small area located close to an end of the respective sleeve member, where for clarity of explanation each of the sleeve members is shown displaced a short distance with respect to its operational position on the core member in order to reveal locations for an indicia on an outside portion of the core member and on an outside portion of the inner sleeve member.

DETAILED DESCRIPTION OF THE PREFERRED EMBODIMENTS

Figure 1:
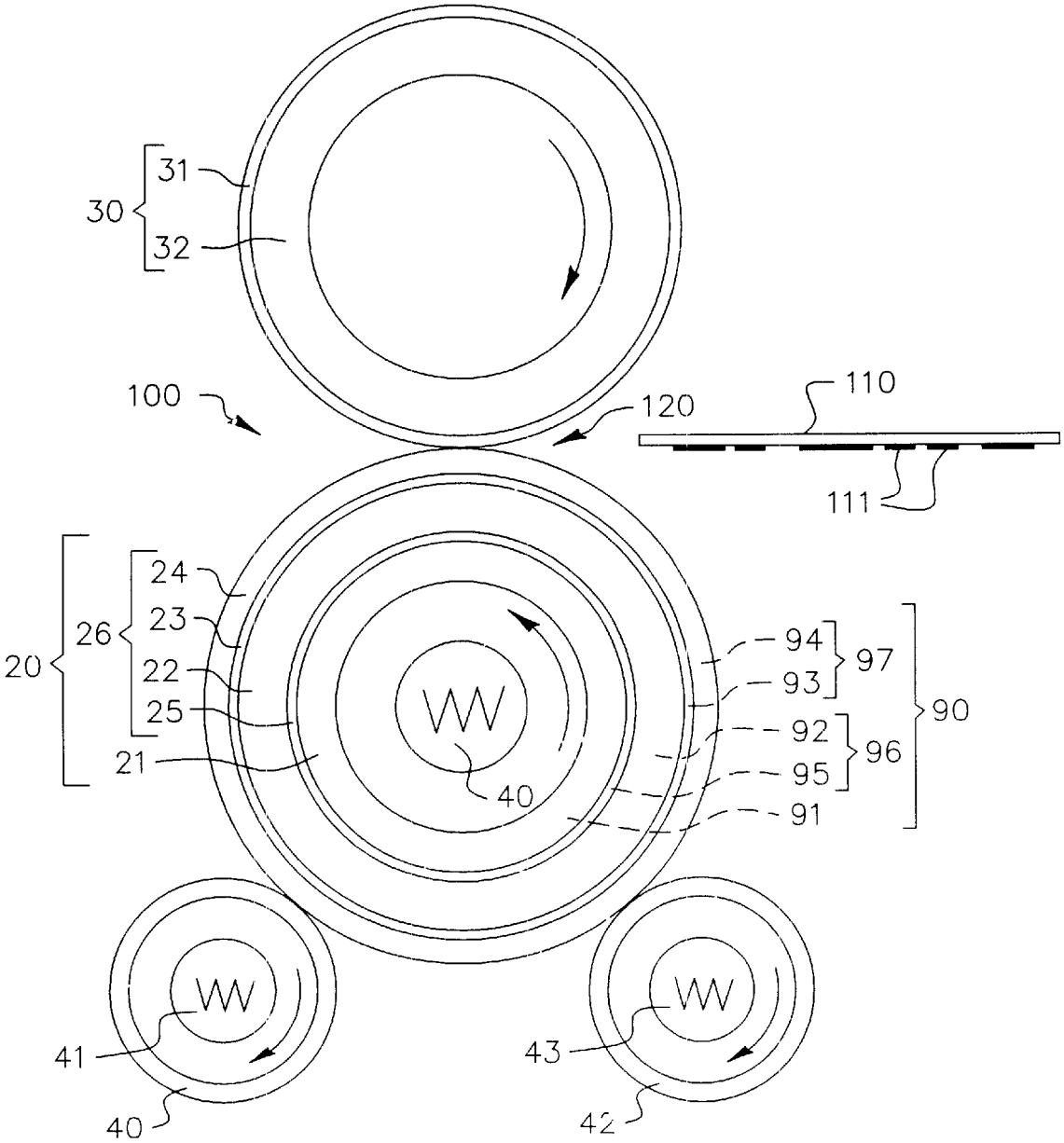
FIG. 1 depicts an end view of a simplex toner fusing station according to this invention which includes a hard pressure roller, engaged in a fusing nip with an externally-heated compliant fuser roller having a sleeve which includes a stiffening layer.

Fusing stations according to this invention are readily usable in typical electrostatographic reproduction apparatus of many types such as described above.

Because such reproduction apparatus are well known, the present description will be directed in particular to subject matter forming part of, or cooperating more directly with, the present invention.

The invention relates to electrostatographic reproduction in an electrostatographic machine utilizing a fusing station to thermally fuse an unfused toner image to a receiver, e.g., paper. The fusing station preferably comprises two rollers, which are engaged to form a fusing nip in which an externally heated fuser roller comes into direct contact with the unfused toner image as the receiver is frictionally moved through the nip. The externally heated roller, which includes a plurality of layers, is heated by a heat source, which preferably comprises one or more heating rollers in contact with the rolling surface of the externally heated roller. Alternatively, the heat source may be external radiation absorbed by the fuser roller, e.g., as provided by one or more lamps, or any other suitable external heating source. At least one the plurality of layers included in the fuser roller is thermally resistive. A thermally resistive layer as described herein is a layer having a thermal conductivity less than or equal to about 0.3 BTU/hr/ft/° F. The receiver may consist of a cut sheet or it may be a continuous web. The unfused toner image may include a single-color toner or it may include a composite image of two or more single-color toners, e.g., a full color composite image made for example from black, cyan, magenta, and yellow toners. The unfused toner image is previously transferred, e.g., electrostatically, to the receiver from a toner image-bearing member such as a primary image-forming member or an intermediate transfer member. The electrostatographic reproduction may utilize a photoconductive electrophotographic primary image-forming member or a non-photoconductive electrographic primary image-forming member. Particulate dry or liquid toners may be used.

A simplex fusing station of the invention may include several embodiments. In a preferred embodiment, the invention includes a conformable externally heated fuser roller engaged in a fusing nip with a hard pressure roller, the conformable externally heated fuser roller having a replaceable removable compliant sleeve member which includes a high-modulus stiffening layer, wherein a high modulus is a Young's modulus equal to or greater than about 100 MPa. In another preferred embodiment, a conformable externally heated fuser roller having a replaceable removable compliant sleeve member which includes a low-modulus barrier layer is engaged in a fusing nip with a hard pressure roller, wherein a low modulus is a Young's modulus less than about 100 MPa. In the above two embodiments, a distorted shape of the compliant fuser roller in the nip helps to release the receiver from the fuser roller and tends to guide it more towards the hard pressure roller as the receiver passes out of the nip. In two other preferred embodiments, a hard externally heated fuser roller is engaged in a fusing nip with a conformable pressure roller having a replaceable removable compliant sleeve member including a high-modulus stiffening layer, and, a conformable externally heated fuser roller having a replaceable removable compliant sleeve member including a stiffening layer is engaged in a fusing nip with a conformable pressure roller having a replaceable removable compliant sleeve member which includes a high-modulus stiffening layer. A simplex fusing station of the invention can be used to fuse an unfused toner image to one side of a receiver which already has a previously fused toner image on the reverse side.

A preferred embodiment of a duplex fusing station of the invention includes a conformable externally heated first fuser roller having a replaceable removable compliant sleeve member including a stiffening layer, engaged in a fusing nip with a conformable externally heated second fuser roller having a replaceable removable compliant sleeve member including a stiffening layer. The duplex fusing station simultaneously fuses two unfused toner images, one on the front and one on the back of the receiver.

In other embodiments, a roller of a fusing station, which may be a fuser roller or a pressure roller, is a double-sleeved roller, which has inner and outer replaceable removable sleeve members in mutual contact.

In yet other embodiments, the stiffening layer included in a sleeve member of a roller of a fusing station is provided with an axial variation of stiffness, i.e., having a variation parallel to the roller axis, the stiffness being measured parallel to a tangential direction of rotation of the roller. It is preferred that the stiffness of the stiffening layer is greatest midway along the length of the roller, and least near each end of the roller.

In additional embodiments, a sleeve member of a roller of a fusing station is provided with a stiffening layer which is located at different depths along the length of the roller. It is preferred that the stiffening layer is located deepest near each end of the roller and shallowest substantially midway along the length of the roller.

In still other embodiments, a roller of a fusing station, which includes a stiffening layer, is provided with an outside diameter varying along a direction parallel to the roller axis. Preferably, a maximum of said outside diameter of a fuser roller is located near each end of the roller and a minimum is located substantially midway along the length of the roller.

In further embodiments, an externally heated fuser roller includes a stiffening layer, which is shorter than the length of a receiver measured parallel to the fuser roller axis when the fuser roller is being utilized for fusing a toner image to a receiver.

In all embodiments, inventive rollers are preferably cylindrically symmetrical, i.e., a cross-section of the roller taken at right angles to the roller axis anywhere along the length of the roller has radial symmetry around the roller axis.

Although not explicitly disclosed in the preferred embodiments, it will be understood that an optional supplementary source of heat for fusing, either external or internal, may be provided to any roller included in a fusing station of the invention.

Referring now to the accompanying drawings, FIG. 1 shows a preferred embodiment of an inventive simplex fuser station, designated by the numeral 100. A rotating fuser roller 20 has an external heat source, e.g., heating rollers 40 and 42. Roller 20, moving in a direction indicated by arrow A, includes a plurality of layers disposed about an axis of rotation, the plurality of layers including a cylindrical core member 21 and a replaceable removable sleeve member 26. The sleeve member 26 includes a flexible strengthening band 25 having the form of a tubular belt, a relatively thick compliant layer 22 formed on the strengthening band, a flexible thin interlayer 23 which is a stiffening layer, with layer 23 being in intimate contact with and surrounding the compliant layer 22, and a compliant release layer or outer layer 24 coated on the stiffening layer. A counter-rotating hard pressure roller 30 moving in the direction of arrow B forms a fusing nip 120 with compliant fuser roller 20. A receiver sheet 110 carrying an unfused toner image 111 facing the fuser roller 20 is shown approaching nip 120. The receiver sheet is fed into the nip by employing well known mechanical transports (not shown) such as a set of rollers or a moving web for example. The fusing station preferably has one driving roller, either the fuser roller or the pressure roller, the other roller being driven and rotated frictionally by contact.

Although two heating rollers 40 and 42 are shown in FIG. 1, one or more heating rollers may be used. A heating roller is made from any suitable thermally conductive rigid material, preferably aluminum, and may further include a preferably thermally stable low surface energy thin polymeric coating on its surface, e.g., a fluoroelastomer or a silicone rubber, typically less than about 1.25 mm thick (not shown in FIG. 1). A tubular heating roller is preferred. A heating element in the interior of a heating roller may include an axially centered tubular incandescent heating lamp, e.g. lamps 41 and 43, or an ohmically heated resistive filament, or other suitable interior source of heat. Preferably, the heat source is controlled by a feedback circuit, for example by utilizing a thermocouple to monitor and thereby control the surface temperature of fuser roller 20 by employing a programmable voltage power supply (not shown) to regulate the temperature of the lamps 41 and 43.

The pressure roller 30 includes a core member 31 and an optional surface layer 32 coated on the core. The core may be made of any suitable rigid material, e.g., aluminum, preferably including a cylindrical tube. Optional surface layer 32 is preferred to be less than about 1.25 mm thick and preferably includes a thermally stable preferably low-surface-energy compliant or conformable material, for example a silicone rubber, e.g., a PDMS, or a fluoroelastomer such as a Viton™ (from DuPont) or a Fluorel™ (from Minnesota Mining and Manufacturing). Alternatively, layer 32 may include a relatively hard poly(tetrafluoroethylene) or other suitable polymeric coating. A bare core having no layer 32 may include, for example, anodized aluminum or copper.

The fuser roller 20 includes a rigid core member 21 preferably in the form of a cylindrical tube made from any suitable material, e.g., aluminum. The core member may have interior reinforcing members, e.g., struts, or other interior strengthening structures (not shown).

The sleeve member 26 of fuser roller 20 preferably is a multilayer unitary body having the form of a tubular belt which is in intimate non-adhesive contact with, surrounding, and snugly gripping the core member 21. The removable replaceable sleeve 26 may be removed from the core 21 by means of a technique in which a pressurized fluid, e.g., compressed air, is used to temporarily expand the sleeve member. For example, the core member may have a gradually tapering portion starting at one end, the gradually tapering portion being an integral part of the core member. The tapering portion is coaxial with, and is connected to and extends from, the operational portion of the core member where the sleeve member is located during operation of the roller, the diameter of the tapering portion of the core increasing to a maximum diameter which is substantially the same as that of the operational portion, the taper starting from a diameter slightly smaller than that of the operational portion. The taper helps to enable a sleeve member to slide on to the tapering portion during placement of a sleeve member on the core member. In the operational portion of the core member is provided a plurality of holes, connected to a chamber located inside the core member, the chamber being connectable, e.g., to a source of compressed air, the plurality of holes being located in the operational portion near to the gradually tapering portion. Preferably, a set of equally spaced holes is located around a perimeter and located a few millimeters from the start of the gradually tapering portion. Compressed air is transmitted from the chamber through the holes to elastically stretch a sleeve member during placement of the sleeve member on the operational portion, such that when the sleeve member is in an operational position on the core member, the source of compressed air can be shut off, thereby allowing the sleeve member to relax but remain slightly stretched and under tension, so as to non-adhesively and snugly grip the core member in a uniform fashion. Similarly, compressed air is used to elastically stretch the sleeve member during removal of the sleeve member. It is to be understood that the above-described method of removal or placement of a sleeve on a core member is exemplary only, and that particular details, e.g., of the shape of the core member, the location of the holes for supplying compressed air, and so forth, may vary widely in applications of the invention.

The strengthening band 25 of the sleeve 26 may be rigid or flexible. The strengthening band has a Young's modulus in a range of approximately between 100 MPa and 500 GPa and preferably between 10 GPa and 300 GPa, and a thickness preferably in a range of approximately between 20 micrometers and 500 micrometers, and more preferably between 40 micrometers and 100 micrometers. The strengthening band can include any suitable material, e.g., metal, elastomer, plastic or a reinforced material such as, for example, a fabric or a reinforced silicone belt. It is preferred that the strengthening band be a seamless web or tube, e.g., an electroformed metal belt, available for example from Stork Screens America, Inc., of Charlotte, N.C. Less preferably, the strengthening band may be fabricated from a sheet by, for example, forming a smooth seam by ultrasonic welding or by using an adhesive.

Formed on strengthening band (SB) 25, e.g., by a suitable coating method, is a relatively thick compliant base cushion layer (BCL) designated as 22. To promote adhesion between the SB 25 and the BCL 22, a thin primer layer (not shown in FIG. 1) may be used, such as for example made from air-dried GE 4044 priming agent (sold by General Electric). In intimate contact with and surrounding the BCL 22 is a thin interlayer 23 which is a stiffening layer. Intimate contact is defined as an interface substantially free of bubbles or voids, and may be adhesive or non-adhesive. Coated on the stiffening layer (SL) 23 is a relatively thin compliant release layer or outer layer (OL) designated 24. (Henceforth the terms "release layer" and "outer layer" are used interchangeably and mean the same thing). The BCL 22 and OL 24 may be the same or different compliant materials.

The base cushion layer 22 may include any suitable thermally stable elastomeric material, such as a single-phase elastomeric material, or it may include an elastomeric material consisting of more than one phase, e.g., a two-phase material such as a closed-cell foam, or a material in which the second phase is a particulate filler dispersed in an elastomer. The BCL 22 may be a fluoroelastomer, e.g., a Viton™ from DuPont) or a Fluorel™ from Minnesota Mining and Manufacturing). Alternatively, the BCL 22 may include a rubber, such as an EPDM rubber made from ethylene propylene diene monomers, or an EPDM rubber further including a particulate filler, preferably of iron oxide. The BCL 22 may also include an addition cured silicone rubber with a chromium (III) oxide filler. However, it is preferred that the BCL 22 includes a condensation-cured poly(dimethylsiloxane) elastomer and further includes a filler which can be aluminum oxide, iron oxide, calcium oxide, magnesium oxide, nickel oxide, tin oxide, zinc oxide, or mixtures thereof. This filler preferably includes particles having a mean diameter in a range of approximately between 0.1 micrometer and 100 micrometers and occupying 3 to 30 volume percent of the base cushion layer, and more preferably, a mean diameter between 0.5 micrometer and 40 micrometers and occupying 5 to 20 volume percent of the base cushion layer. The filler preferably includes zinc oxide particles. The base cushion layer 22 preferably has a thickness in a range of approximately between 0.25 mm and 25 mm, and more preferably, between 1.25 mm and 12.5 mm. The BCL 22 preferably has a thermal conductivity less than 0.4 BTU/hr/ft/° F., and more preferably, in a range of 0.1 BTU/hr/ft/° F.–0.3 BTU/hr/ft/° F. The BCL 22 also has a Poisson's ratio preferably in a range of between approximately 0.2 and 0.5, and more preferably, between 0.45 and 0.5. In addition, the base cushion layer 22 preferably has a Young's modulus in a range of approximately between 0.05 MPa and 10 MPa, and more preferably, between 0.1 MPa and 1 MPa.

The stiffening layer 23 can include any suitable material, including metal, elastomer, plastic, woven material, fabric, cordage, mesh or reinforced material such as, for example, a reinforced silicone rubber belt. A cordage may include a continuous strand of any suitable material or a portion thereof wound around the roller, where the number of windings per unit length along the roller may be systematically varied. Alternatively, a cordage may include individual rings or loops of any suitable material, the loops being concentric with the roller axis, and the number of loops per unit length measured axially along the roller may be systematically varied. A material which is impervious to penetration by fuser oil is preferred, inasmuch as it is known that elevated temperature contact with fuser oil can deleteriously affect a base cushion layer and cause it to have a reduced operational life. It is preferred that the SL 23 has good thermal conductance, which helps to reduce variations in temperature near the surface of the roller 20 and thereby improves fusing uniformity and image quality. The stiffening layer 23 may be adhesively bonded to the BCL 22. The SL 23 preferably includes a suitably flexible high-modulus metal or plated metal, and can be made, e.g., from the group of metals including copper, gold, steel, and more preferably, nickel, or other suitable metals. The SL 23 may also include a sol-gel or a ceramer or an elastomer such as for example a polyurethane, a polyimide, a polyamide or a fluoropolymer, the SL having a yield strength which is not exceeded during operation of the fuser roller. The stiffening layer preferably has the form of a seamless endless belt. The stiffening layer may also include a sheet wrapped around the base cushion layer and smoothly joined by a seam to create an endless belt, and the seam may have an adhesive or a weld. It is preferable that the stiffening layer has a thickness less than about 500 micrometers, and more preferably, in a range of approximately between 75 micrometers and 250 micrometers. The Young's modulus of SL 23 is preferably in a range of approximately between 0.1 GPa and 500 GPa, and more preferably, between 10 GPa and 350 GPa. If the SL 23 is not impervious to fuser oil, a barrier layer including preferably a fluoroelastomer -may be provided above the BCL 22, preferably on top of SL 23 and under the release layer 24.

The compliant release layer or outer layer (OL) 24 preferably has a highly smooth outermost surface. The OL 24 is preferred to be highly resistant to abrasion, and can include any suitable elastomeric material preferably having a low surface energy, such as for example a silicone rubber, or a fluoroelastomer. The outer layer may include for example a PDMS, preferably an addition-cured poly(dimethylsiloxane) elastomer and silica and titania fillers. The OL 24 has a roughness value, Ra, no greater than about 10 microinches, as determined by measurements on a 15-inch long roller using a Federal Surfanalyzer 4000 Profilometer provided with a transverse chisel stylus moving at a speed of 2.5 mm/sec. A release layer 24 providing suitable smoothness, of which the composition and coating method are disclosed by Chen et al. in commonly assigned U.S. patent application Ser. No. 08/879,896, may include Silastic™ E RTV silicone rubber available from Dow Corning Corporation. The outer layer has a thickness preferably less than about 1 millimeter, and more preferably in a range of approximately between 25 micrometers and 250 micrometers. The OL 24 preferably has a thermal conductivity in a range of approximately between 0.2 BTU/hr/ft/° F. and 0.5 BTU/hr/ft/° F., and a Young's modulus of approximately between 0.05 MPa and 10 MPa, more preferably between 0.1 MPa and 1 MPa. The Poisson's ratio of the OL 24 is preferably in a range of between approximately 0.4 and 0.5, and more preferably, between 0.45 and 0.5. The release layer 24 further includes a particulate filler which can be aluminum oxide, iron oxide, calcium oxide, magnesium oxide, nickel oxide, tin oxide, zinc oxide, copper oxide, titanium oxide, silicon oxide, graphite, and mixtures thereof, and preferably zinc oxide. The particulate filler preferably occupies approximately 5 to 50 volume percent of the release layer, and more preferably, 10 to 35 volume percent. Preferably, the filler helps to provide good thermal conductivity in the OL 24, which reduces variations in temperature near the surface of the fuser roller 20 and thereby improves fusing uniformity and image quality.

The preferred sleeve member 26 including a stiffening layer in the form of an endless seamless belt is preferably made in three steps. The first step is to provide the strengthening band 25 mounted on a first mandrill and then to form a uniform base cushion layer 22 on the strengthening band. In the second step, the SL 23 in the shape of a seamless metal tube, preferably an electroformed belt preferably made of nickel available from Stork Screens America, Inc., of Charlotte, N.C., is mounted on a second mandrill and coated with the outer layer 24. The inner diameter of the as-purchased electroformed belt is a little smaller than the outside diameter of the BCL 22 on the first mandrill, typically about 300 micrometers smaller. In the third step, the electroformed belt coated by the OL 24 is removed from the second mandrill and slid over the BCL 22 on the first mandrill to create a completed sleeve member 26 on the first mandrill. To accomplish the third step, the inner diameter of the OL-coated electroformed belt is temporarily made larger than the outer diameter of the base cushion layer 22 as formed on the strengthening band 25. For example, an assembly of the first mandrill plus the strengthening band and the base cushion layer may be cooled to a low temperature in order to contract it, so that the OL-coated electroformed belt having a higher temperature can be slid into place. When the assembly is returned to room temperature, the stiffening layer 23, is placed under tension, so as to snugly and uniformly clasp the BCL 22. Alternatively, the third step can be accomplished by using any well-known compressed air assist technique to elastically stretch the OL-coated electroformed tube slightly so that it can be slid into place. In order to aid sliding, a lubricating aid may be applied to the outer surface of BCL 22, the inner surface of the SL belt 23, or both surfaces. Lubricating aids include materials, which can produce a low-surface-energy sliding interface, such as for example sub-Micron particles of silica and the like, zinc stearate, or other suitable materials. After the coated SL 23 is satisfactorily placed in a suitable position on the base cushion layer 22, and the compressed air turned off, the stretched SL relaxes and grips the stiffening layer snugly. Although the SL 23 in its final position after the third step is already in intimate tensioned contact with the BCL 22, an adhesive coating (not illustrated in FIG. 1) may be applied to the BCL surface in order to adhesively bond the SL to the BCL. Any other suitable method of fabricating the sleeve 26 may be used. The sleeve 26 is then subsequently removed from the first mandrill, e.g., by using any well-known compressed air assist technique to elastically stretch the strengthening band 25 by providing compressed air between the outer surface of the first mandrill and the inner surface of the SB 25, or alternatively by selectively cooling the first mandrill to shrink it or selectively heating the sleeve member to expand it before sliding the sleeve member off the first mandrill. The completed sleeve may then be mounted on the core member 21 by any suitable method including the aforementioned compressed air assist and cooling techniques, thereby creating a fully assembled fuser roller 20. The mounting of the sleeve 26 is preferably done with one end of the core member remaining attached to a frame portion of the electrostatographic machine, e.g., a frame portion of the fusing station (not illustrated) with the other end disconnected from its support.

Figure 2:
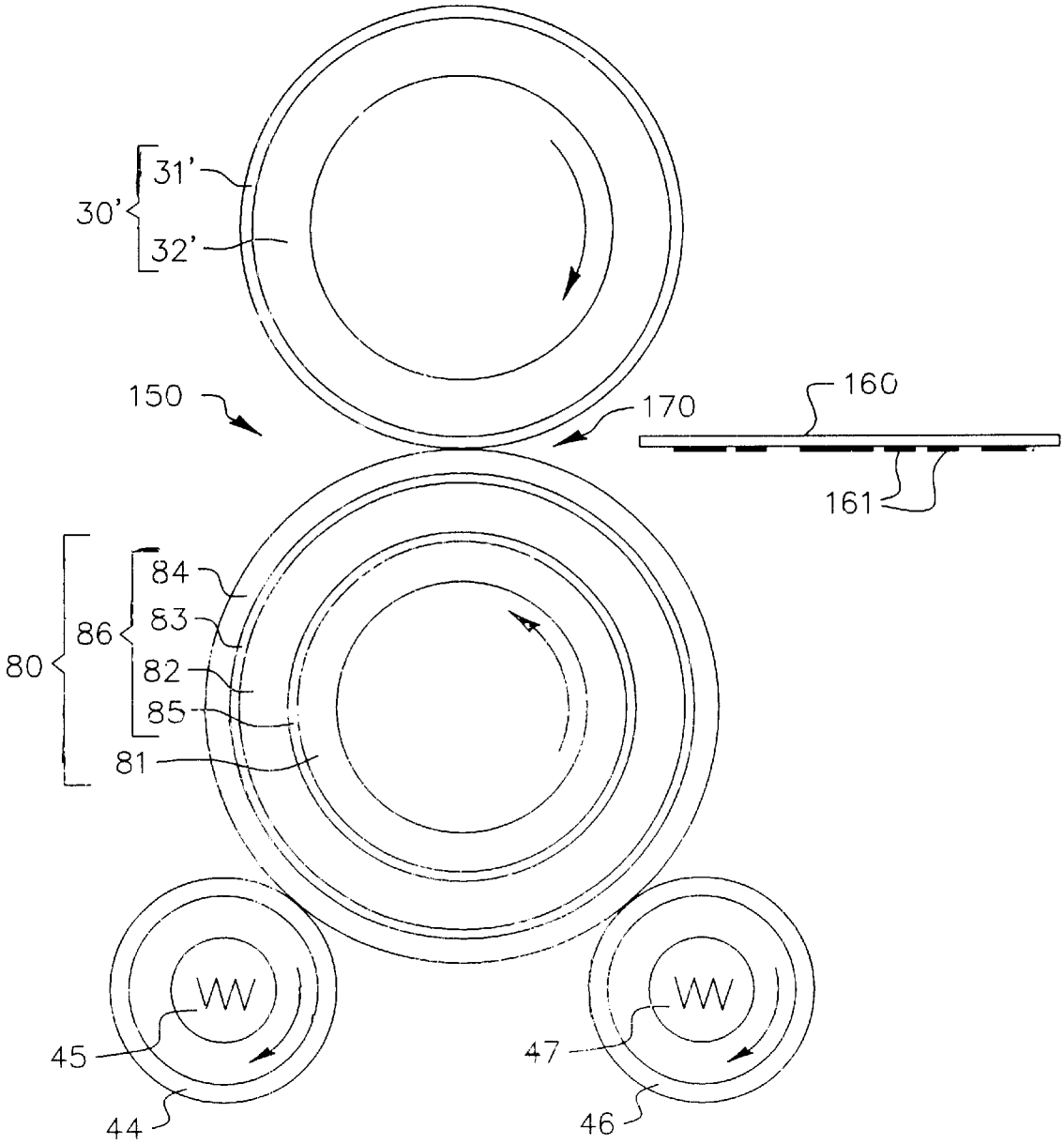
FIG. 2 depicts an end view of a simplex toner fusing station according to this invention which includes a hard pressure roller, engaged in a fusing nip with an externally-heated compliant fuser roller having a sleeve which includes a low-modulus barrier layer located under an outer layer.

A second preferred embodiment of a simplex fusing station is shown designated in FIG. 2 as 150, in which single-primed (') entities correspond to similar entities labeled by unprimed numerals in FIG. 1. Fusing station 150 includes a sleeved compliant externally-heated fuser roller and a hard pressure roller. A rotating fuser roller 80 includes a cylindrical core member 81, and a replaceable removable sleeve member 86, the sleeve preferably non-adhesively and snugly gripping the core 21. The sleeve member 86 includes a flexible strengthening band 85, a relatively thick compliant layer 82 formed on the strengthening band, a flexible thin interlayer 83 which is a low-modulus barrier layer coated on the compliant layer 82, and a compliant release layer or outer layer 84 coated on the barrier layer. Roller 80 is externally heated by any suitable heat source including any of the external heat sources described above for roller 20 in FIG. 1, such as for example external heating rollers 44 and 46 having sources of heating indicated as interior incandescent lamps 45 and 47. A counter-rotating hard pressure roller 30' forms a fusing nip 170 with compliant fuser roller 80. A receiver sheet 160 carrying an unfused toner image 161 facing the fuser roller 80 is shown approaching nip 170. The receiver sheet is fed into the nip by employing well known mechanical transports (not shown) such as a set of rollers or a moving web for example. The fusing station preferably has one driving roller, which may be either the fuser roller 80 or the pressure roller 30', the other roller being driven and rotated frictionally by contact.

In FIG. 2, core member 81 and layers 82, 83 and 84 have material characteristics and ranges of physical properties which are the same as for core member 21 and layers 22, 23 and 24, respectively.

The low-modulus thin barrier layer 83 in FIG. 2 is substantially impervious to fuser oil, and is similar to that disclosed in Chen et al., in U.S. patent application Ser. No. 08/879,896. The barrier layer preferably includes a fluoropolymer and 20 to 40 volume percent of a particulate filler. The fluoropolymer is preferably a random copolymer formed from mixtures of monomer units selected from vinylidene fluoride, tetrafluoroethylene, and hexafluoropropylene. The filler can be aluminum oxide, iron oxide, calcium oxide, magnesium oxide, nickel oxide, tin oxide, and mixtures thereof. Preferably the barrier layer has a thickness in a range of 10 micrometers to 50 micrometers.

The sleeve member 86 including a barrier layer is preferably made in three steps. The first step is to provide the strengthening band mounted on a first mandrill and then to form a uniform base cushion layer 82 on the strengthening band. In the second step, the barrier layer 83 is coated on the BCL. In the third step the OL 84 is coated on the barrier layer. The completed sleeve 86 may then be mounted on the core member 81 by any suitable method including the aforementioned compressed air assist and cooling techniques, thereby creating a fully assembled fuser roller 80. The mounting of the sleeve 86 is preferably done with one end of the core member remaining attached to a frame portion of the electrostatographic machine, e.g., a frame portion of the fusing station (not illustrated) with the other end disconnected from its support.

Figure 3:
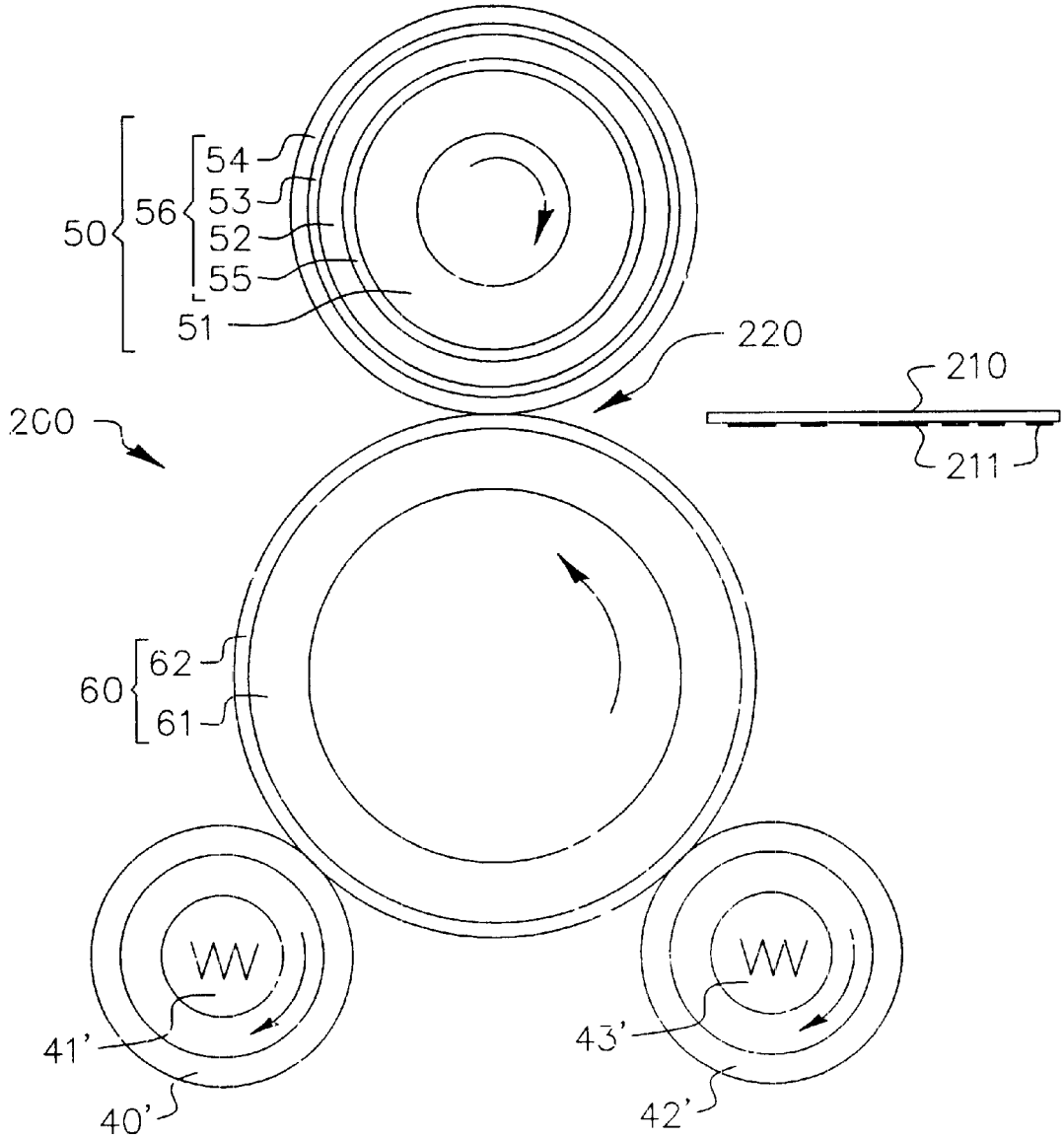
FIG. 3 depicts an end view of a simplex toner fusing station according to this invention which includes an externally-heated hard fuser roller engaged in a fusing nip with a compliant pressure roller having a sleeve which includes a stiffening layer.

A third preferred embodiment of an inventive simplex fusing station is shown in FIG. 3 designated as 200. In the figure the singly-primed (') entities correspond to similar entities labeled by unprimed numerals in FIG. 1. This preferred embodiment includes an externally heated hard fuser roller 60, and a sleeved compliant pressure roller 50 including a stiffening layer. Roller 60 is heated by any suitable external source of heat, such as for example may be provided by contact with one or more heating rollers indicated as 40' and 42' having sources of heating indicated as interior incandescent lamps 41' and 43'. A receiver sheet 210 carrying an unfused toner image 211 is shown approaching a fusing nip 220 formed by engaged rollers 50 and 60.

The fuser roller 60 includes a core member 61 and an optional surface layer 62 coated on the core. The core may be made of any suitable rigid material, e.g., aluminum, preferably including a cylindrical tube. Optional surface layer 62 is preferred to be less than 1.25 mm thick and preferably includes a thermally stable preferably low-surface-energy compliant or conformable material, for example a silicone rubber, e.g., a PDMS, or a fluoroelastomer such as a Viton™ (from DuPont) or a Fluorel™ from Minnesota Mining and Manufacturing). Alternatively, layer 62 may include a relatively hard poly(tetrafluoroethylene) or other suitable polymeric coating.

The sleeved compliant pressure roller 50 includes a rigid cylindrical core member 51, preferably made from aluminum, and a removable replaceable sleeve member 56 preferably having the form of a tubular endless belt non-adhesively and snugly gripping the core member 51. The sleeve includes a compliant base cushion layer 52 formed on a strengthening band 55, an interlayer 53 which is a stiffening layer preferably in the form of a tubular endless belt in intimate contact with and surrounding BCL 52, and an optional outer layer 54 coated on the stiffening layer.

The strengthening band 55 of the sleeve 56 may be rigid or flexible. The strengthening band (SB) 55 has a Young's modulus in a range of approximately between 100 MPa and 500 GPa and preferably between 10 GPa and 300 GPa, and a thickness preferably less than about 500 micrometers and more preferably, in a range of approximately between 40 micrometers and 100 micrometers. The SB 55 can include any suitable material, e.g., metal, elastomer, plastic or a reinforced material such as, for example, a fabric or a reinforced silicone belt. It is preferred that the strengthening band 55 be a seamless web or tube, e.g., an electroformed metal belt, available for example from Stork Screens America, Inc., of Charlotte, N.C. Less preferably, the strengthening band may be fabricated from a sheet by, for example, forming a smooth seam by ultrasonic welding or by using an adhesive.

The base cushion layer 52 preferably includes a suitable thermally stable elastomer, e.g., a fluoroelastomer, an EPDM rubber, a PDMS, or other suitable material preferably having thickness in a range of approximately between 0.25 mm and 25 mm. The base cushion layer preferably has a Young's modulus in a range of approximately between 0.05 MPa and 10 MPa and may further include a particulate filler or a foam. Base cushion layer 52 has a Poisson's ratio preferably in a range between approximately 0.2 and 0.5 and more preferably between 0.45 and 0.5. The base cushion layer 52 and outer layer 54 may be the same or different compliant materials.

The stiffening layer 53 preferably includes a thin, flexible, preferably high-modulus material having characteristics similar to those disclosed above for layer 23 of FIG. 1. Preferably, the stiffening layer is a seamless belt. It is preferred that stiffening layer 53 is made of nickel.

The optional outer layer 54 preferably includes an elastomer, such as for example a PDMS or a fluoropolymer, having a thickness preferably less than about 1 millimeter. Layer 54 preferably has a Young's modulus in a range of approximately between 0.05 MPa and 10 MPa, although the Young's modulus may be larger in some applications. The Poisson's ratio of outer layer 54 is in a range between approximately 0.4 and 0.5 and more preferably between 0.45 and 0.5.

The preferred sleeve member 56, including a stiffening layer preferably in the form of an endless seamless belt, is preferably made in similar fashion to that described above for sleeve 26, using the selective cooling or heating method or the compressed air assist method or any other useful method of fabrication.

Figure 4:
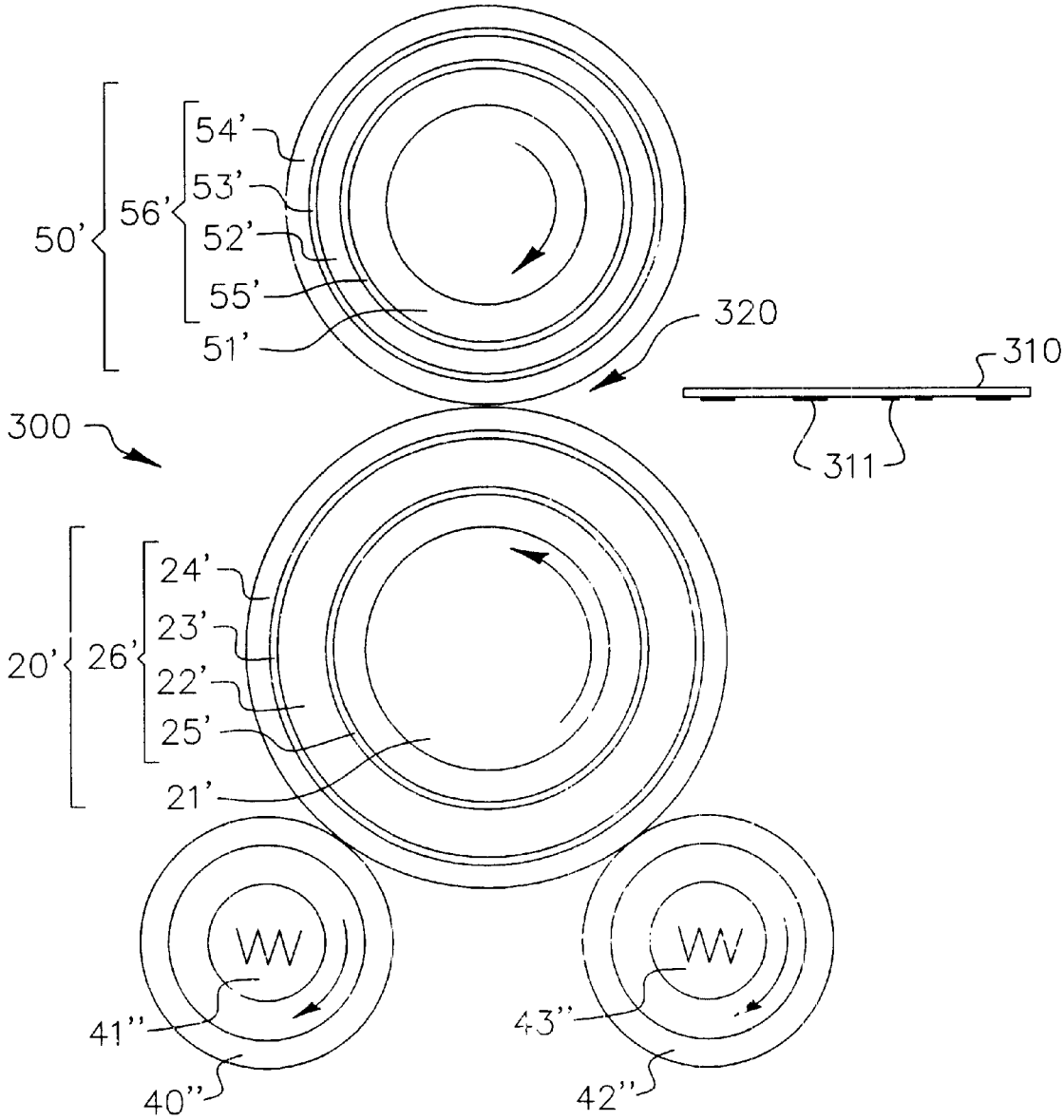
FIG. 4 depicts an end view of a simplex toner fusing station according to this invention which includes an externally-heated compliant fuser roller having a sleeve which includes a stiffening layer, engaged in a fusing nip with a compliant pressure roller having a sleeve which includes a stiffening layer.

A fourth preferred embodiment of an inventive simplex fusing station is shown in FIG. 4 designated as 300, in which the single-primed (') entities correspond to similar entities labeled by unprimed numerals in FIGS. 1 and 3. The material and physical characteristics of the single-primed and double-primed entities are similar and have the same ranges as disclosed above for the unprimed entities. Fusing station 300 includes an externally heated compliant fuser roller 20', the roller 20' including a removable replaceable sleeve member 26' preferably in the form of a tubular endless belt non-adhesively and snugly gripping a core member 21', and a compliant pressure roller 50', the roller 50' including a removable replaceable sleeve 56' preferably in the form of a tubular endless belt non-adhesively and snugly gripping a core member 51'. Fuser roller 20' is heated by any suitable external source of heat, such as for example may be provided by contact with one or more heating rollers labeled as 40" and 42" with sources of heating indicated as interior incandescent lamps 41" and 43". A receiver sheet 310 carrying an unfused toner image 311 is shown approaching a fusing nip 320 formed by engaged rollers 20' and 50'. The sleeve 26' includes a strengthening band 25', a base cushion layer 22' formed on the strengthening band 25', an interlayer 23' which is a stiffening layer in intimate contact with and surrounding the base cushion layer 22', and a release layer 24' coated on the stiffening layer 23'. The sleeve 56' includes a strengthening band 55', a base cushion layer 52' formed on the strengthening band 55', a stiffening layer 53' in intimate contact with and surrounding the base cushion layer 52', and an optional outer layer 54' coated on the stiffening layer 53'. The compliant base cushion layer and outer layer in each of rollers 20' and 50' may respectively include the same or different materials.

Figure 5:
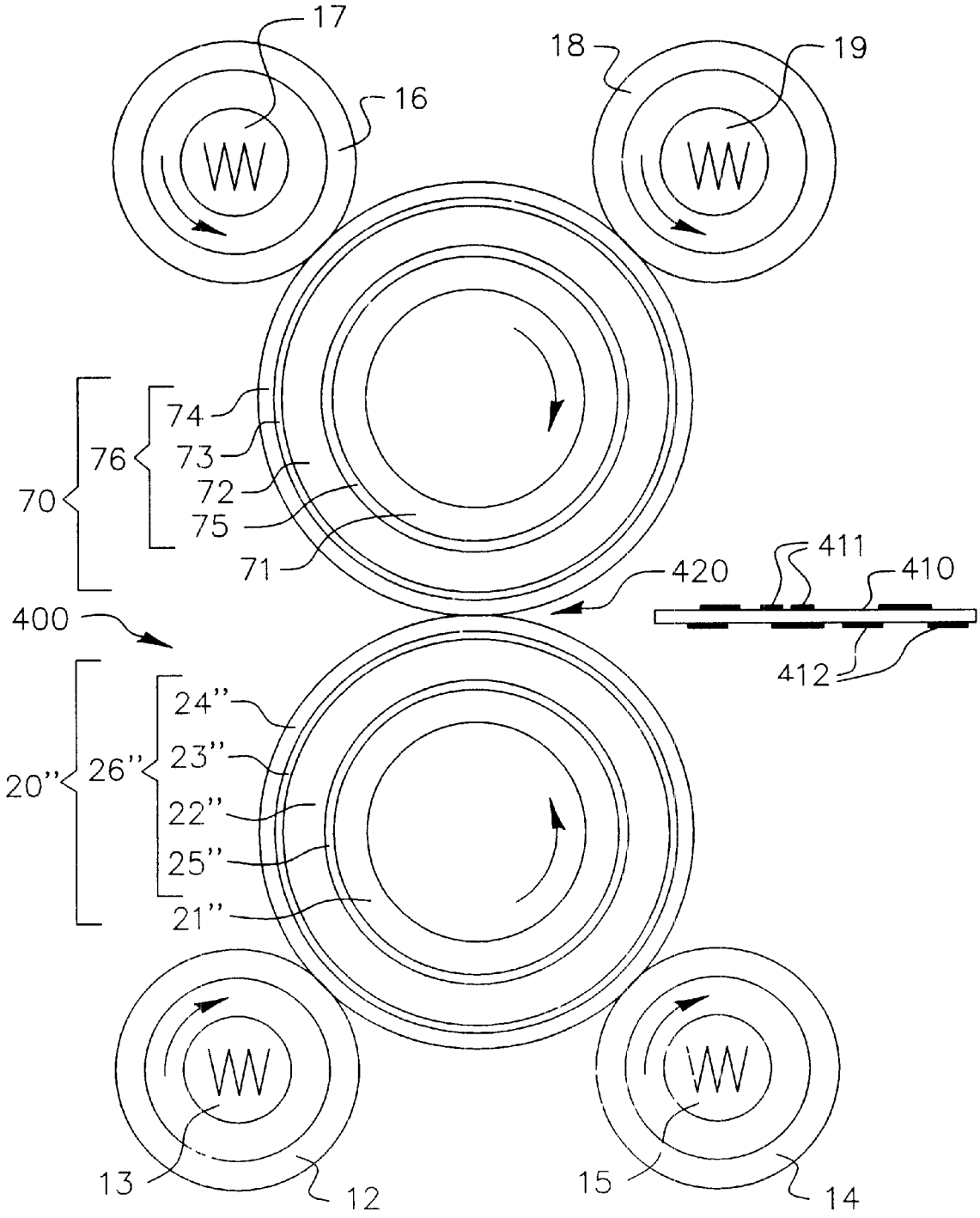
FIG. 5 depicts an end view of a duplex toner fusing station according to this invention which includes an externally-heated compliant first fuser roller having a sleeve which includes a stiffening layer, engaged in a fusing nip with an externally-heated compliant second fuser roller having a sleeve which includes a stiffening layer.

A preferred embodiment of an inventive duplex fusing station is shown in FIG. 5 designated as 400, wherein the double-primed entities correspond to similar entities labeled by unprimed numerals in FIG. 1, and the material and physical characteristics of the double-primed entities are qualitatively and quantitatively the same as those disclosed above for the unprimed entities. A first rotating externally-heated fuser roller indicated as 20" includes a removable replaceable sleeve 26" preferably in the form of a tubular endless belt non-adhesively and snugly gripping a rigid cylindrical core member 21". Sleeve 26" includes a strengthening band (SB) 25", a base cushion layer (BCL) 22" formed on SB 25", an interlayer which is preferably a stiffening layer (SL) 23" in intimate contact with and surrounding the BCL 22", and an outer release layer 24" coated on the SL 23". A counter-rotating externally-heated second sleeved fuser roller 70 forms a fusing nip 420 with the first fuser roller 20". The second fuser roller has the same structure as the first fuser roller, i.e., includes a removable replaceable sleeve 76 preferably in the form of a tubular endless belt non-adhesively and snugly gripping a rigid cylindrical core member 71. Sleeve 76 includes a strengthening band 75, a base cushion layer 72 formed on the strengthening band 75, an interlayer, which is preferably a stiffening layer 73 in intimate contact with and surrounding the base cushion layer 72, and a release layer 74 coated on the stiffening layer 73. The second fuser roller 70 is similar in other ways to the first fuser roller, inasmuch as it includes the same types of materials and the same ranges of physical and material parameters as disclosed above for the fuser roller 20 of the first simplex embodiment. Thus the elements 71, 72, 73, 74 and 75 correspond respectively with the elements 21", 22", 23", 24" and 25". However, the two fuser rollers 20" and 70 may differ within the disclosed parameter ranges in specific dimensions, such as for example roller diameters, layer thicknesses, and so forth, and may also differ in specific choices of materials and material properties. In particular, the base cushion layers 22" and 72 may be made of different materials, and the outer layers 24" and 74 may be made of different materials. Each of the fuser rollers is heated by any suitable external source of heat, such as for example may be provided by contact with one or more heating rollers, indicated as 12 and 14 for roller 20" and 16 and 18 for roller 70, with corresponding sources of heating indicated as interior incandescent lamps 13, 15, 17 and 19. A receiver sheet 411 is shown approaching fusing nip 420. On each side of the receiver is an unfused toner image, labeled 411 and 412, respectively.

Figure 6:
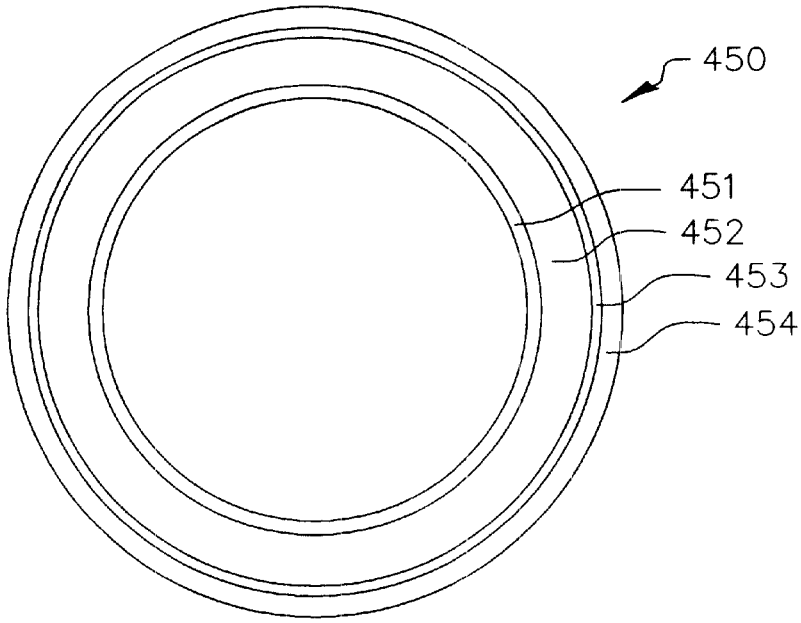
FIG. 6 depicts an end view of a sleeve member according to this invention which includes a tubular strengthening band, a base cushion layer formed on the strengthening band, an optional barrier layer coated on the base cushion layer, and an outer layer coated on the barrier layer.

A preferred embodiment of a conformable sleeve member is shown in FIG. 6, designated as 450. Sleeve 450 may be included in a conformable roller of a fusing station according to the invention. The sleeve 450 includes a tubular strengthening band 451, a compliant base cushion layer 452 formed on the strengthening band, a stiffening layer 453 surrounding and in intimate contact with the strengthening band, and an outer layer 454 on the stiffening layer. The physical characteristics of the individual layers 451, 452, 453 and 454 are determined by the usage of the sleeve 450, which may be used with a core member in an inventive fuser roller or in an inventive pressure roller, with the sleeve member 450 contacting the core member removably, replaceably and non-adhesively. When sleeve member 450 is included in a fuser roller which includes a stiffening layer, the characteristics of the individual layers are for example in all respects similar to those of sleeve 26 of fuser roller 20 in FIG. 1. Thus, for example, the characteristics of layer 451 are the same and have the same ranges as described in detail above for strengthening band 25 of sleeve 26 of fuser roller 20. Similarly, the ranges and characteristics of layer 452 correspond with those of base cushion layer 22 of sleeve 26 of roller 20, the ranges and characteristics of layer 453 correspond with those of stiffening layer 23 of sleeve 26 of roller 20, and the ranges and characteristics of layer 454 correspond with those of outer layer 24 of sleeve 26 of roller 20. When sleeve member 450 is included in a pressure roller, the characteristics of the individual layers are for example in all respects similar to those of sleeve 56 of pressure roller 50 in FIG. 3. Thus, for example, the characteristics of layer 451 are the same and have the same ranges as described in detail above for strengthening band 55 of sleeve 56 of pressure roller 50. Similarly, the ranges and characteristics of layer 452 correspond with those of base cushion layer 52 of sleeve 56 of roller 50, the ranges and characteristics of layer 453 correspond with those of stiffening layer 53 of sleeve 56 of roller 50, and the ranges and characteristics of layer 454 correspond with those of outer layer 54 of sleeve 56 of roller 50. Conformable sleeve member 450 may include additional layers (not illustrated), such as for example priming layers or subbing layers as may be needed to manufacture the sleeve 450. Sleeve 450 may be provided with a surface treatment of the outer surface of layer 454. The surface treatment may include, for example, an application of a low surface energy compound or an application of small particles of silica or titania or the like in order to produce a low surface energy or a low adhesivity as may be necessary, or other surface treatments may be provided as may be required for suitable operation of the sleeve. Outer layer 454 is preferred to be compliant. Outer layer 454 may be coated on stiffening layer 453 by any suitable coating means, and the outer layer may require suitable curing, e.g., in an oven, before sleeve 450 is mounted on a core member to create a finished conformable roller.

Figure 7:
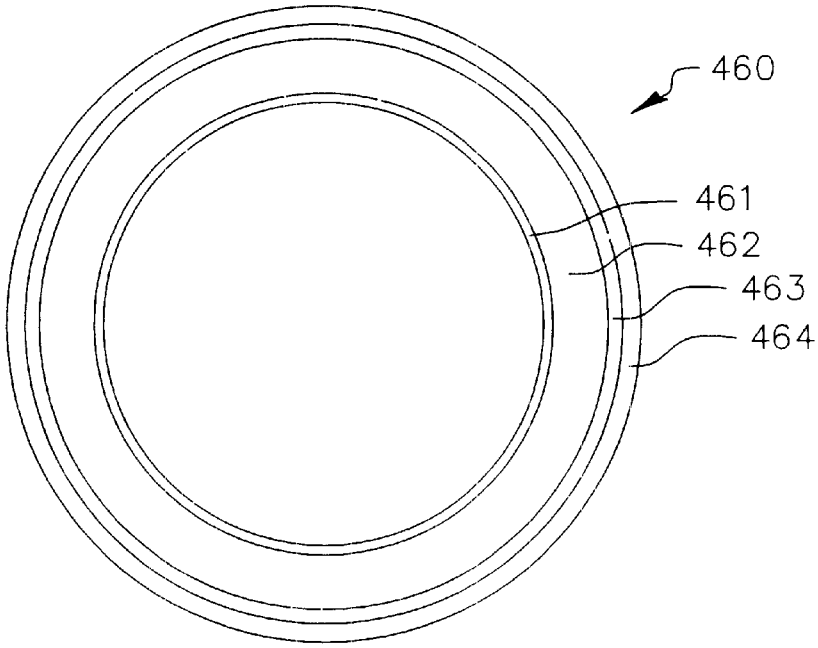
FIG. 7 depicts an end view of a sleeve member according to this invention which includes a tubular strengthening band, a base cushion layer formed on the strengthening band, a stiffening layer surrounding and in intimate contact with the base cushion layer, and an outer layer coated on the stiffening layer.

Another preferred embodiment of a conformable sleeve member is shown in FIG. 7, designated as 450. Sleeve 450 may be included in a conformable roller of a fusing station according to the invention. The sleeve 460 includes a tubular strengthening band 461, a compliant base cushion layer 462 formed on the strengthening band, a low-modulus barrier layer 463 surrounding and in intimate contact with the strengthening band, and an outer layer 464 on the stiffening layer. The characteristics of the individual layers are for example in all respects similar to those of sleeve 86 of fuser roller 80 in FIG. 2. Thus, for example, characteristics of layer 461 are the same and have the same ranges as described in detail above for strengthening band 85 of sleeve 86 of fuser roller 80. Similarly, the ranges and characteristics of layer 462 correspond with those of base cushion layer 82 of sleeve 86 of roller 80, the ranges and characteristics of layer 463 correspond with those of stiffening layer 83 of sleeve 86 of roller 80, and the ranges and characteristics of layer 464 correspond with those of outer layer 84 of sleeve 86 of roller 80. Conformable sleeve member 460 may include additional layers (not illustrated), such as for example priming layers or subbing layers as may be needed to manufacture the sleeve 460. Sleeve 460 may be provided with a suitable surface treatment of the outer surface of layer 464 as may be required for suitable operation of the sleeve. Outer layer 464 is preferred to be compliant. Outer layer 464 may be coated on stiffening layer 463 by any suitable coating means, and the outer layer may require suitable curing, e.g., in an oven, before sleeve 460 is mounted on a core member to create a finished conformable roller.

The fusing stations described above so far include sleeved compliant rollers having a single sleeve. Other useful embodiments of the invention are also contemplated which employ compliant double-sleeved externally-heated fuser rollers and pressure rollers, and in particular, externally-heated double-sleeved rollers including a stiffening layer. Referring back to FIG. 1, a simplex fusing station may include, as an alternative to fuser roller 20, an externally heated double-sleeved compliant fuser roller 90, wherein roller 90 is shown being used in conjunction with hard pressure roller 30. Fuser roller 90 includes a core member 91, a replaceable removable inner sleeve member 96 which includes a strengthening band 95 on which a base cushion layer 92 is formed, and a replaceable removable outer sleeve member 97 which includes a stiffening layer 93 and a release layer 94 coated on the stiffening layer. The external source of heat is entirely similar to that of roller 20, and the shapes, parameters, ranges, and material characteristics of core 91 and layers 92, 93, 94 and 95 are preferably entirely similar to those of core 21 and layers 22, 23, 24, and 25, respectively. The inner sleeve 96 is preferably in the form of a tubular endless belt non-adhesively and snugly gripping core member 91, and the outer sleeve 97 is preferably in the form of a tubular endless belt non-adhesively and snugly gripping the inner sleeve 96. The double-sleeved structure of roller 90 makes it possible to replace either the outer sleeve or the inner sleeve separately, inasmuch as either sleeve may tend to have a shorter life than the other, or else one of the sleeves may become damaged during operation and require separate replacement. This advantageously allows lowering of fabrication costs by having simpler sleeves, and reduces operational costs by being able to retain a sleeve for additional use when the other sleeve is at the end of its useful life.

Figure 8A:
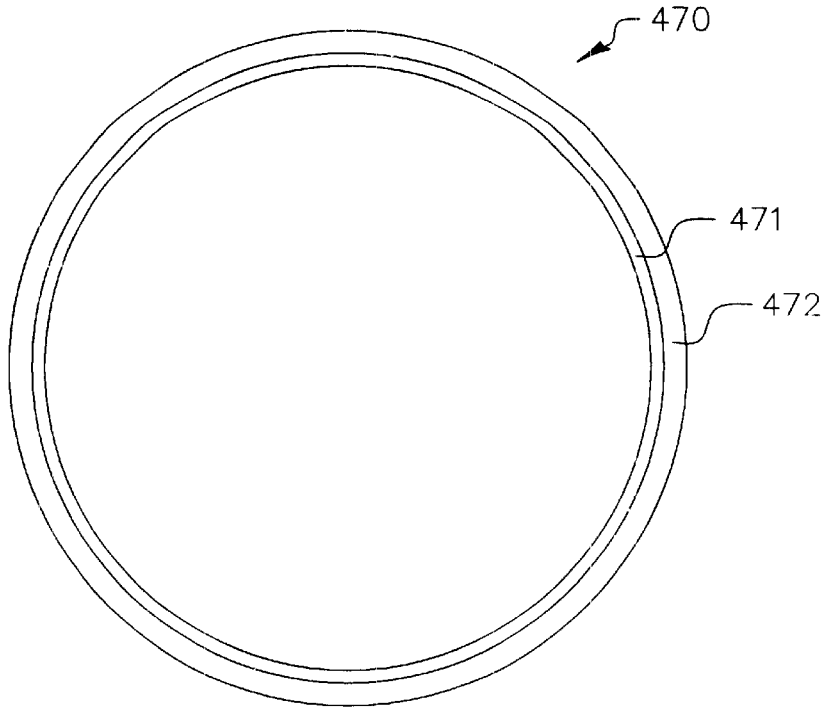
FIG. 8(*a*) depicts an end view of an outer sleeve member according to this invention, which includes a stiffening layer and an outer layer coated on the stiffening layer.
Figure 8B:
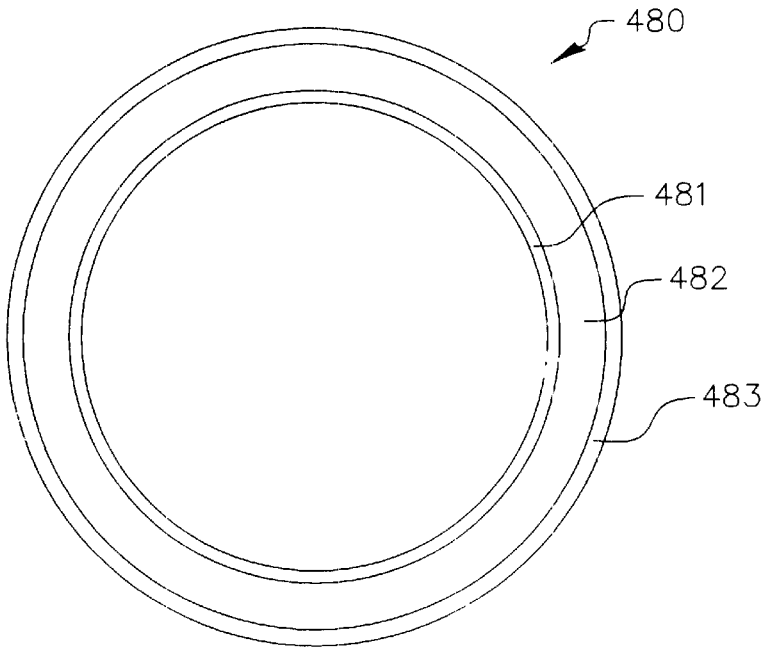

FIGS. 8(*a*) and 8(*b*) show end views of two preferred embodiments of inner and outer sleeve members for inclusion in a double-sleeved conformable roller of a fusing station according to the invention. FIG. 8(*a*) shows an outer sleeve member designated as 470, and FIG. 8(*b*) shows an inner sleeve member designated as 480. The outer sleeve 470 includes a tubular stiffening layer 471 and an outer layer 472 on the stiffening layer 471. The inner sleeve 480 includes a tubular strengthening band 481, a compliant base cushion layer 482 formed on the strengthening band 481, and a protective layer 483 on the compliant base cushion layer 482.

In outer sleeve 470 of FIG. 8(*a*), the physical characteristics of the individual layers 471 and 472 are determined by the usage of the outer sleeve. An outer sleeve 470 is used in conjunction with a core member and an inner sleeve member, either in an inventive fuser roller or in an inventive pressure roller, with the outer sleeve member 470 contacting the inner sleeve member removably, replaceably and non-adhesively. When outer sleeve member 470 is included in a fuser roller which includes a stiffening layer, the characteristics of the individual layers are for example in all respects similar to those of outer sleeve 97 member of fuser roller 20 in FIG. 1. Thus, for example, the characteristics of layer 471 are the same and have the same ranges as described in detail above for stiffening layer 93 of outer sleeve member 97 of fuser roller 90. Similarly, the ranges and characteristics of layer 472 correspond with those of outer layer 94 of outer sleeve member 97 of roller 90. When outer sleeve member 470 is included in a pressure roller, the characteristics of the individual layers of are for example in all respects similar to those of sleeve 56 of pressure roller 50 in FIG. 3 (a double-sleeved pressure roller is not illustrated in FIG. 3). Thus, for example, the characteristics of layer 471 are the same and have the same ranges as described in detail above for stiffening layer 53 of pressure roller 50. Similarly, the ranges and characteristics of layer 472 correspond with those of outer layer 54 of roller 50. Conformable outer sleeve member 470 may include additional layers (not illustrated), such as for example priming layers or subbing layers as may be needed to manufacture the outer sleeve 470. Outer layer 472 is preferred to be compliant. The outer surface of layer 472 of outer sleeve 470 may be provided with a surface treatment. The surface treatment may include, for example, an application of a low surface energy compound or an application of small particles of silica or titania or the like in order to produce a low surface energy or a low adhesivity as may be necessary, or other surface treatments may be provided as may be required for suitable operation of the sleeve. Outer layer 472 may be coated on stiffening layer 471 by any suitable coating means, and the outer layer may require suitable curing, e.g., in an oven, before outer sleeve 470 is mounted on an inner sleeve member previously mounted on a core member to create a finished conformable roller.

In the inner sleeve 480 of FIG. 8(*b*), the physical characteristics of the individual layers 481 and 482 are determined by the usage of the inner sleeve. An inner sleeve 480 is used sandwiched between a core member and an outer sleeve member in an inventive fuser roller or in an inventive pressure roller, with the inner sleeve member 480 contacting the core member removably, replaceably and non-adhesively. When inner sleeve member 480 is included in a fuser roller which includes a stiffening layer, the characteristics of the individual layers are for example in all respects similar to those of inner sleeve 96 of fuser roller 90 in FIG. 1. Thus, for example, the characteristics of layer 481 are the same and have the same ranges as described in detail above for strengthening band 95 of inner sleeve 96 of fuser roller 90. Similarly, the ranges and characteristics of layer 482 correspond with those of base cushion layer 92 of inner sleeve 96 of roller 90. When inner sleeve member 480 is included in a pressure roller, the characteristics of the individual layers are for example in all respects similar to those of sleeve 56 of pressure roller 50 in FIG. 3 (a double-sleeved pressure roller is not illustrated in FIG. 3). Thus, for example, the characteristics of layer 481 are the same and have the same ranges as described in detail above for strengthening band 55 of sleeve 56 of pressure roller 50. Similarly, the ranges and characteristics of layer 482 correspond with those of base cushion layer 52 of roller 50. Conformable inner sleeve member 480 may include additional layers (not illustrated), such as for example priming layers or subbing layers as may be needed to manufacture the inner sleeve 480.

The base cushion layer 482 of inner sleeve 480 may be optionally overcoated, using any suitable coating method, by a flexible, thin, preferably hard, protective layer 483 (a protective layer is not illustrated in inner sleeve 96 of roller 90 in FIG. 1). The purpose of this protective layer is to protect the base cushion layer 482 from damage, e.g., during placement or removal of an outer sleeve member. Protective layer 484 may be coated on base cushion layer 483 by any suitable coating means, and the protective layer may require suitable curing, e.g., in an oven. The protective layer may include a sol-gel, a ceramer, or any other suitable material. Alternatively, the protective layer may include a thin metal band, e.g., of nickel, which may be in the form of an endless belt held under tension to provide an intimate contact with the outer surface of the base cushion layer. The thin metal band may be applied to the outer surface of the base cushion layer 482 by, for example, mounting on a mandrill a sleeve which includes strengthening band 481 and base cushion layer 482 previously formed on the strengthening band, and then using compressed air assist to slide the thin metal tube over the base cushion layer to a suitable position, or by cooling the assembly of the mandrill with the strengthening band plus base cushion layer in order to shrink the assembly so as to slide on the thin metal band. In some applications the protective layer 483 may be adhered to base cushion layer 482 using an adhesive. The protective layer 483 has a thickness preferably in a range of approximately between 1 micrometer and 50 micrometers and more preferably between 4 micrometers and 15 micrometers, and a Young's modulus preferably greater than 100 MPa and more preferably in a range of approximately between 0.5 GPa and 20 GPa.

An outer sleeve member 470 may be made for example by providing a cylindrical mandrel on which the stiffening layer 471 has been previously mounted, e.g., as previously described above by using compressed air assist or by temporarily cooling the mandrel in order to shrink it, and then forming the outer layer 472 on the stiffening layer, whereupon the outer sleeve 470 may be removed from the mandrel, e.g., by using compressed air assist and sliding the outer sleeve off the mandrel, or the outer sleeve may be removed by temporarily selectively cooling the mandrel or selectively heating the sleeve in order to shrink the mandrel or expand the outer sleeve before sliding the outer sleeve off the mandrel. Similarly, an inner sleeve 480 may be made by providing a cylindrical mandrel on which is mounted the strengthening band 481, e.g., by using compressed air assist or by temporarily cooling the mandrel in order to shrink it, and then forming the base cushion layer 482 on the strengthening band and the protective layer 483 on the base cushion layer, whereupon the inner sleeve 480 may be removed from the mandrel, e.g., by using compressed air assist and sliding the inner sleeve off the mandrel, or the inner sleeve may be removed by temporarily selectively cooling the mandrel or selectively heating the sleeve in order to shrink the mandrel or expand the inner sleeve before sliding the inner sleeve off the mandrel.

Either or both of the inner surface of stiffening layer 471 of outer sleeve 470 and the outer surface of outer layer 483 of inner sleeve 480 may be treated with a suitable lubricating agent to facilitate mounting of the respective sleeves on a core member to create a fully assembled double-sleeved conformable roller of the invention. The mounting of the inner and outer sleeves is done successively, preferably using any compressed air assist technique or any other suitable method, and preferably with one end of the core member remaining attached to a frame portion (not illustrated) of the electrostatographic apparatus with the other end disconnected from its support, the sleeves being successively mounted over the free end of the core member.

Double-sleeved fuser roller embodiments similar to roller 90 may be similarly used as alternatives to fuser rollers 20', 20", 70 and 80. Thus, as an alternative to fuser roller 20' of FIG. 4, layers 23' and 24' may be included in an outer sleeve, and layers 22' and 25' in an inner sleeve, with layer 22' being optionally coated by a protective layer (not illustrated). Analogously, double-sleeved pressure roller embodiments (not illustrated) may be similarly used as alternatives to pressure rollers 50 and 50'. Thus, in roller 50 of FIG. 3, layers 53 and 54 may be included in an outer sleeve, and layers 52 and 55 in an inner sleeve, with layer 52 being optionally coated by a protective layer (not illustrated).

In certain embodiments of sleeved rollers described below, it is advantageous to provide a sleeve member including a stiffening layer having a stiffness that varies along the length of the sleeve, in particular for an inventive fusing roller. It may also be advantageous to provide a variably stiff stiffening layer included in a sleeve member of a compliant pressure roller used in a fusing station of the invention. A variably stiff stiffening layer of a sleeve member can improve paper transport through a fusing station, particularly when paper receiver sheets are not perfectly rectangular as a result of humidity-induced swelling. A typical 8.5"×11" paper sheet has long paper fibers oriented substantially parallel to the 11" direction, and moisture penetrates preferentially into the 8.5" edges typically causing the nominally 8.5" edges to expand by about 1% to 2% compared to the nominal 8.5" width. It is usual practice to feed such paper sheets into a fuser nip with the 8.5" edges oriented parallel to the paper feeding direction, i.e., perpendicular to the roller axes. As a result, it typically takes a longer time for the swollen 8.5" edges to pass through the fusing nip than it does for the middle of the sheet. This can result in severe paper wrinkling and large scale image defects. To correct this problem, it is preferred that all portions of the paper spend substantially the same time passing through the nip. A means to accomplish this is to provide a greater amount of overdrive near the swollen 8.5" edges of the paper than at the center. As is also well known, a pressure nip formed between two rollers, at least one of which has an elastomeric coating, does not usually have a uniform pressure distribution measured in the axial direction along the length of the rollers. Rather, owing to the fact that the compressive forces are applied at the ends of the rollers, e.g., to the roller axle, the rollers tend to bow outwards slightly, thereby producing a higher pressure near the ends of the rollers than half way along their length. This also tends to produce greater overdrive towards the ends of the rollers. However, the amount of extra overdrive from roller bending is not normally sufficient to compensate for humidity-induced paper swelling, and embodiments of sleeves including a variably stiff stiffening layer may be used.

In embodiments described below, a variably stiff stiffening layer is provided in a sleeve member of a conformable inventive roller to produce a predetermined variation of overdrive along the length of a roller, e.g., to compensate for humidity-induced paper swelling. The variably stiff stiffening layer may be included in a sleeve of a fuser roller, e.g., a sleeve 26, 26', 26" or 76 of respective rollers 20, 20', 20" or 70, and an outer sleeve such as sleeve 97 of fuser roller 90. Or, the variably stiff stiffening layer may be included in a sleeve of a pressure roller, e.g., pressure rollers 50 or 50'. When a stiffening layer includes a cordage, a fabric, or a woven material, the spaces or interstices between cords or fibers may be filled by any suitable material, including a material of an adjacent layer of an inventive roller.

Figure 9:
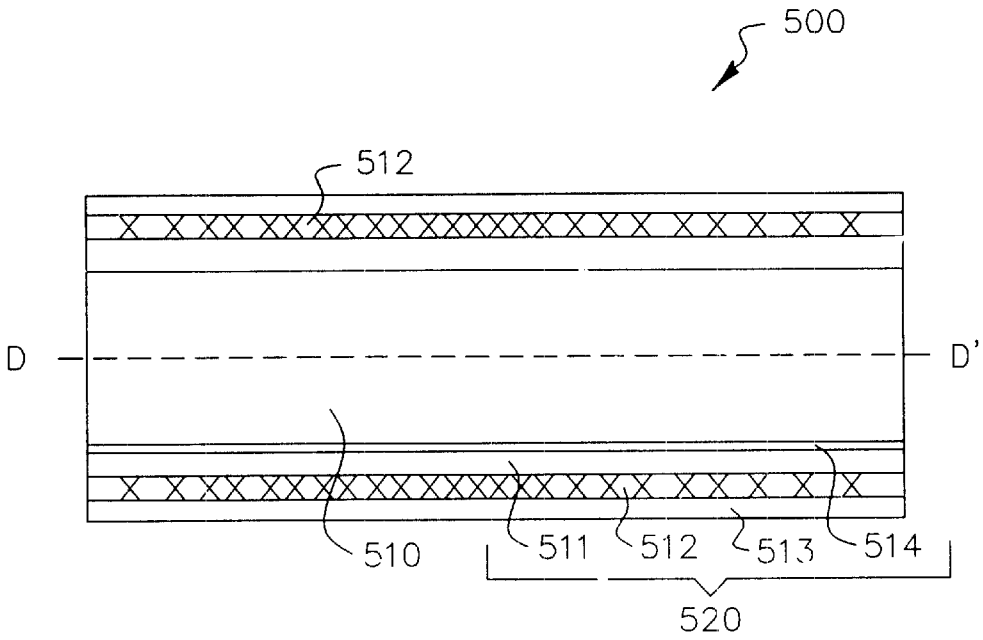
FIG. 9 shows a diagrammatic representation of a roller according to this invention, provided with a stiffening layer having a longitudinally variable Young's modulus.

In an embodiment utilizing a sleeve member having a variably stiff stiffening layer included in a conformable roller of a fusing station according to the invention, the stiffening layer is provided with a Young's modulus that varies systematically parallel to the roller axis, the modulus being measured parallel to a tangential direction of rotation of the roller. It is preferred that the modulus of the stiffening layer be greatest substantially midway along the length of the sleeve, and least near each end of the sleeve. As a result, when the roller is engaged in the fusing nip, there will be an increased amount of overdrive provided by the reduced stiffness of the stiffening layer near the edges of a paper sheet, as compared to the center of the paper, thereby providing a mechanism to ensure that all portions of the paper sheet spend substantially the same time passing through the nip. In this embodiment, the stiffening layer may include a continuous, thin, seamless metal tube in which the Young's modulus may be controlled, for example, by providing the metal as an alloy having a variable composition parallel to the roller axis. Alternatively, the stiffening layer may include a cordage in which the Young's modulus is changed systematically as a function of position along the roller, or the stiffening layer may include any other suitable material for which the Young's modulus can be systematically controlled and varied. FIG. 9 shows a longitudinal cross section of a diagrammatic representation of an exemplary inventive cylindrically symmetric roller, indicated as 500, including a sleeve member 520 provided with a stiffening layer 512 having a variable Young's modulus. Roller 500 includes a rigid core member 510 having a substantially uniform outer diameter along the length of the roller, and sleeve member 520 includes a strengthening band 514, a compliant base cushion layer 511 formed on the strengthening band 514, a stiffening layer 512 surrounding and in intimate contact with the base cushion layer 511 with stiffening layer 512 having a Young's modulus variable in a direction parallel to an axis of rotation indicated by D . . . D', and an outer layer 513 on the stiffening layer. Layer 513 is preferably compliant. Stiffening layer 512 is depicted with hatchings in which the density of hatching lines represents the magnitude of Young's modulus, with Young's modulus of stiffening layer 512 increasing from a minimum value at each end of the sleeve 520 towards a maximum value located at substantially the midpoint along the length of the sleeve. For clarity of understanding, the thickness of stiffening layer 512 has been greatly exaggerated. The longitudinal variation of Young's modulus of stiffening layer 512 may be smooth from an end of the sleeve 520 to substantially the midpoint, as suggested by the variation of hatching density in FIG. 9, or it may have more or less abrupt changes. For example, individual longitudinal lengths or sections having discretely different Young's moduli may be used to make layer 512, where the individual lengths may be different materials. The individual longitudinal lengths need not be joined to form a continuous tube but may be separated by gaps, the gaps being preferably small enough so as to cause no noticeable effects at the exterior surface of layer 513 that could result in a decreased fusing performance or quality. Moreover, the maximum value of Young's modulus may, if desired, extend for a suitable distance on either side of substantially the midpoint along the length of the sleeve 520.

Figure 10:
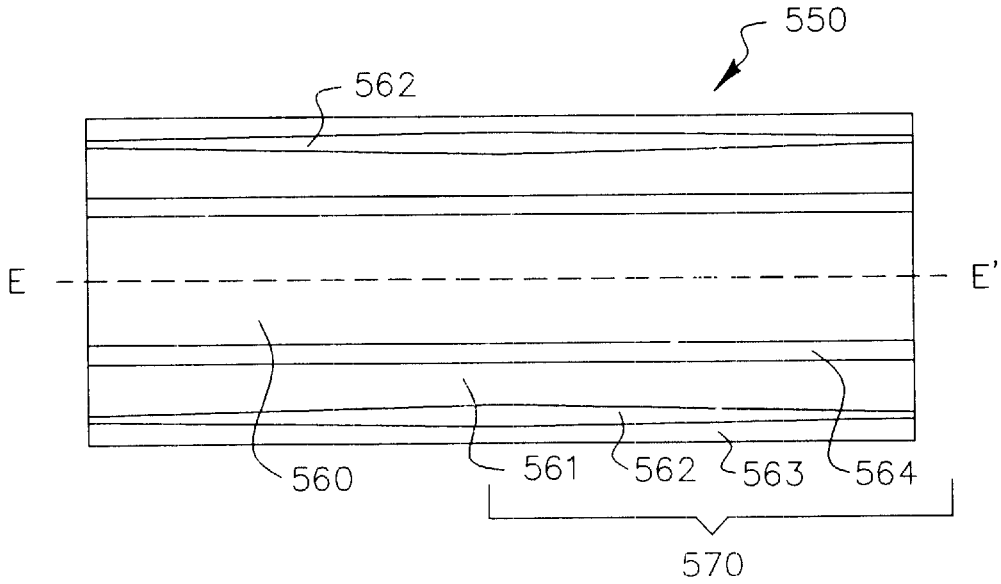
FIG. 10 shows a diagrammatic representation of a roller according to this invention, provided with a stiffening layer having a thickness that varies along the length of the roller.

In a further embodiment utilizing a sleeve member having a variably stiff stiffening layer included in a conformable roller of a fusing station according to the invention, the stiffening layer of the sleeve is provided with a thickness that varies systematically parallel to the roller axis. It is preferred that the thickness of the stiffening layer be greatest substantially midway along the length of the sleeve, and least near each end of the sleeve. As a result, when the roller is engaged in the fusing nip, there will be an increased amount of overdrive provided by the reduced thickness of the stiffening layer near the edges of a paper sheet, as compared to the center of the paper, thereby providing a mechanism to ensure that all portions of a paper sheet spend substantially the same time passing through the nip. In this embodiment, the stiffening layer preferably includes a continuous, seamless, thin metal tube in which the thickness may be systematically varied parallel to the roller axis. Alternatively, the stiffening layer may include-a cordage in which the thickness of the cords is changed systematically as a function of position along the roller, or the stiffening layer may include any other suitable material for which the thickness can be systematically controlled and varied. FIG. 10 shows a longitudinal cross section of a diagrammatic representation of an exemplary inventive cylindrically symmetric roller, indicated as 550, which includes a sleeve member 570 provided with a stiffening layer 562 having a thickness that varies systematically parallel to the roller axis. Roller 550 includes a rigid core member 560 having a substantially uniform outer diameter along the length of the roller, and the sleeve 570 includes a strengthening band 564, a compliant base cushion layer 561 formed on the strengthening band 564, a stiffening layer 562 surrounding and in intimate contact with the base cushion layer 561 with stiffening layer 562 having a thickness variable in a direction parallel to an axis of rotation indicated by E . . . E', and an outer compliant layer 563 on the stiffening layer. Stiffening layer 562 is shown with a thickness increasing from a minimum value at each end of the sleeve 570 towards a maximum value located at substantially the midpoint along the length of the sleeve. For clarity of understanding, the thickness of stiffening layer 562 has been greatly exaggerated along the entire length of the sleeve 570. The longitudinal variation of thickness of stiffening layer 562 may be smooth from an end of the sleeve 570 to substantially the midpoint, as indicated in FIG. 10, or it may have more or less abrupt changes. For example, individual longitudinal lengths or sections having discretely different thicknesses may be used to make layer 562. The individual longitudinal lengths need not be joined to form a continuous tube but may be separated by gaps, the gaps being preferably small enough so as to enough so as to cause no noticeable effects at the exterior surface of layer 563 that could result in a decreased fusing performance or quality. Moreover, the maximum value of thickness of stiffening layer 562 may, if desired, extend for a suitable distance on either side of substantially the midpoint along the length of the sleeve 570. The stiffening layer 562 having a variable thickness may also include a mesh or a cordage (not illustrated) such that the diameters of the fibers, threads or wires of which the mesh or cordage is made are systematically varied so as to have a minimum diameter at or near each end of the sleeve 570, and a maximum diameter at substantially the midpoint along the length of sleeve 570.

Figure 11:
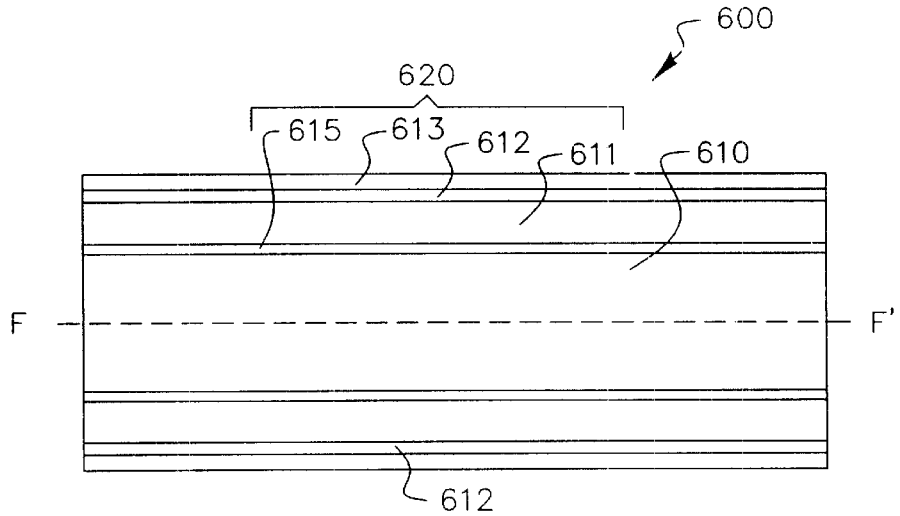
FIG. 11 shows a diagrammatic representation of a roller according to this invention, having a stiffening layer provided with a plethora of holes, with the combined area occupied by the holes varying along the length of the roller.
Figure 11:
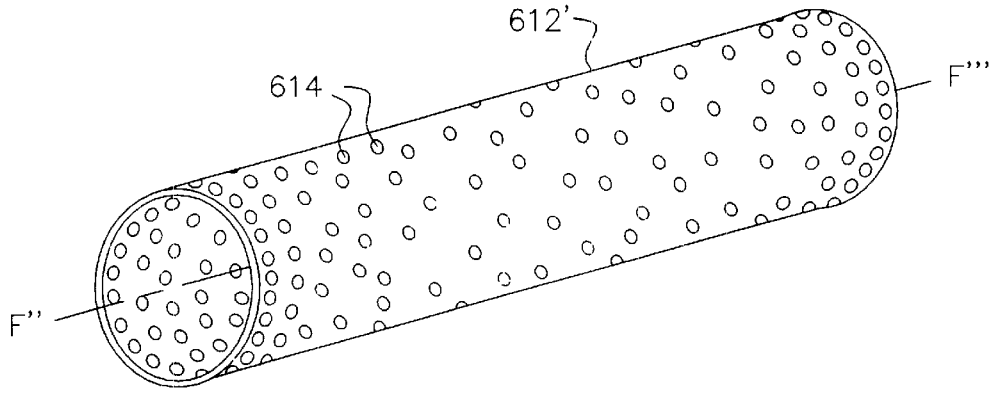

In another embodiment utilizing a sleeve member having a variably stiff stiffening layer included in a conformable roller of a fusing station according to the invention, the stiffening layer is provided with a plethora of holes, preferably small holes, with the combined area occupied by the holes varying systematically along the length of the roller parallel to the roller axis. This may be accomplished by changing number of holes per unit area along the length of the sleeve, or by changing the area per hole along the length of the sleeve, or by a combination of variation of hole size and area per hole along the length of the sleeve. The holes may, therefore, have different sizes at different locations in the stiffening layer. It is preferred that the fractional area occupied by holes per unit length of a sleeve included in an inventive roller be smallest substantially midway along the length of the sleeve, and greatest near each end of the sleeve. As a result, when the roller is engaged in the fusing nip, there will be an increased amount of overdrive provided by larger amount of strain in the stiffening layer near the edges of a paper sheet, as compared to the center of the paper, thereby providing a mechanism to ensure that all portions of a paper sheet spend substantially the same time passing through the nip. In this embodiment, the stiffening layer preferably includes a continuous, seamless, thin metal tube in which the holes may be provided, e.g., formed by punching, drilling, etching, or by using a laser. Alternatively, the stiffening layer may include any other suitable material in which the holes can be systematically be provided, such as a plastic or reinforced material. FIG. 11 shows a longitudinal cross section of a diagrammatic representation of an exemplary inventive cylindrically symmetric roller, indicated as 600, including a sleeve member 620. Roller 600 includes a rigid core member 610 having a substantially uniform outer diameter along the length of the roller, and the sleeve 620 includes a strengthening band 615, a compliant base cushion layer 611 formed on the strengthening band 615, a stiffening layer 612 surrounding and in intimate contact with the base cushion layer 611 with stiffening layer 612 being provided with a plethora of holes, preferably small holes, with the combined area occupied by the holes varying systematically per unit length along the length of the sleeve 620 parallel to the roller axis of rotation indicated by F . . . F', and an outer compliant layer 613 on the stiffening layer 612. For clarity of understanding, an embodiment of a stiffening layer 612' is depicted in the tubular representation shown in the lower portion of FIG. 11, in which a number per unit area of similar-sized holes 614 is shown steadily varying, in a direction parallel to axis F" . . . F'", from a maximum value at or near each end of the stiffening layer 612' towards a minimum value located at substantially the midpoint along the length of the stiffening layer. For ease of understanding, only a few approximately round holes 614 having exaggerated sizes are indicated in FIG. 11. In practice of the invention, a large number of very small holes per unit area is generally preferred, with the holes preferably having diameters which are smaller than the thickness of the stiffening layer. The holes may have any suitable shapes, including random shapes. Different sized holes may be used at different locations, and holes of different sizes may be used together in any local area of the stiffening layer 612. For an inventive fuser roller, it is preferred that the holes be small enough to produce no measurable effect on fusing uniformity. It is to be understood that, in other suitable embodiments of stiffening layer 612 (not illustrated), a variation in the total fractional area occupied by holes along the length of the stiffening layer may be accomplished by varying the area per individual hole, or by combining a variation of the area per individual hole with a variation in the number of holes per unit area of the stiffening layer 612. The longitudinal variation along the length of the stiffening layer of the area occupied by holes may be smooth, as indicated for layer 612', or it may have more or less abrupt changes. For example, individual longitudinal lengths or sections having discretely different fractional hole areas may be used to make layer 612. The individual longitudinal lengths need not be joined to form a continuous tube but may be separated by gaps, the gaps being preferably small enough so as to enough so as to cause no noticeable effects at the exterior surface of layer 613 that could result in a decreased fusing performance or quality. Moreover, the minimum value of the area occupied by holes per unit length of the stiffening layer 612 may, if desired, extend for a suitable distance on either side of substantially the midpoint along the length of the sleeve 620. Additionally, the minimum value of the number of holes per unit area provided or formed in the stiffening layer may be zero, such that holes may be provided or formed only near each end of the stiffening layer 612. When outer compliant layer 613 is formed on the stiffening layer, the material of layer 613 may be made to penetrate and fill the holes. Alternatively, the holes in the stiffening layer may be filled by any suitable other material, preferably a compliant material, and this is preferably done before the outer compliant layer 613 is formed on the stiffening layer 612.

Figure 12:
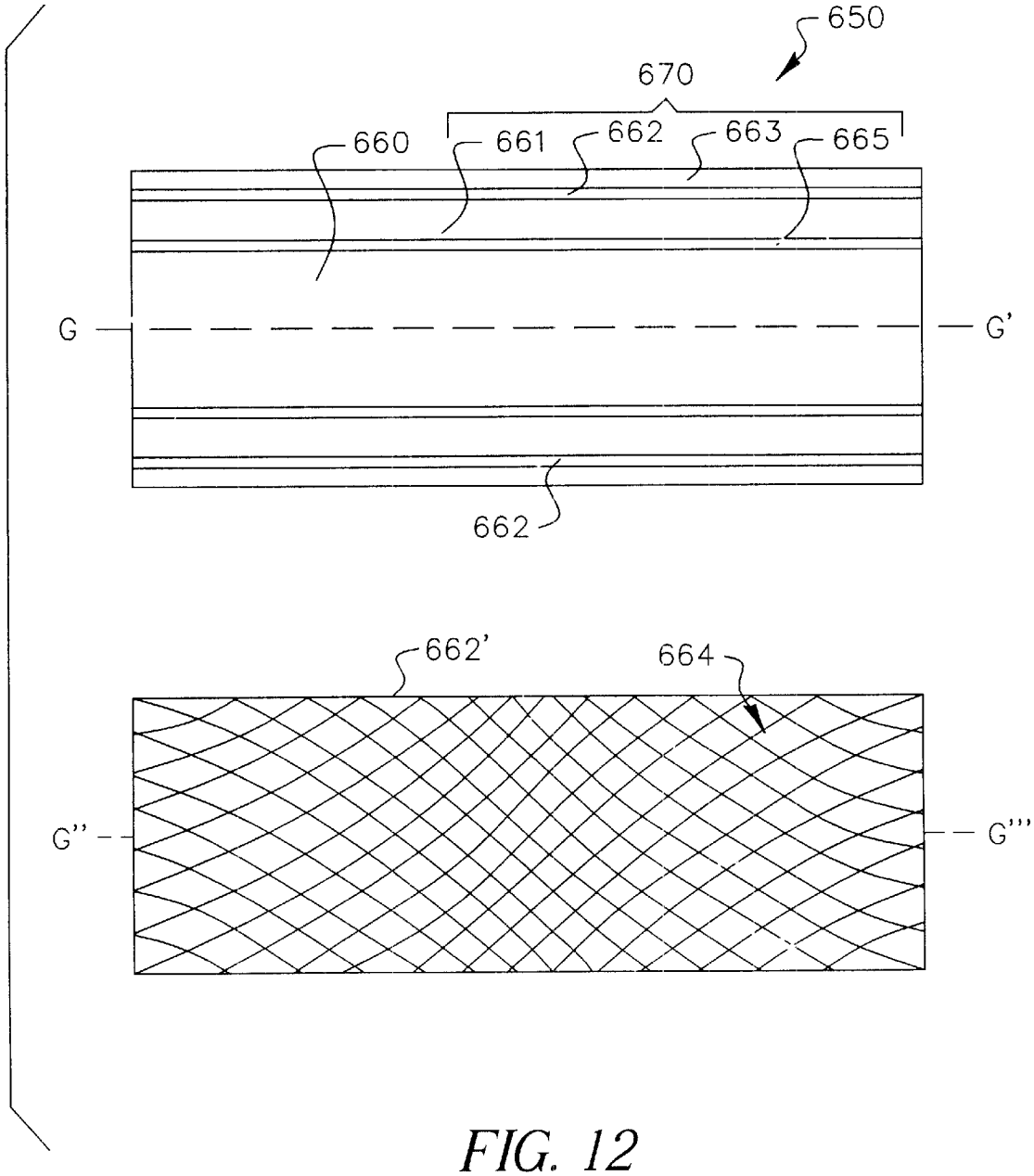
FIG. 12 shows a diagrammatic representation of a roller according to this invention, having a stiffening layer which includes a mesh or fabric in which the mesh density or fabric density is variable along the length of the roller.

In a further embodiment utilizing a sleeve member having a variably stiff stiffening layer included in a conformable roller of a fusing station according to the invention, the stiffening layer includes a mesh or fabric in which the mesh density or fabric density is systematically variable along the length of the sleeve parallel to the roller axis. The density is proportional to the number of threads or wires per unit area, i.e., a high density in a given area of the mesh or fabric means a comparatively large number of threads or wires passing in any given direction, including sets of threads or wires that cross each other. It is preferred that the mesh or fabric density be lowest near the ends of a sleeve included in an inventive roller, and highest substantially midway along the length of the sleeve. As a result, when the roller is engaged in the fusing nip, there will be an increased amount of overdrive provided by larger amount of strain in the stiffening layer near the edges of a paper sheet, as compared to the center of the paper, thereby providing a mechanism to ensure that all portions of the paper sheet spend substantially the same time passing through the nip. In this embodiment, the fabric or mesh may include natural or synthetic fibers, threads, metal wires or strips, or any other suitable preferably flexible material which can be woven into a fabric or mesh having a variable density. FIG. 12 shows a longitudinal cross section of a diagrammatic representation of an exemplary inventive cylindrically symmetric roller, indicated as 650, including a sleeve member 670. Roller 650 includes a rigid core member 660 having a substantially uniform outer diameter along the length of the roller, and the sleeve 670 includes a strengthening band 665, a compliant base cushion layer 661 formed on the strengthening band 665, a stiffening layer 662 surrounding and in intimate contact with the base cushion layer 661, the stiffening layer 662 including a mesh or fabric in which the mesh density or fabric density is systematically variable along the length of the sleeve 670 parallel to the roller axis of rotation indicated by G . . . G', and an outer compliant layer 663 on the stiffening layer 662. In the lower portion of FIG. 12, an embodiment of a stiffening layer indicated as 662' is depicted in a side view representation, wherein a woven fabric 664 is shown having a simple diagonal mesh, the mesh density varying, in a direction parallel to axis G" . . . G'", from a Minimum value at or near each end of the stiffening layer 662' towards a maximum value located at substantially the midpoint along the length of the stiffening layer (crossings of fibers are not shown in detail). For clarity, a greatly enlarged mesh 664 is indicated, although in practice a high mesh density is generally preferred. For a sleeve 670 included in an inventive fuser roller, it is preferred that diameters of the fibers, threads or wires of which the mesh is made be small enough to produce no measurable effect on fusing uniformity. Similarly, it is preferred for an inventive fuser roller that the interstices between the fibers, threads or wires of which the mesh is made be small enough to produce no measurable effect on fusing uniformity. It is to be understood that, in other useful embodiments of the stiffening layer 662 (not illustrated) the mesh or fabric may include any suitable weave, e.g., having a simple form of a warp and a woof, or including a more complex weave, with the threads or wires passing in any suitable directions, including directions parallel and perpendicular to the axis G . . . G'. The mesh may be made of one or more different kinds of fibers, or fibers of one or more different diameters. For example, the simple mesh of the fabric 664 may be considered to be made of a warp and a woof, with the warp and woof being optionally made of different materials, or having fibers or threads of different diameters. The longitudinal variation of the mesh density along the length of the stiffening layer may be smooth, as depicted for layer 662', or it may have more or less abrupt changes. For example, individual longitudinal lengths or sections having discretely different mesh densities may be used to make layer 662. The individual longitudinal lengths need not be joined to form a continuous tube but may be separated by gaps, the gaps being preferably small enough so as to cause no noticeable effects at the exterior surface of compliant layer 663 that could result in a decreased fusing performance or quality. Moreover, the maximum value of the mesh density of the stiffening layer 662 may, if desired, extend for a suitable distance on either side of substantially the midpoint along the length of the roller 650. When outer compliant layer 663 is formed on the stiffening layer, the material of layer 663 may be made to penetrate and fill the interstices of the mesh. Alternatively, the interstices of the mesh included in the stiffening layer may be filled by any suitable other material, preferably a compliant material, and this is preferably done before the outer compliant layer 663 is formed on the stiffening layer 662.

Figure 13:
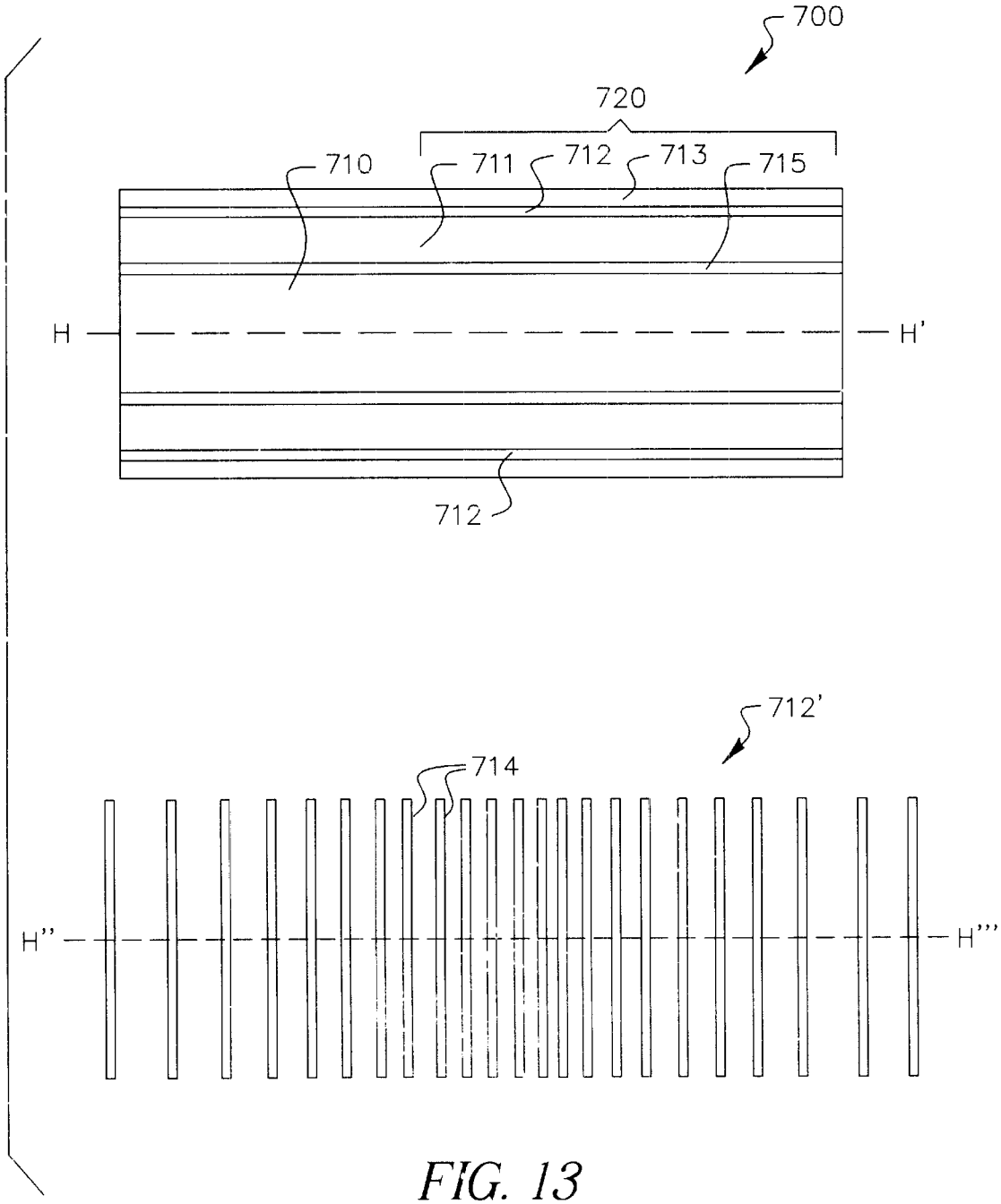
FIG. 13 shows a diagrammatic representation of a roller according to this invention, having a stiffening layer which includes a cordage in which the cordage density is variable along the length of the roller.

In yet another embodiment utilizing a sleeve member having a variably stiff stiffening layer included in a conformable roller of a fusing station according to the invention, the stiffening layer includes a cordage, and the variation of stiffness is produced by a systematic variation, as measured in the plane of the stiffening layer, of the density of the cordage, i.e., of the number of cords per unit length cutting a direction parallel to the axis of rotation of the roller. It is preferred that the cordage density be lowest near the ends of the sleeve member of an inventive roller, and highest substantially midway along the length of the sleeve. As a result, when the roller is engaged in the fusing nip, there will be an increased amount of overdrive provided by larger amount of strain in the stiffening layer near the edges of a paper sheet, as compared to the center of the paper, thereby providing a mechanism to ensure that all portions of the paper sheet spend substantially the same time passing through the nip. In this embodiment, the cordage may include natural or synthetic fibers, metal wires or strips, or any other suitable material, e.g., in the form of a wound filament which can for example be wound as a continuous strand around a compliant layer, or provided in ring form around the compliant layer as a set of rings having their centers substantially concentric with the axis of rotation of the roller. FIG. 13 shows a longitudinal cross section of a diagrammatic representation of an exemplary inventive cylindrically symmetric roller, indicated as 700, including a sleeve member 720. Roller 700 includes a rigid core member 710 having a substantially uniform outer diameter along the length of the roller, and the sleeve 720 includes a strengthening band 715, a compliant base cushion layer 711 formed on the strengthening band 715, a stiffening layer 712 surrounding and in intimate contact with the base cushion layer 711, the stiffening layer 712 including a cordage density variable in a direction parallel to the roller axis of rotation indicated by H . . . H', and an outer compliant layer 713 on the stiffening layer 712. For clarity of understanding, an embodiment of a stiffening layer 712' including a cordage is depicted in a side view representation in the lower portion of FIG. 13, with individual rings of cordage depicted edge on and labeled 714, the rings of cordage being centered on an axis H" . . . H'" and having a density varying, in a direction parallel to axis H" . . . H'", from a minimum value at or near each end of the stiffening layer 712' to a maximum value located at substantially the midpoint along the length of the stiffening layer. For clarity, a greatly reduced cordage density 714 is indicated in FIG. 13, although a generally high density of cordage is preferred. For an inventive fuser roller, it is preferred that diameters of the fibers, threads or wires of which the cordage is made be small enough to produce no measurable effect on fusing uniformity. Similarly, it is preferred for an inventive fuser roller that the cordage density is made high enough, and the interstices between the fibers, threads or wires of which the cordage is made be small enough, so as to produce no measurable effect on fusing uniformity. It is to be understood that, in other useful embodiments of the stiffening layer 712 (not illustrated) the cordage may include any suitable winding around the base cushion layer 711, in any suitable directions, and there may also be crossings of the windings, including more than one layer. The cordage may be made of one or more different kinds of fibers, threads or wires. Alternatively, the cordage may be made of interspersed fibers, threads or wires having one or more different diameters. The longitudinal variation of the cordage density along the length of the stiffening layer may be smooth, as shown for example by the cordage 712', or it may have more or less abrupt changes. For example, individual longitudinal lengths or sections having discretely different cordage densities, with the cordage in each of the lengths in the form of continuous windings, may be used to make layer 712. The individual longitudinal lengths need not be joined but may be separated by gaps, the gaps being preferably small enough so as to cause no noticeable effects at the exterior surface of compliant layer 713 that could result in a decreased fusing performance or quality. Moreover, the maximum value of the cordage density of the stiffening layer 712 may, if desired, extend for a suitable distance on either side of substantially the midpoint along the length of the sleeve 720. When outer compliant layer 713 is formed on the stiffening layer, the material of layer 713 may be made to penetrate and fill the interstices of tile cordage. Alternatively, the interstices of the cordage included in the stiffening layer may be filled by any suitable other material, preferably a compliant material, and this is preferably done before the outer compliant layer 713 is formed on the stiffening layer 712.

Figure 14:
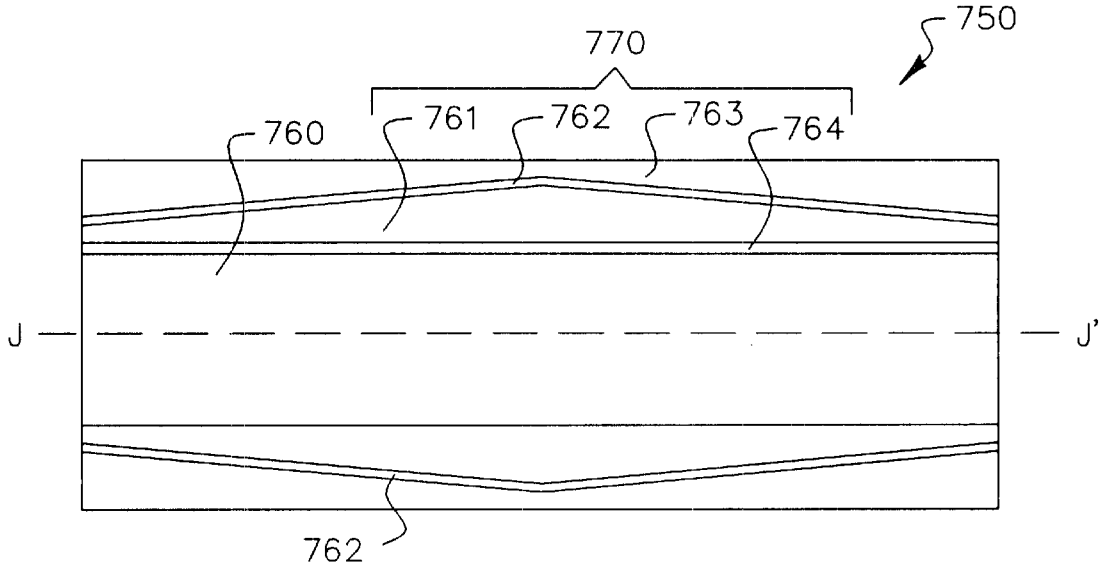
FIG. 14 shows a diagrammatic representation of a roller according to this invention, provided with a stiffening layer having a depth within the roller that varies in a direction parallel to the roller axis.

In an embodiment for providing a predetermined variation of overdrive along the length of a conformable roller of an inventive fusing station, the roller may be provided with a stiffening layer which is located at different depths along the length of the roller. It is preferred that the stiffening layer is located deepest near each end of the roller, and shallowest substantially midway along the length of the roller. As a result, when the roller is engaged in the fusing nip, there will be an increased amount of overdrive provided by larger amount of strain in the stiffening layer near the edges of a paper sheet, as compared to the center of the paper, thereby providing a mechanism to ensure that all portions of a paper sheet spend substantially the same time passing through the nip. FIG. 14 shows a longitudinal cross section of a diagrammatic representation of an exemplary inventive cylindrically symmetric roller, indicated as 750, including a sleeve member 770. Roller 750 includes a rigid core member 760 having a substantially uniform outer diameter along the length of the roller, and the sleeve 770 includes a strengthening band 764, a compliant base cushion layer 761 formed on the strengthening band 764, a stiffening layer 762 surrounding and in intimate contact with the base cushion layer 761 with the stiffening layer 762 having a depth which is variable in a direction parallel to an axis of rotation indicated by J . . . J', and an outer compliant layer 763 on the stiffening layer 762. Stiffening layer 762 is shown at a variable depth below the outer layer 763, the depth increasing from a minimum value at or near each end of the sleeve 770 towards a maximum value located at substantially the midpoint along the length of the sleeve 770. Preferably, a sum of the thicknesses of layers 761 and 763 is substantially constant along the entire length of the sleeve. For clarity of understanding in FIG. 14, the variation of depth of stiffening layer 762 has been greatly exaggerated along the entire length of the sleeve 770. The longitudinal variation of depth of stiffening layer 762 may be smooth from an end of the sleeve 770 to substantially the midpoint of the sleeve 770, as depicted in FIG. 14, or it may have more or less abrupt changes. For example, individual longitudinal lengths or sections having discretely different depths below the outer compliant layer 763 may be used to make layer 762. The individual longitudinal lengths need not be joined to form a continuous tube but may be in the form of individual tubes, made, e.g., of metal, having different diameters, the tubes being separated by gaps, the gaps being preferably small enough so as to cause no noticeable effects at the exterior surface of compliant layer 763 that could result in a decreased fusing performance or quality. Moreover, the maximum value of the depth of stiffening layer 762 may, if desired, extend for a suitable distance on either side of substantially the midpoint along the length of the sleeve 770. The stiffening layer 762 having a variable depth may also include a mesh or a cordage (not illustrated).

Figure 15:
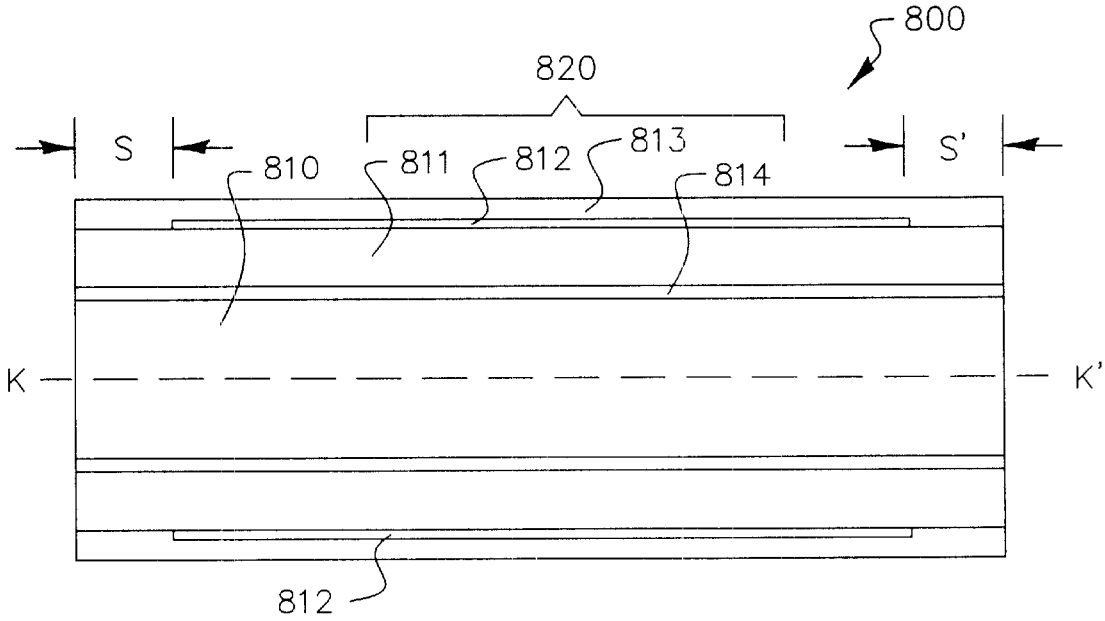
FIG. 15 shows a diagrammatic representation of a roller of an inventive fusing station, the roller including a stiffening layer which is shorter than the length of a receiver, as measured parallel to the fuser roller axis.

In a further embodiment for providing a predetermined variation of overdrive along the length of a conformable roller of an inventive fusing station, the roller includes a stiffening layer which is shorter than the length of a receiver, as measured parallel to the fuser roller axis. Each edge of a paper sheet passing through the fusing station is preferably located less than about 2 inches beyond a corresponding end of the stiffening layer, and more preferably, less than about 1.5 inches beyond a corresponding end of the stiffening layer. By providing the stiffening layer to be shorter than the length of the fuser roller that contacts the paper, the overdrive is increased in the areas near the edges of a paper sheet for which there is no stiffening layer, as compared to rest of the paper, thereby providing a mechanism to reduce wrinkling of a paper sheet passing through the nip. FIG. 15 shows a longitudinal cross section of a diagrammatic representation of an exemplary inventive cylindrically symmetric roller, indicated as 800, rotatable about an axis K . . . K'. Roller 800 includes a rigid core member 810 having a substantially uniform outer diameter along the length of the roller, and a sleeve member 820. The sleeve 820 includes a strengthening band 814, a compliant base cushion layer 811 formed on the strengthening band 814, a stiffening layer 812 surrounding and in intimate contact with the base cushion layer 811, and an outer compliant layer 813 on the stiffening layer 812. As indicated in FIG. 15, the stiffening layer 812 is shorter than the sleeve 820, so that portions of the base cushion layer 811 having indicated respective lengths s and s' located at each end of the outer surface of the base cushion layer are not covered by the stiffening layer 812. Preferably, the portions of the base cushion layer 811 not covered by the stiffening layer are of approximately equal length, and these portions are covered by the outer compliant layer 813. It is preferred that an outer diameter of roller 800 be uniformly the same along the length of the roller. As indicated in FIG. 15, this may be accomplished by making the portions of the outer compliant layer 813 correspondingly thicker where there is no underlying stiffening layer 812 on top of base cushion layer 811, the base cushion layer preferably having a diameter which is uniformly the same along the length of the roller 800. Alternatively, the outer diameter of roller 800 may be made uniformly the same along the length of the roller by having the base cushion layer correspondingly thicker where there is no stiffening layer (not illustrated).

Figure 16:
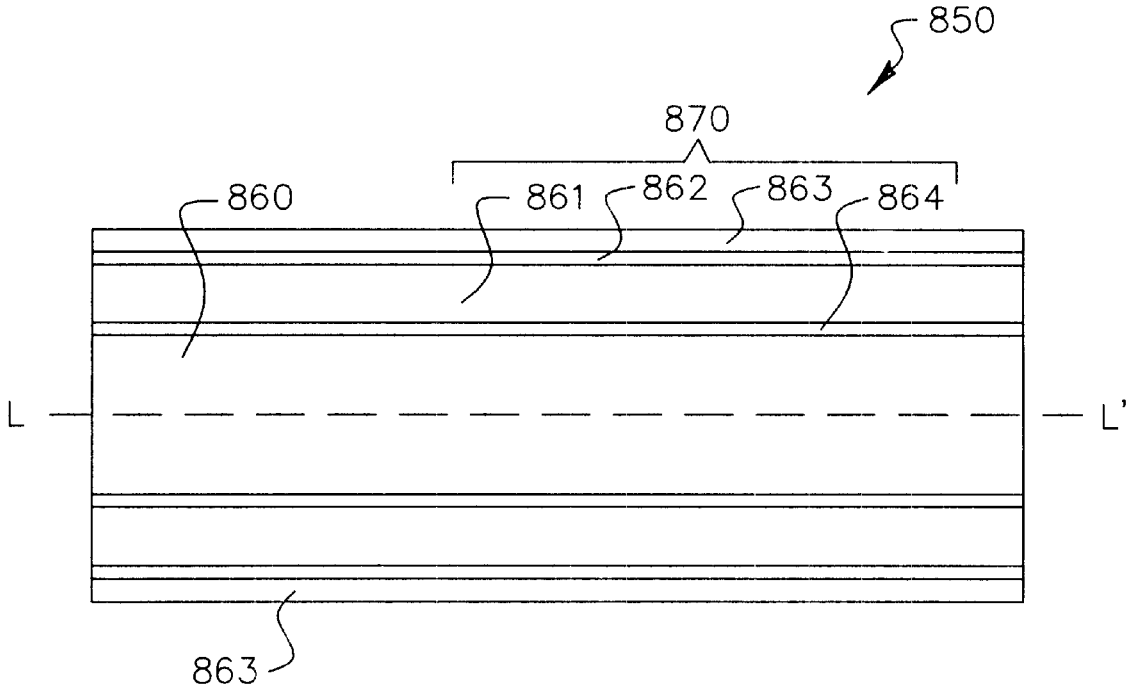
FIG. 16 shows a diagrammatic representation of a roller of an inventive fusing station, the roller having an outer diameter that varies along the length of the roller, the roller including an outer layer which is thicker towards the ends of the roller than it is at substantially the midpoint along the length of the roller.

In another additional embodiment for providing a predetermined variation of overdrive along the length of a conformable roller of an inventive fusing station, the compliant roller which includes a stiffening layer may be provided with an outside diameter which varies along a direction parallel to the roller axis. It is preferred, for an inventive roller, that a maximum of the outside diameter is located near each end of the roller and a minimum is located substantially midway along the length of the roller, increasing the overdrive near the edges of a paper sheet, as compared to the center of the paper, and thereby providing a mechanism to ensure that all portions of a paper sheet spend substantially the same time passing through the nip. FIG. 16 shows a longitudinal cross section of a diagrammatic representation of an exemplary inventive cylindrically symmetric roller, indicated as 850, having a profiled outer diameter and being rotatable about an axis L . . . L', roller 850 including a rigid cylindrical core member 860 having a substantially uniform outer diameter along the length of the roller, and a sleeve member 870. The sleeve 870 includes a strengthening band 864, a compliant base cushion layer 861 formed on the strengthening band 864, a stiffening layer 862 surrounding and in intimate contact with the base cushion layer 861, and a longitudinally profiled outer compliant layer 863 on the stiffening layer 862. Preferably, each of both the base cushion layer 861 and the stiffening layer 862 has a substantially uniform thickness along the length of the sleeve 870. The outer compliant layer 863 is thicker towards the ends of sleeve 870 than it is at substantially the midpoint along the length of the sleeve. It may be desirable in certain applications to vary the outer diameter of roller 850 by including a longitudinally profiled core member 860 (not illustrated) or a longitudinally profiled base cushion layer 861 (not illustrated) in order to provide a desired variation of outer diameter along the length of roller 850.

Figure 17A:
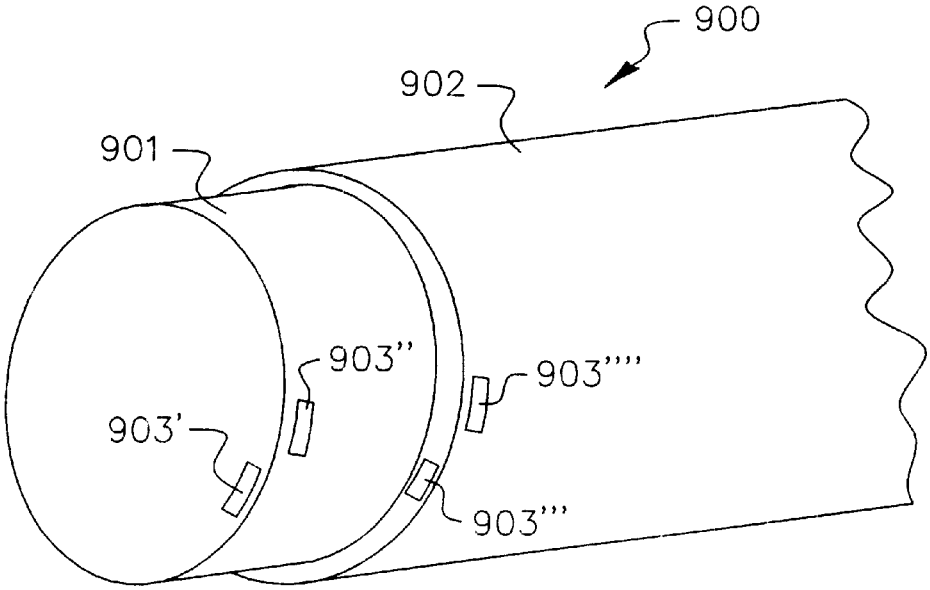
FIG. 17(*a*) is a diagrammatic representation of a partly assembled roller including a sleeve member according to the invention, wherein the core member has marked on it a descriptive indicia, machine readable, located on an outer surface of the core member in a small area located close to an end of the core member, and the sleeve member has marked on it a descriptive indicia, machine readable, located on the outer surface of the sleeve member in a small area located close to an end of the sleeve member, where for clarity of explanation the sleeve member is shown displaced a short distance with respect to its operational position on the core member in order to reveal a location for an indicia on an outside portion of the core member.
Figure 17B:
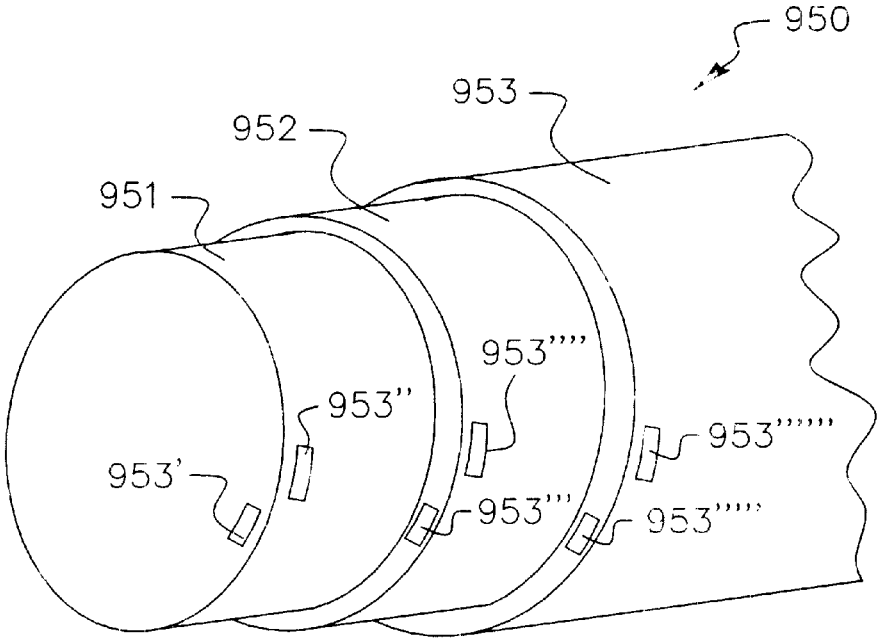
Figure 18:
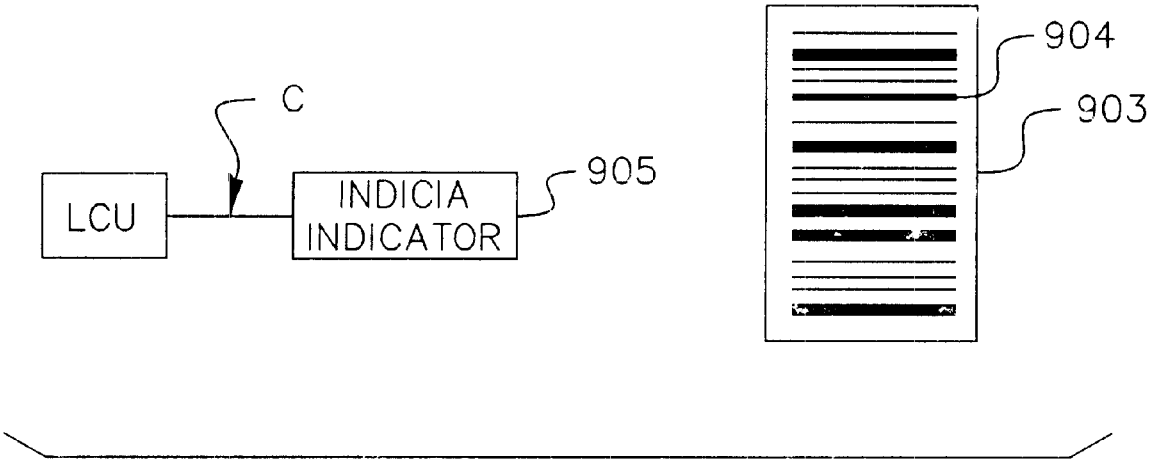
FIG. 18 is a diagrammatic representation of an indicia in the form of a bar code and its detection by an indicia indicator.

FIG. 17(*a*) is a sketch of a cutaway end portion of an assembly, indicated as 900, of a sleeve member 902 concentrically disposed about a core member 901 of an inventive conformable roller, where, for clarity of explanation, the sleeve 902 is shown displaced from its operational location by a short distance with respect to the core member 901. The assembly 900 is representative of a sleeved roller utilized in a fusing station of the invention, i.e., a sleeved fuser roller exemplified by rollers 20, 20', 20" and 80, or a sleeved pressure roller exemplified by rollers 50, 50' and 70. Core member 901 has marked on it descriptive indicia located on its outer surface in an area located close to an end of the core member, and the sleeve member 902 has marked on it descriptive indicia located on its outer surface in an area located close to an end of the sleeve. The indicia are provided on the sleeve 902 to indicate a parameter relative to the sleeve, and are also provided on the core member 901 to indicate a parameter relative to the core member. With reference to FIG. 17(*a*), entities shown therein that are similar to one another are identified with one or more primes (') after the reference numbers. The indicia on the core member 901, i.e., a set of descriptive markings, may be located in a preferably small area 903" located on a cylindrically curved portion of the core member 901 close to an end of the core member. More preferably, the indicia on the core member 901 are contained in a preferably small area 903' located on an end of core member 901 and close to the perimeter (the individual layers included in core member 901 are not shown). The indicia on the sleeve member 902, i.e., a set of descriptive markings, are preferably located in a small area 903"" located on a cylindrically curved portion of the sleeve member close to an end of the sleeve member. More preferably, the indicia on the sleeve member are contained in a small area 903'" located on an end of sleeve 902 (the individual layers included in sleeve 902 are not shown). FIG. 18 shows a diagrammatic representation of an area 903, an enlarged view of any of the areas 903', 903", 903'", or 903"", and illustrates that the descriptive indicia in area 903 may be in the form of a bar code, as indicated by the numeral 904, which may be read, for example, by a scanner. The scanner may be mounted in an electrophotographic machine so as to monitor an inventive roller, e.g., during operation of the machine or during a time when the machine is idle, or the scanner may be externally provided during installation of, or maintenance of, an inventive roller 900. Generally, the indicia may be read, sensed or detected by an indicia detector 905. As indicated in FIG. 18 by the line C, the analog or digital output of the indicia detector may be sent to a logic control unit (LCU) incorporated in an electrostatographic machine utilizing an inventive roller, or it may be processed externally, e.g., in a portable computer during the installation or servicing of an inventive roller, or it may be processed in any other suitable data processor. The indicia may be machine read optically, magnetically, or by means of radio frequency.

Moreover, indicia having characteristics similar to those described above and similarly detectable by an indicia detector may also be placed on an outer surface of an outer sleeve member of a double-sleeved fuser roller according to the invention. Thus, as illustrated diagrammatically in FIG. 17(*b*), a double-sleeved conformable roller of the invention 950 has a core member 951 surrounded by an inner sleeve member 952 and an outer sleeve member 953 concentrically disposed about sleeve 952. For clarity of explanation, each of the sleeve members is shown displaced from its operational location by a short distance with respect to the core member 951. Core member 951 and sleeve members 952 and 953 preferably have indicia located in a preferably small area near an end of each member, preferably on a cylindrically curved surface portion, e.g., in areas 953", 953"" or 953""", or more preferably on an end surface 953', 953'" or 953"". Areas 953', 953", 953'", 953"", 953""" and 953"" of roller 950 also correspond to area 903 of FIG. 18 and may be machine readable by an indicia indicator 905 in similar fashion to areas 903', 903", 903'" and 903"" of roller 900. The indicia on core 951, inner sleeve 952 and outer sleeve 953 have characteristics entirely similar to those on roller 900.

In addition to a bar code 904 in FIG. 18, the indicia may comprise any suitable markings, including symbols and ordinary words, and may be color-coded. The indicia may also be read visually or interpreted by eye. A color-coded indicia on a core member or on a sleeve member of inventive rollers 900 and 950 may include a relatively large colored area which may be otherwise devoid of markings or other features and which may readily be interpreted by eye to indicate a predetermined property of the color-coded indicia. A thermally induced change of the indicia may be used to monitor the life of an inventive roller 900 or 950, or alternatively, of a sleeve member or of a core member individually. For example, a color of an indicia could be chosen to have a thermally induced slow fade rate, or a thermally induced slow rate of change of an initial, e.g., as-manufactured, color, whereby a fading or otherwise thermally induced color change could be used as a measure of elapsed life or as a measure of remaining life of the roller. Such a color change may be monitored by eye. Preferably, the color change is measured by means of a reflected light beam, e.g., by using a densitomer or spectrophotometer, or any other suitable means of measuring the intensity or color of light reflected from the indicia, with the reflected optical information provided to a LCU or other computer. An indicia may also be utilized to measure the wear rate of a sleeve member, in particular of an outer sleeve member, of an inventive roller 900 or 950, e.g., by providing a portion of the indicia having a predetermined wear rate. The wear rate of an indicia may be measured optically, e.g., by monitoring the reflection optical density of a portion of the indicia which may be subject to wear, or by other suitable means. Suitable materials for the indicia are for example inks, paints, magnetic materials, reflective materials, and the like, which may be applied directly to the surface of the sleeve member. Alternatively, the indicia may be located on a label that is adhered to the outer surface of a core member or sleeve member. The indicia may also be in raised form or produced by stamping with a die or by otherwise deforming a preferably small local area on the outer surface of a core member or sleeve member, and the deformations may be sensed mechanically or otherwise detected or read using an indicia detector 905 in the form of a contacting probe or by other mechanical means. It may also be desirable for some applications to place an indicia on an inner surface of a sleeve member, e.g., sleeves 902, 952 or 953. It may also be desirable to provide a cutaway or an opening (not illustrated) in a sleeve member 902 so that an indicia located in an area 903" on core member 901 may be detected when the sleeve is located in operational position, and not displaced as shown in FIG. 17(*a*). Although the indicial areas 903" and 903'" are shown as lined up on top of one another in FIG. 17(*a*), this is not necessarily the case and the sleeve 902 may be rotated arbitrarily with respect to the core member 901. Similarly, it may also be desirable to provide a cutaway or an opening (not illustrated) in a sleeve member 952 or 953 so that an indicia located in an area 953" on core member 901 or in an area 953'" on inner sleeve member 952 may be detected when both sleeves 952 and 953 are located in operational position, and not displaced as shown in FIG. 17(*b*). Although the indicial areas 953", 953'" and 953"" are shown as lined up on top of one another in FIG. 17(*b*), this is not necessarily the case, and the sleeves 952 and 953 may be rotated arbitrarily with respect to one another and with respect to the core member 951.

Indicia having characteristics similar to those described above and similarly detectable by an indicia detector may also be placed on a hard fuser roller according to the invention, or on a hard pressure roller according to the invention. The indicia are preferably placed in similar fashion, i.e., close to an end of a hard fuser roller or a hard pressure roller, and located either on a cylindrically curved surface portion or on an end surface (indicia located on a hard fuser roller or a pressure roller are not illustrated).

Different types of information may be encoded or recorded in the indicia on the core member and on the sleeve member. For example, the outside diameter of a roller, i.e., the outside diameter of sleeve member 902 or 953 may be recorded so that nip width can be accordingly adjusted. The effective hardness and effective Young's modulus of a sleeve or core member of an inventive roller may be recorded in the indicia so that nip widths may be suitably adjusted. Similarly, specific information concerning individual layers of a roller, including the layers of a sleeve, may be provided in the indicia. The date of manufacture of a sleeve or a core member may be recorded in the indicia for diagnostic purposes, so that the end of useful life of the given sleeve or core member could be estimated for timely replacement. Specific information for each given roller regarding the runout as measured after manufacture, e.g., the core runout or runout of a sleeve member, may also be recorded in the indicia.

It will be evident that the indicia according to the invention are distinguished from information stored electronically as described by M. E. Beard et al., in U.S. Pat. No. 6,016,409, which discloses a module that includes an electronically-readable memory whereby the control system of the printing apparatus reads out codes from the electronically readable memory. According to the present invention, an indicia comprises a physical alteration of a surface of a sleeve member or a core member, e.g., of a roller 900 or a roller 950, and does not comprise electronic information as such, even though after detection by the indicia detector 905 the detected information may be subsequently converted to electronic form, e.g., in a computer.

It is preferred to provide an indicia on sleeved rollers 20, 20', 20", 50, 50', 70, 80, 500, 550, 600, 650, 700, 750, 800 and 850, according to the manner described above for an inventive fuser roller 900. The indicia may be provided on an outer surface of a sleeve member, e.g., sleeves 26, 26', 26", 56, 56', 76, 86, 96, 97, 450 and 470, according to the manner described above for sleeves 902, 952 and 953, or indicia may be provided on an outer surface of a core member of an inventive sleeved roller. The indicia may also be provided on an inner surface of a sleeve member (not illustrated). When an indicia is provided on a core member, it may also be useful to provide an opening or cutaway in an inventive sleeve member (not illustrated) to allow the indicia on the core member to be detected with the sleeve member in operational position on the core member. In the case of a double-sleeved roller, an opening or cutaway in an outer sleeve member may be provided to allow an indicia on an inner sleeve member to be detected with both sleeve members in operational position on the core member (not illustrated). It is further preferred to provide an indicia on an outer surface of a hard roller such as rollers 30, 30', and 60 used in a fusing station of the invention, preferably on a cylindrically curved portion near to an end of the hard roller and more preferably on an end portion near the rim.

In the above-disclosed sleeved roller embodiments, it is preferred to remove or replace a sleeve while keeping the core member attached to a frame portion of a fusing station of an electrostatographic machine, thereby reducing the risk of damage to the core member and also avoiding the need to remove bulky and heavy rollers from a machine in order to change a sleeve. For example, a sleeve, e.g., sleeve 902 can be slid off or on the core member, e.g., core member 901 from one end of the core which is temporarily detached from the frame, while the other end of the core remains attached to the frame. Or, an outer sleeve, e.g., sleeve 953 can be slid off or on an inner sleeve, e.g., sleeve 952 while one of the ends of the core, e.g., core 951 remains attached to the frame. Alternatively, both an inner sleeve and an outer sleeve, e.g., sleeves 952 and 953, may be mounted or demounted from a core member, e.g., core 951, simultaneously. It is preferred to use the compressed air assist method to effect removal or replacement of a sleeve from a fuser roller or from a pressure roller.

The invention has been described in detail with particular reference to certain preferred embodiments thereof, but it will be understood that variations and modifications can be effected within the spirit and scope of the invention.

In accordance with the above, and in the following numbered paragraphs below, it is apparent that the inventors have described:

¶1. A conformable roller, for use in a fusing station of an electrostatographic machine, including a substantially rigid cylindrical core member and a replaceable removable sleeve member in non-adhesive intimate contact with and surrounding the core member, the sleeve member including;

a strengthening band;

a base cushion layer formed on the strengthening band;

a stiffening layer in intimate contact with and surrounding the base cushion layer;

a compliant release layer coated on the stiffening layer;

wherein the fusing station is provided with an externally heated fuser roller.

¶2. A conformable externally heated toner fuser roller, for use in a fusing station of an electrostatographic machine, including a substantially rigid cylindrical core member and a replaceable removable sleeve member in non-adhesive intimate contact with and surrounding the core member, the sleeve member including;

a strengthening band;

a base cushion layer formed on the strengthening band;

a stiffening layer in intimate contact with and surrounding the base cushion layer;

a compliant release layer coated on the stiffening layer;

a heat source for heating the roller which is external to he roller.

¶3. A conformable externally heated toner fuser roller, for use in a fusing station of an electrostatographic machine, including a substantially rigid cylindrical core member and a replaceable removable sleeve member in non-adhesive intimate contact with and surrounding the core member, the sleeve member including;

a strengthening band;

a base cushion layer formed on the strengthening band;

a barrier layer in intimate contact with and surrounding the base cushion layer;

a compliant release layer coated on the barrier layer;

a heat source for heating the roller which is external to the roller.

¶4. A conformable pressure roller, for use in a fusing station of an electrostatographic machine, including a substantially rigid cylindrical core member and a replaceable removable sleeve member in non-adhesive intimate contact with and surrounding the core member, the sleeve member including;

a strengthening band;

a base cushion layer formed on the strengthening band;

a stiffening layer in intimate contact with and surrounding the base cushion layer;

an optional compliant release layer coated on the stiffening layer;

wherein the fusing station is provided with an externally heated fuser roller.

¶5. The roller according to Paragraph 1 wherein the base cushion layer of the sleeve member includes a poly (dimethylsiloxane) elastomer.

¶6. The roller according to Paragraph 1 wherein the base cushion layer of the sleeve includes a fluoroelastomer or an EPDM rubber.

¶7. The roller according to Paragraph 1 wherein the base cushion layer of the sleeve has a thickness in a range of 0.25 mm to 25 mm.

¶8. The roller according to Paragraph 7 wherein the base cushion layer has a thickness in a range of 1.25 mm to 12.5 mm.

¶9A. The toner fuser roller according to Paragraph 2 wherein the base cushion layer of the sleeve has a thermal conductivity less than 0.4 BTU/hr/ft/° F.

¶9B. The toner fuser roller according to Paragraph 3 wherein the base cushion layer of the sleeve has a thermal conductivity less than 0.4 BTU/hr/ft/° F.

¶10A. The toner fuser roller according to Paragraph 9A wherein the base cushion layer has a thermal conductivity in a range of 0.1 BTU/hr/ft/° F.–0.3 BTU/hr/ft/° F.

¶10B. The toner fuser roller according to Paragraph 9B wherein the base cushion layer has a thermal conductivity in a range of 0.1 BTU/hr/ft/° F.–0.3 BTU/hr/ft/° F.

¶11. The roller according to Paragraph 1 wherein the base cushion layer of the sleeve has a Young's modulus in a range of 0.05 MPa–10 MPa.

¶12. The roller according to Paragraph 11 wherein the base cushion layer has a Young's modulus in a range of 0.1 MPa–1 MPa.

¶13A. The toner fuser roller according to Paragraph 2 wherein the base cushion layer of the sleeve further includes a particulate filler.

¶13B. The toner fuser roller according to Paragraph 3 wherein the base cushion layer of the sleeve further includes a particulate filler.

¶14A.The toner fuser roller according to Paragraph 13A wherein the particulate filler in the base cushion layer is selected from the group consisting of chromium(III) oxide, aluminum oxide, iron oxide, calcium oxide, magnesium oxide, nickel oxide, tin oxide, zinc oxide, copper oxide, titanium oxide, silicon oxide and mixtures thereof.

¶14B. The toner fuser roller according to Paragraph 13B wherein the particulate filler in the base cushion layer is selected from the group consisting of chromium(III) oxide, aluminum oxide, iron oxide, calcium oxide, magnesium oxide, nickel oxide, tin oxide, zinc oxide, copper oxide, titanium oxide, silicon oxide and mixtures thereof.

¶15A. The toner fuser roller according to Paragraph 13A wherein said particulate filler occupies 3 to 30 volume percent of said base cushion layer.

¶15B. The toner fuser roller according to Paragraph 13B wherein said particulate filler occupies 3 to 30 volume percent of said base cushion layer.

¶16A.The toner fuser roller according to Paragraph 15A wherein the filler occupies 5 to 20 volume percent of said base cushion layer.

¶16B. The toner fuser roller according to Paragraph 15B wherein the filler occupies 5 to 20 volume percent of said base cushion layer.

¶17A. The toner fuser roller according to Paragraph 13A wherein said particulate filler includes particles having a mean diameter in a range of 0.1 micrometer–100 micrometers.

¶17B. The toner fuser roller according to Paragraph 13B wherein said particulate filler includes particles having a mean diameter in a range of 0.1 micrometer–100 micrometers.

¶18A.The toner fuser roller according to Paragraph 17A wherein the filler includes particles having a mean diameter in a range of 0.5 micrometer–40 micrometers.

¶18B. The toner fuser roller according to Paragraph 17B wherein the filler includes particles having a mean diameter in a range of 0.5 micrometer–40 micrometers.

¶19. The roller according to Paragraph 1 wherein said stiffening layer has the form of a seamless endless belt or tube.

¶20. The roller according to Paragraph 1 wherein said stiffening layer has a thickness less than about 500 micrometers.

¶21. The roller according to Paragraph 20 wherein said stiffening layer has a thickness in a range of 75 micrometers–250 micrometers.

¶22. The roller according to Paragraph 1 wherein said stiffening layer has a Young's modulus in a range of 0.1 GPa–500 GPa.

¶23. The roller according to Paragraph 22 wherein said stiffening layer has a Young's modulus in a range of 10 GPa–350 GPa.

¶24. The roller according to Paragraph 1 wherein said stiffening layer is selected from one or more metals of a group consisting of nickel, copper, gold, and steel.

¶25. The roller according to Paragraph 24 wherein the stiffening layer is made of nickel.

¶26. The roller according to Paragraph 1 wherein said compliant release layer includes a fluoroelastomer or a silicone rubber.

¶27. The roller according to Paragraph 1 wherein said compliant release layer has a thickness less than 1 millimeter.

¶28. The roller according to Paragraph 27 wherein said compliant release layer has a thickness in a range of 25 micrometers to 250 micrometers.

¶29A. The toner fuser roller according to Paragraph 2 wherein the compliant release layer has a thermal conductivity in a range of 0.2 BTU/hr/ft/° F.–0.5 BTU/hr/ft/° F.

¶29B. The toner fuser roller according to Paragraph 3 wherein the compliant release layer has a thermal conductivity in a range of 0.2 BTU/hr/ft/° F.–0.5 BTU/hr/ft/° F.

¶30. The roller according to Paragraph 1 wherein said compliant release layer has a Young's modulus in a range of 0.05 MPa–10 MPa.

¶31. The roller according to Paragraph 30 wherein said compliant release layer has a Young's modulus in a range of 0.1 MPa–1 MPa.

¶32. The roller according to Paragraph 1 wherein said compliant release layer further includes a particulate filler.

¶33. The roller according to Paragraph 32 wherein said particulate filler in the release layer is selected from the group consisting of aluminum oxide, iron oxide, calcium oxide, magnesium oxide, nickel oxide, tin oxide, zinc oxide, copper oxide, titanium oxide, silicon oxide, graphite, and mixtures thereof.

¶34. The roller according to Paragraph 33 wherein said particulate filler in said release layer is zinc oxide.

¶35. The roller according to Paragraph 32 wherein said particulate filler occupies 5 to 50 volume percent of said release layer.

¶36. The roller according to Paragraph 35 wherein the filler occupies 10 to 35 volume percent of said release layer.

¶37. The toner fuser roller of Paragraph 2 further including an elastomeric barrier layer coated on the stiffening layer.

¶38. The toner fuser roller of Paragraph 37 wherein the barrier layer includes a fluoroelastomer plus 20 to 40 volume percent of a particulate filler, wherein the fluoroelastomer is preferably a random copolymer formed from mixtures of monomer units selected from vinylidene fluoride, tetrafluoroethylene, and hexafluoropropylene, and the filler includes aluminum oxide, iron oxide, calcium oxide, magnesium oxide, nickel oxide, tin oxide, and mixtures thereof.

¶39. The toner fuser roller of Paragraph 3 wherein the barrier layer includes a fluoroelastomer plus 20 to 40 volume percent of a particulate filler, wherein the fluoroelastomer is preferably a random copolymer formed from mixtures of monomer units selected from vinylidene fluoride, tetrafluoroethylene, and hexafluoropropylene, and the filler includes aluminum oxide, iron oxide, calcium oxide, magnesium oxide, nickel oxide, tin oxide, and mixtures thereof.

¶40. The toner fuser roller of Paragraph 37 wherein the barrier layer has a thickness in a range of 10 micrometers to 50 micrometers.

¶41. The toner fuser roller of Paragraph 3 wherein said barrier layer has a thickness in a range of 10 to 50 micrometers.

¶42. The roller of Paragraph 1 wherein the base cushion layer has a Poisson's ratio between 0.2 and 0.5.

¶43. The roller of Paragraph 42 wherein the base cushion layer has a Poisson's ratio between 0.45 and 0.5.

¶44. The roller of Paragraph 1 wherein the compliant release layer has a Poisson's ratio between 0.4 and 0.5.

¶45. The roller of Paragraph 44 wherein the compliant release layer has a Poisson's ratio between 0.45 and 0.5.

¶46. The roller according to Paragraph 1 wherein the strengthening band has the form of a seamless endless belt or tube.

¶47. The roller according to Paragraph 1 wherein the strengthening band has a Young's modulus in a range 100 MPa–500 GPa.

¶48. The roller according to Paragraph 47 wherein the strengthening band has a Young's modulus in a range 10 GPa–300 GPa.

¶49. The roller according to Paragraph 1 wherein the strengthening band has a thickness in a range 20 micrometers–500 micrometers.

¶50. The roller according to Paragraph 49 wherein the strengthening band has a thickness in a range 40 micrometers–100 micrometers.

¶51. A simplex fusing station of an electrostatographic machine, including:

a rotating externally heated compliant fuser roller;

a counter-rotating hard pressure roller engaged to form a fusing nip with the compliant fuser roller;

wherein the compliant fuser roller further includes a replaceable removable sleeve member surrounding and in intimate contact with a rigid cylindrical core member, the sleeve member including a strengthening band having a Young's modulus in a range of 0.1 GPa to 500 GPa, a base cushion layer formed on the strengthening band, a stiffening layer surrounding and in intimate contact with the base cushion layer, the stiffening layer having a Young's modulus in a range of 0.1 GPa to 500 GPa and having a thickness less than 500 micrometers, and an outer release layer coated on the stiffening layer.

¶52. A simplex fusing station of an electrostatographic machine, including:

a rotating externally heated compliant fuser roller;

a counter-rotating hard pressure roller engaged to form a fusing nip with the compliant fuser roller;

wherein the compliant fuser roller further includes a replaceable removable sleeve member surrounding and in intimate contact with a rigid cylindrical core member, the sleeve member including a strengthening band having a Young's modulus in a range of 0.1 GPa to 500 GPa, a base cushion layer formed on the strengthening band, a thin flexible barrier layer coated on the base cushion layer, and an outer release layer coated on the barrier layer.

¶53. A simplex fusing station of an electrostatographic machine, including:

a rotating externally heated compliant fuser roller;

a counter-rotating compliant pressure roller engaged to form a fusing nip with the compliant fuser roller;

wherein the compliant fuser roller further includes a replaceable removable sleeve member surrounding and in intimate contact with a rigid cylindrical core member, the sleeve member including a strengthening band having a Young's modulus in a range of 0.1 GPa to 500 GPa, a base cushion layer formed on the strengthening band, a stiffening layer surrounding and in intimate contact with the base cushion layer, the stiffening layer having a Young's modulus in a range of 0.1 GPa to 500 GPa and having a thickness less than 500 micrometers, and an outer release layer coated on the stiffening layer; and wherein also the compliant pressure roller further includes a replaceable removable sleeve member surrounding and in intimate contact with a rigid cylindrical core member, the sleeve member including a strengthening band having a Young's modulus in a range of 0.1 GPa to 500 GPa, a base cushion layer formed on the strengthening band, a stiffening layer surrounding and in intimate contact with the base cushion layer, the stiffening layer having a Young's modulus in a range of 0.1 GPa to 500 GPa and having a thickness less than 500 micrometers, and an outer layer coated on the stiffening layer.

¶54. A simplex fusing station of an electrostatographic machine, including:

a rotating compliant pressure roller;

a counter-rotating externally heated hard fuser roller engaged to form a fusing nip with the compliant pressure roller;

wherein the compliant pressure roller further includes a replaceable removable sleeve member surrounding and in intimate contact with a rigid cylindrical core member, the sleeve member including a strengthening band having a Young's modulus in a range of 0.1 GPa to 500 GPa, a base cushion layer formed on the strengthening band, a stiffening layer surrounding and in intimate contact with the base cushion layer, the stiffening layer having a Young's modulus in a range of 0.1 GPa to 500 GPa and having a thickness less than 500 micrometers, and an optional outer layer coated on the stiffening layer.

¶55A. The simplex fusing station according to Paragraph 51 wherein the strengthening band is in the form of a seamless endless belt.

¶55B. The simplex fusing station according to Paragraph 52 wherein the strengthening band is in the form of a seamless endless belt.

¶55C. The simplex fusing station according to Paragraph 53 wherein the strengthening band is in the form of a seamless endless belt.

¶55D. The simplex fusing station according to Paragraph 54 wherein the strengthening band is in the form of a seamless endless belt.

¶56A. The simplex fusing station according to Paragraph 51 wherein the stiffening layer is in the form of a seamless endless belt.

¶56B. The simplex fusing station according to Paragraph 53 wherein the stiffening layer is in the form of a seamless endless belt.

¶56C. The simplex fusing station according to Paragraph 54 wherein the stiffening layer is in the form of a seamless endless belt.

¶57. A duplex fusing station of an electrostatographic machine, including:

a rotating first fuser roller;

a counter-rotating second fuser roller engaged to form a pressure fusing nip with the first fuser roller;

wherein both or either of the first and second fuser rollers further includes a replaceable removable sleeve member surrounding and in intimate contact with a rigid cylindrical core member, the sleeve member including a strengthening band having a Young's modulus in a range of 0.1 GPa to 500 GPa, a base cushion layer formed on the strengthening band, a stiffening layer in intimate contact with the base cushion layer, the stiffening layer having a Young's modulus in a range of 0.1 GPa to 500 GPa and having a thickness less than 500 micrometers, and an outer release layer surrounding the stiffening layer; and wherein also both or either of the first and second fuser rollers is heated by an external source of heat.

¶58. A toner fusing method, for use in an electrostatographic machine, including:

forming a fusing nip by engaging a rotating externally heated compliant fuser roller and a counter-rotating hard pressure roller, one of the rollers being a driven roller and the other frictionally driven by pressure contact in the nip;

providing one or more heating rollers contacting and thereby heating the fuser roller;

forming an unfused toner image on a surface of a receiver sheet;

feeding the leading edge of the receiver into the nip and allowing the unfused toner image on the receiver sheet to pass through the fusing nip with the unfused toner image facing the fuser roller;

wherein the externally heated fuser roller further includes a replaceable removable sleeve member surrounding and in intimate contact with a rigid cylindrical core member, the sleeve member including a strengthening band, a compliant base cushion layer formed on the strengthening band, a stiffening layer in intimate contact with and surrounding the base cushion layer, and an outer layer coated on the stiffening layer.

¶59. The toner fusing method of Paragraph 58 wherein:

the strengthening band of the sleeve member has a Young's modulus in a range 100 MPa–500 GPa and a thickness in a range 20 micrometers–500 micrometers;

the compliant base cushion layer of the sleeve member includes an elastomer and contains 3 to 30 volume percent of a particulate filler having a particle size in a range of 0.1 micrometer to 100 micrometers, the base cushion layer further including a thickness in a range of 0.25 mm to 25 mm, a thermal conductivity in a range of 0.08 to 0.3 BTU/hr/ft/° F., and a Young's modulus in a range of 0.05 MPa to 10 MPa;

the stiffening layer of the sleeve member includes a flexible material having a thickness less than about 500 micrometers and a Young's modulus in a range of 0.1 GPa to 500 GPa ; and the outer layer of the sleeve member includes an elastomer and contains 5 to 50 volume percent of a particulate filler having a particle size in a range of 0.1 micrometer to 100 micrometers, the outer layer further including a thickness less than about 1 millimeter, a thermal conductivity in a range of 0.2 BTU/hr/ft/° F. to 0.5 BTU/hr/ft/° F., a Poisson's ratio between 0.4 and 0.5, and a Young's modulus in a range of 0.05 MPa to 10 MPa.

¶60. The toner fusing method according to Paragraph 58 wherein said outer layer includes a fluoroelastomer or a silicone rubber.

¶61. The toner fusing method according to Paragraph 58 wherein said compliant base cushion layer includes a poly (dimethylsiloxane) elastomer, a fluoroelastomer, or an EPDM rubber.

¶62. The toner fusing method according to Paragraph 58 wherein said stiffening layer is made of nickel.

¶63. A toner fusing method, for use in an electrostatographic machine, including:

forming a fusing nip by engaging a rotating externally heated hard fuser roller and a counter-rotating compliant pressure roller, one of the rollers being a driven roller and the other frictionally driven by pressure contact in the nip;

providing one or more heating rollers contacting and thereby heating the fuser roller;

forming an unfused toner image on a surface of a receiver sheet;

feeding the leading edge of the receiver into the nip and allowing the unfused toner image on the receiver sheet to pass through the fusing nip with the unfused toner image facing the fuser roller;

wherein the compliant pressure roller further includes a replaceable removable sleeve member surrounding and in intimate contact with a rigid cylindrical core member, the sleeve member including a strengthening band, a compliant base cushion layer formed on the strengthening band, and a stiffening layer in intimate contact with and surrounding the base cushion layer.

¶64. The toner fusing method of Paragraph 63 wherein:

the strengthening band of the sleeve member of the pressure roller has a Young's modulus in a range 100 MPa–500 GPa and a thickness in a range 20 micrometers–500 micrometers;

the compliant base cushion layer of the sleeve member of the pressure roller includes an elastomer having a thickness in a range of 0.25 mm to 25 mm and a Young's modulus in a range of 0.05 MPa to 10 MPa; and, the stiffening layer of the sleeve member of the pressure roller includes a flexible material having a thickness less than about 500 micrometers and a Young's modulus in a range of 0.1 GPa to 500 GPa.

¶65. The toner fusing method according to Paragraph 63 wherein said compliant base cushion layer includes a poly (dimethylsiloxane) elastomer, a fluoroelastomer or an EPDM rubber.

¶66. The toner fusing method according to Paragraph 63 wherein said stiffening layer is made of nickel.

¶67. The toner fusing method according to Paragraph 63 wherein the sleeve member of the pressure roller further includes an optional outer layer coated on the stiffening layer, the outer layer including an elastomer having a thickness less than about 1 millimeter, and having a Poisson's ratio between 0.4 and 0.5 and a Young's modulus in a range of 0.05 MPa–10 MPa.

¶68A.The fusing station of Paragraph 53 wherein the base cushion layer of the pressure roller has a Poisson's ratio in a range from 0.2 to 0.5.

¶68B. The fusing station of Paragraph 54 wherein the base cushion layer of the pressure roller has a Poisson's ratio in a range from 0.2 to 0.5.

¶69A. The fusing station of Paragraph 68A wherein the base cushion layer of the pressure roller has a Poisson's ratio in a range from 0.45 to 0.5.

¶69B. The fusing station of Paragraph 68B wherein the base cushion layer of the pressure roller has a Poisson's ratio in a range from 0.45 to 0.5.

¶70A. The fusing station of Paragraph 51 wherein the base cushion layer of the fuser roller has a Poisson's ratio in a range from 0.2 to 0.5.

¶70B. The fusing station of Paragraph 52 wherein the base cushion layer of the fuser roller has a Poisson's ratio in a range from 0.2 to 0.5.

¶70C. The fusing station of Paragraph 53 wherein the base cushion layer of the fuser roller has a Poisson's ratio in a range from 0.2 to 0.5.

¶70D. The fusing station of Paragraph 57 wherein the base cushion layer of the fuser roller has a Poisson's ratio in a range from 0.2 to 0.5.

¶71A.The fusing station of Paragraph 70A wherein the base cushion layer of the fuser roller has a Poisson's ratio in a range from 0.45 to 0.5.

¶71B. The fusing station of Paragraph 70B wherein the base cushion layer of the fuser roller has a Poisson's ratio in a range from 0.45 to 0.5.

¶71C. The fusing station of Paragraph 70C wherein the base cushion layer of the fuser roller has a Poisson's ratio in a range from 0.45 to 0.5.

¶71D.The fusing station of Paragraph 70D wherein the base cushion layer of the fuser roller has a Poisson's ratio in a range from 0.45 to 0.5.

¶72A. The fusing station of Paragraph 51 wherein the Poisson's ratio of the outer layer is between 0.4 and 0.5.

¶72B. The fusing station of Paragraph 52 wherein the Poisson's ratio of the outer layer is between 0.4 and 0.5.

¶72C. The fusing station of Paragraph 53 wherein the Poisson's ratio of the outer layer is between 0.4 and 0.5.

¶72D. The fusing station of Paragraph 54 wherein the Poisson's ratio of the outer layer is between 0.4 and 0.5.

¶72E. The fusing station of Paragraph 57 wherein the Poisson's ratio of the outer layer is between 0.4 and 0.5.

¶73A. The fusing station of Paragraph 72A wherein the Poisson's ratio of the outer layer is between 0.45 and 0.5.

¶73B. The fusing station of Paragraph 72B wherein the Poisson's ratio of the outer layer is between 0.45 and 0.5.

¶73C. The fusing station of Paragraph 72C wherein the Poisson's ratio of the outer layer is between 0.45 and 0.5.

¶73D. The fusing station of Paragraph 72D wherein the Poisson's ratio of the outer layer is between 0.45 and 0.5.

¶73E. The fusing station of Paragraph 72E wherein the Poisson's ratio of the outer layer is between 0.45 and 0.5.

¶74A. The toner fusing method of Paragraph 58 wherein the base cushion layer has a Poisson's ratio in a range from 0.2 to 0.5.

¶74B. The toner fusing method of Paragraph 63 wherein the base cushion layer has a Poisson's ratio in a range from 0.2 to 0.5.

¶75A. The toner fusing method of Paragraph 74A wherein the base cushion layer has a Poisson's ratio in a range from 0.45 to 0.5.

¶75B. The toner fusing method of Paragraph 74B wherein the base cushion layer has a Poisson's ratio in a range from 0.45 to 0.5.

¶76A. The toner fuser roller of Paragraph 2 wherein the release layer has a roughness value, Ra, not exceeding about 10 microinches.

¶76B. The toner fuser roller of Paragraph 3 wherein the release layer has a roughness value, Ra, not exceeding about 10 microinches.

¶77A. The simplex fusing station according to Paragraph 51 wherein the hard pressure roller includes a rigid cylindrical tube, optionally coated with an elastomer less than 1.25 mm thick including a fluoroelastomer or a silicone rubber.

¶77B. The simplex fusing station according to Paragraph 52 wherein the hard pressure roller includes a rigid cylindrical tube, optionally coated with an elastomer less than 1.25 mm thick including a fluoroelastomer or a silicone rubber.

¶78. The simplex fusing station according to Paragraph 54 wherein the hard fuser roller includes a thermally conductive rigid cylindrical tube, optionally coated with an elastomer less than 1.25 mm thick including a fluoroelastomer or a silicone rubber.

¶79. The toner fusing method according to Paragraph 58 wherein the hard pressure roller includes a rigid cylindrical tube, optionally coated with an elastomer less than 1.25 mm thick including a fluoroelastomer or a silicone rubber.

¶80. The toner fusing method according to Paragraph 63 wherein the hard fuser roller includes a thermally conductive rigid cylindrical tube, optionally coated with an elastomer less than 1.25 mm thick including a fluoroelastomer or a silicone rubber.

¶81. A conformable double-sleeved toner fuser roller for use in a fusing station of an electrostatographic machine, the fuser roller heated by a heat source which is external to the roller, the fuser roller including:

a substantially rigid cylindrical core member;

a replaceable removable inner sleeve member in the form of a seamless belt in intimate non-adhesive contact with and surrounding the core member;

a replaceable removable outer sleeve member in the form of a seamless belt in intimate non-adhesive contact with and surrounding the inner sleeve member;

wherein the inner sleeve member includes a strengthening band, a base cushion layer formed on the strengthening band having a Poisson's ratio in a range between 0.2 and 0.5, and an optional thin hard protective layer coated on the base cushion layer; and wherein further the outer sleeve member includes a stiffening layer in the form of a seamless belt in intimate contact with and surrounding the inner sleeve and an outer layer release layer having a Poisson's ratio in a range between 0.4 and 0.5 coated on the stiffening layer, the stiffening layer having a thickness less than about 500 micrometers and a Young's modulus in a range of 0.1 GPa to 500 GPa.

¶82. A conformable double-sleeved pressure roller, for use with an externally-heated fuser roller in a fusing station of an electrostatographic machine, including:

a substantially rigid cylindrical core member;

a replaceable removable inner sleeve member in the form of a seamless belt in intimate non-adhesive contact with and surrounding the core member;

a replaceable removable outer sleeve member in the form of a seamless belt in intimate non-adhesive contact with and surrounding the inner sleeve member;

wherein the inner sleeve member includes a strengthening band, a base cushion layer having a Poisson's ratio in a range between 0.2 and 0.5 formed on the strengthening band, and an optional thin hard protective layer coated on the base cushion layer; and wherein further the outer sleeve member includes a stiffening layer in the form of a seamless belt in intimate contact with and surrounding the inner sleeve and an optional outer layer having a Poisson's ratio in a range between 0.4 and 0.5 coated on the stiffening layer, the stiffening layer having a thickness less than about 500 micrometers and a Young's modulus in a range of 0.1 GPa to 500 GPa.

¶83. A conformable roller according to Paragraph 1 wherein the core member remains connected to a frame portion of said electrostatographic machine when the replaceable removable sleeve member is placed on or removed from the core member.

¶84. A conformable double-sleeved toner fuser roller according to Paragraph 81 wherein the core member remains connected to a frame portion of the electrostatographic machine when the outer replaceable removable sleeve member is placed on or removed from the inner sleeve member and when the inner replaceable removable sleeve member is placed on or removed from the core member.

¶85. A conformable double-sleeved pressure roller according to Paragraph 82 wherein the core member remains connected to a frame portion of the electrostatographic machine when the outer replaceable removable sleeve member is placed on or removed from the inner sleeve member and when the inner replaceable removable sleeve member is placed on or removed from the core member.

What is claimed is:

1. A conformable roller for use in a fusing station of an electrostatographic machine, said fusing station being provided with a pressure roller and a fuser roller for fusing a toner image on a receiver, said fuser roller made from a plurality of layers surrounding an axis of rotation, said conformable roller comprising:

a rigid cylindrically symmetric core member;

a flexible replaceable removable compliant sleeve member in the form of a tubular belt surrounding and removably contacting the core member, said sleeve member including a compliant base cushion layer formed on a tubular strengthening band, a barrier layer coated on the base cushion layer and, an outer layer on the barrier layer; and said fusing station including an external heat source for said fuser roller, at least one of said plurality of layers being thermally resistive.

2. The conformable roller according to claim 1 being said fuser roller.

3. The conformable roller according to claim 1 being said pressure roller.

4. The conformable roller according to claim 1 being both said fuser roller and said pressure roller.

5. The conformable roller according to claim 1 wherein said sleeve member comprises:

a compliant base cushion layer formed on a tubular strengthening band;

a stiffening layer in intimate contact with and surrounding the base cushion layer; and, an outer layer on the stiffening layer.

6. The conformable roller according to claim 1 further comprising an indicia located on an outer surface of said core member, said indicia being provided on said core member to indicate a parameter relative to said core member that may be read, sensed or detected by an indicia detector, either visually, mechanically, optically, magnetically, or by a radio frequency.

7. The conformable roller according to claim 1 further comprising an indicia located on an outer surface of said sleeve member, said indicia being provided on said sleeve member to indicate a parameter relative to said sleeve member that may be read, sensed or detected by an indicia detector, either visually, mechanically, optically, magnetically, or by a radio frequency.

8. A sleeve member, included in a conformable roller of a fusing station of an electrostatographic machine, said fusing station being provided with a pressure roller and a fuser roller for fusing a toner image on a receiver, said fuser roller being provided with an external heat source, said conformable roller including both a core member and a sleeve member, said sleeve member comprising:

a tubular strengthening band;

a compliant base cushion layer formed on the strengthening band;

an optional barrier layer coated on said base cushion layer;

an outer layer coated on the barrier layer;

wherein said sleeve member has the form of a tubular belt surrounding and nonadhesively intimately contacting said core member.

9. A method of making a sleeve member of claim 8, including the steps of:

providing a cylindrical mandrill;

mounting on said mandrill said strengthening band by sliding said strengthening band over said mandrel to a suitable position, the sliding being accomplished by making an inner diameter of said strengthening band temporarily larger during the sliding than an outer diameter of said mandrel;

forming said base cushion layer on said strengthening band;

uniformly coating said base cushion layer by said barrier layer;

uniformly coating said barrier layer by said outer layer to form a completed sleeve member; and, sliding said completed sleeve member off said mandrill, the sliding being accomplished by making an inner diameter of said sleeve member temporarily larger during the sliding than an outer diameter of said mandrill.

10. A sleeve member, included in a conformable roller of a fusing station of an electrostatographic machine, said fusing station being provided with a pressure roller and a fuser roller for fusing a toner image on a receiver, said fuser roller being provided with an external heat source, said conformable roller including both a core member and a sleeve member, said sleeve member comprising:

a tubular strengthening band;

a compliant base cushion layer formed on the strengthening band;

a stiffening layer in intimate contact with and surrounding the base cushion layer;

an outer layer on the stiffening layer;

wherein said sleeve member has the form of a tubular belt surrounding and nonadhesively intimately contacting said core member.

11. A method of making a sleeve member of claim 10, including the steps of:

providing a cylindrical mandrill;

mounting on said mandrill said strengthening band by sliding said strengthening band over said mandrel to a suitable position, the sliding being accomplished by making an inner diameter of said strengthening band temporarily larger during the sliding than an outer diameter of said mandrel;

forming said base cushion layer on said strengthening band;

providing said stiffening layer in the shape of a seamless metal tube;

sliding said metal tube over an outer surface of said base cushion layer, the metal tube having, prior to said sliding of said metal tube, an inner diameter smaller than-an outside diameter of said base cushion layer formed on said strengthening band, the sliding being accomplished by making said inner diameter of said metal tube temporarily larger during the sliding than the outside diameter of said base cushion layer;

uniformly coating said metal tube by said compliant release layer to form a completed sleeve member; and sliding said completed sleeve member off said mandrill, the sliding being accomplished by making an inner diameter of said sleeve member temporarily larger during the sliding than an outer diameter of said mandrill.

12. An inner sleeve member, included in a double-sleeved conformable, roller of a fusing station of an electrostatographic machine, said fusing station being provided with a pressure roller and a fuser roller for fusing a toner image on a receiver, said fuser roller being provided with an external heat source, said conformable roller including a core member and an inner sleeve member and an outer sleeve member, said inner sleeve member comprising:

a tubular strengthening band;

a compliant base cushion layer formed on the strengthening band;

an optional protective layer coated on the base cushion layer;

wherein said inner sleeve member has the form of a tubular belt surrounding and nonadhesively intimately contacting said core member.

13. A method of making an inner sleeve member of claim 12, including the steps of:

providing a cylindrical mandrill;

mounting on said mandrill said strengthening band by sliding said strengthening band over said mandrel to a suitable position, the sliding being accomplished by making an inner diameter of said strengthening band temporarily larger during the sliding than an outer diameter of said mandrel;

forming said base cushion layer on said strengthening band;

optionally coating said base cushion layer with a protective layer to form a completed inner sleeve member; and sliding said completed inner sleeve member off said mandrill, the sliding being accomplished by making an inner diameter of said inner sleeve member temporarily larger during the sliding than an outer diameter of said mandrill.

14. An outer sleeve member, included in a double-sleeved conformable roller of a fusing station of an electrostatographic machine, said fusing station being provided with a pressure roller and a fuser roller for fusing a toner image on a receiver, said fuser roller being provided with an external heat source, said conformable roller including a core member and an inner sleeve member and an outer sleeve member, the inner sleeve member including a tubular strengthening band, a compliant base cushion layer formed on the strengthening band, and an optional protective layer coated on the base cushion layer, said outer sleeve member comprising:

a stiffening layer in intimate contact with and surrounding the base cushion layer;

an outer layer on the stiffening layer;

wherein said outer sleeve member has the form of a tubular belt surrounding and nonadhesively intimately contacting said inner sleeve member.

15. The outer sleeve member according to claim 14, further comprising an indicia located on an outer surface of said outer sleeve member, said indicia being provided on said outer sleeve member to indicate a parameter relative to said outer sleeve member that may be read, sensed or detected by an indicia detector, either visually, mechanically, optically, magnetically, or by a radio frequency.

16. A method of making an outer sleeve member of claim 14, including the steps of:

providing a cylindrical mandrill;

mounting on said mandrill said stiffening layer by sliding said stiffening layer over said mandrel to a suitable position, the sliding being accomplished by making an inner diameter of said stiffening layer temporarily larger during the sliding than an outer diameter of said mandrel;

coating said stiffening layer by said outer layer to form a completed outer sleeve member; and sliding said completed outer sleeve member off said mandrill, the sliding being accomplished by making an inner diameter of said outer sleeve member temporarily larger during the sliding than an outer diameter of said mandrill.

17. A fusing station of an electrostatographic machine comprising:

a rotating externally heated compliant fuser roller, said compliant fuser roller including a compliant removable replaceable sleeve member surrounding and nonadhesively intimately contacting a rigid cylindrical core member, said sleeve member including (a), (b), (c) and (d), wherein (a) is a tubular strengthening band, (b) is a base cushion layer formed on the strengthening band, (c) is a stiffening layer surrounding and in intimate contact with said base cushion layer, said stiffening layer having a Young's modulus in a range of approximately 0.1 GPa to 500 GPa and a thickness less than about 500 micrometers, (d) is an outer layer on said stiffening layer; and a counter-rotating hard pressure roller engaged to form a fusing nip with the compliant fuser roller.

18. A fusing station according to claim 17 wherein said base cushion layer has a Poisson's ratio in a range between approximately 0.2 and 0.5, and said outer layer has a Poisson's ratio in a range of between approximately 0.4 and 0.5.

19. A fusing station according to claim 17 wherein further:

said strengthening band of the sleeve member of said fuser roller has a Young's modulus in a range of approximately between 100 MPa–500 GPa and a thickness in a range of approximately between 20 micrometers to 500 micrometers;

said compliant base cushion layer of the sleeve member of the fuser roller includes an elastomer, the base cushion layer containing 3 to 30 volume percent of a particulate filler having a particle size in a range of approximately between 0.1 micrometer to 100 micrometers, the base cushion layer having a thickness in a range of approximately 0.25 mm to 25 mm, the base cushion layer having a thermal conductivity in a range of approximately 0.08 BTU/hr/ft/° F. to 0.3 BTU/hr/ft/° F., the base cushion layer having a Poisson's ratio in a range between approximately 0.2 and 0.5, the base cushion layer having a Young's modulus in a range of approximately 0.05 MPa to 10 MPa;

said stiffening layer of the sleeve member of the fuser roller includes a seamless belt having a thickness in a range of approximately between 75 micrometers to 250 micrometers, the stiffening layer having a Young's modulus in a range of approximately between 10 GPa and 350 GPa; and said outer layer of the sleeve member of the fuser roller includes an elastomer containing 5 to 50 volume percent of a particulate filler having a particle size in a range of approximately 0.1 micrometer to 100 micrometers, the outer layer having a thickness less than about 1 millimeter, the outer layer having a thermal conductivity in a range of approximately 0.2 BTU/hr/ft/° F. to 0.5 BTU/hr/ft/° F., the outer layer having a Poisson's ratio in a range between approximately 0.4 and 0.5, and, the outer layer having a Young's modulus in a range of approximately 0.05 MPa to 10 MPa.

20. A toner fusing method, for use in an electrostatographic machine having a fusing station according to claim 17, said toner fusing method comprising the steps of:

forming a fusing nip by engaging said rotating compliant fuser roller having an external source of heat and said counter-rotating hard pressure roller, one of the rollers being a driven roller and the other frictionally driven by pressure contact in the nip;

forming an unfused toner image on a surface of a receiver sheet;

feeding the leading edge of the receiver into the nip and allowing the unfused toner image on the receiver sheet to pass through the fusing nip with the unfused toner image facing the fuser roller; and wherein a compliancy of said compliant fuser roller in combination with said stiffening layer together provide a reduced wear rate of said fuser roller and an improved quality of a toner image fused on said receiver sheet by said fusing station.

21. A fusing station of an electrostatographic machine comprising:

a rotating externally heated compliant fuser roller, the compliant fuser roller including a compliant removable replaceable sleeve member surrounding and nonadhesively intimately contacting a rigid cylindrical core member, said sleeve member including (a), (b), (c) and (d), wherein (a) is a tubular strengthening band, (b) is a base cushion layer formed on the strengthening band, (c) is an optional barrier layer on said base cushion layer, (d) is an outer layer on said barrier layer; and a counter-rotating hard pressure roller engaged to form a fusing nip with the compliant fuser roller.

22. A fusing station according to claim 21 wherein said base cushion layer has a Poisson's ratio in a range between approximately 0.2 and 0.5, and said outer layer has a Poisson's ratio in a range of between approximately 0.4 and 0.5.

23. A fusing station according to claim 21 wherein further:

said strengthening band of said sleeve member of said fuser roller has a Young's modulus in a range of approximately between 100 MPa–500 GPa and a thickness in a range of approximately between 20 micrometers to 500 micrometers;

said compliant base cushion layer of the sleeve member of the fuser roller includes an elastomer, the base cushion layer containing 3 to 30 volume percent of a particulate filler having a particle size in a range of approximately between 0.1 micrometer to 100 micrometers, the base cushion layer having a thickness in a range of approximately 0.25 mm to 25 mm, the base cushion layer having a thermal conductivity in a range of approximately 0.08 BTU/hr/ft/° F. to 0.3 BTU/hr/ft/° F., the base cushion layer having a Poisson's ratio between approximately 0.2 and 0.5, the base cushion layer having a Young's modulus in a range of approximately 0.05 MPa to 10 MPa;

said barrier layer of the sleeve member of the fuser roller includes a fluoroelastomer plus 20 to 40 volume percent of a particulate filler; and said outer layer of the sleeve member of the fuser roller includes an elastomer and contains 5 to 50 volume percent of a particulate filler having a particle size in a range of approximately 0.1 micrometer to 100 micrometers, the outer layer having a thickness less than about 1 millimeter, the outer layer having a thermal conductivity in a range of approximately 0.2 BTU/hr/ft/° F. to 0.5 BTU/hr/ft/° F., the outer layer having a Poisson's ratio in a range between approximately 0.4 and 0.5, the outer layer having a Young's modulus in a range of approximately 0.05 MPa to 10 MPa.

24. A toner fusing method, for use in an electrostatographic machine having a fusing station according to claim 21, said toner fusing method comprising the steps of:

forming a fusing nip by engaging said rotating compliant fuser roller having an external source of heat and said counter-rotating hard pressure roller, one of the rollers being a driven roller and the other frictionally driven by pressure contact in the nip;

forming an unfused toner image on a surface of a receiver sheet;

feeding the leading edge of the receiver into the nip and allowing the unfused toner image on the receiver sheet to pass through the fusing nip with the unfused toner image facing the fuser roller; and wherein a low cost of ownership of said fusing station is provided by use of said replaceable removable sleeve member.

25. A fusing station of an electrostatographic machine, comprising:

a rotating externally heated compliant fuser roller, said compliant fuser roller including a compliant removable replaceable sleeve member surrounding and nonadhesively intimately contacting a rigid cylindrical core member, said sleeve member including (a), (b), (c) and (d), wherein (a) is a tubular strengthening band, (b) is a base cushion layer formed on the strengthening band, (c) is a stiffening layer surrounding and in intimate contact with said base cushion layer, the stiffening layer having a Young's modulus in a range of approximately 0.1 GPa to 500 GPa and a thickness less than about 500 micrometers, (d) is an outer layer on said stiffening layer; and a counter-rotating compliant pressure roller engaged to form a fusing nip with said compliant fuser roller, the compliant pressure roller including a compliant removable replaceable sleeve member surrounding and nonadhesively intimately contacting a rigid cylindrical core member, said sleeve member including (a), (b), (c) and (d), wherein (a) is a tubular strengthening band, (b) is a base cushion layer formed on the strengthening band, (c) is a stiffening layer surrounding and in intimate contact with said base cushion layer, the stiffening layer having a Young's modulus in a range of approximately 0.1 GPa to 500 GPa and a thickness less than about 500 micrometers, (d) is an outer layer on said stiffening layer.

26. A fusing station according to claim 25 wherein said base cushion layer of said compliant fuser roller has a Poisson's ratio in a range between approximately 0.2 and 0.5, said outer layer of said compliant fuser roller has a Poisson's ratio in a range of between approximately 0.4 and 0.5, said base cushion layer of said compliant pressure roller has a Poisson's ratio in a range between approximately 0.2 and 0.5, and said outer layer of said compliant pressure roller has a Poisson's ratio in a range of between approximately 0.4 and 0.5.

27. A fusing station of an electrostatographic machine comprising:

a rotating compliant pressure roller including a compliant removable replaceable sleeve member surrounding and nonadhesively intimately contacting a rigid cylindrical core member, said sleeve member including (a), (b), (c) and (d), wherein (a) is a tubular strengthening band, (b) is a base cushion layer formed on the strengthening band, (c) is a stiffening layer surrounding and in intimate contact with said base cushion layer, said stiffening layer having a Young's modulus in a range of approximately 0.1 GPa to 500 GPa and a thickness less than about 500 micrometers, (d) is an outer layer on said stiffening layer; and a counter-rotating externally heated hard fuser roller engaged to form a fusing nip with said compliant pressure roller.

28. A fusing station according to claim 27 wherein said base cushion layer has a Poisson's ratio in a range between approximately 0.2 and 0.5, and said outer layer has a Poisson's ratio in a range of between approximately 0.4 and 0.5.

29. A fusing station of an electrostatographic machine comprising:

a rotating first heated fuser roller;

a counter-rotating second heated fuser roller engaged to form a pressure fusing nip with the first fuser roller;

wherein at least one of said first and second heated fuser rollers further includes a compliant removable replaceable sleeve member surrounding and nonadhesively intimately contacting a rigid cylindrical core member, said sleeve member including (a), (b), (c) and (d), wherein (a) is a tubular strengthening band, (b) is a base cushion layer formed on the strengthening band, (c) is a stiffening layer surrounding and in intimate contact with said base cushion layer, said stiffening layer having a Young's modulus in a range of approximately 0.1 GPa to 500 GPa and a thickness less than about 500 micrometers, (d) is an outer layer on said stiffening layer; and wherein at least one of said first and second heated fuser rollers is heated by an external source of heat.

* * * * *